US006252572B1

(12) United States Patent
Kurumisawa et al.

(10) Patent No.: US 6,252,572 B1
(45) Date of Patent: Jun. 26, 2001

(54) DISPLAY DEVICE, DISPLAY DEVICE DRIVE METHOD, AND ELECTRONIC INSTRUMENT

(75) Inventors: Takashi Kurumisawa; Akihiko Ito; Shingo Isozaki; Satoru Ito, all of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/676,205

(22) PCT Filed: Nov. 17, 1995

(86) PCT No.: PCT/JP95/02359

§ 371 Date: Jul. 15, 1996

§ 102(e) Date: Jul. 15, 1996

(87) PCT Pub. No.: WO96/16346

PCT Pub. Date: May 30, 1996

(30) Foreign Application Priority Data

| | | |
|---|---|---|
| Nov. 17, 1994 | (JP) | 6-283167 |
| Dec. 28, 1994 | (JP) | 6-326816 |
| Dec. 28, 1994 | (JP) | 6-326817 |
| Aug. 4, 1995 | (JP) | 7-199826 |

(51) Int. Cl.[7] ..... G09G 3/36

(52) U.S. Cl. ..... 345/98; 345/99; 345/100; 345/103

(58) Field of Search ..... 345/55, 56, 58, 345/90, 92, 94–100, 196, 197, 203, 209.5, 508, 511, 202, 103, 99, 104

(56) References Cited

U.S. PATENT DOCUMENTS

| | | |
|---|---|---|
| 3,603,725 | 9/1971 | Cutler . |
| 3,668,639 | 6/1972 | Harmuth . |
| 3,973,252 | 8/1976 | Mitomo et al. . |
| 4,097,780 | 6/1978 | Ngo . |
| 4,100,579 | 7/1978 | Ernstoff . |

(List continued on next page.)

FOREIGN PATENT DOCUMENTS

| | | |
|---|---|---|
| 654 473 | 9/1984 | (CH) . |
| 4031905 | 4/1991 | (DE) . |
| 0 206 178 | 12/1986 | (EP) . |

(List continued on next page.)

OTHER PUBLICATIONS

Doctoral Thesis by Ruckmongathan, T.N., Fed 1998 "Some New Addressing Techniques For RMS Responding Matrix LCDs".

(List continued on next page.)

*Primary Examiner*—Almis R. Jankus
*Assistant Examiner*—Henry N. Tran

(57) ABSTRACT

A display device is provided having M data lines and N scanning lines arranged in a matrix and forming a plurality of display elements disposed at intersections of the M data and N scanning lines, wherein N and M are each integers greater than 1, for displaying an image. A scanning line drive circuit applies a scanning voltage signal possessing a specified selection voltage pattern simultaneously to n scanning lines from among the N scanning lines, where n is an integer greater than 1 and less than N. First and second frame memory devices accumulate display data representing the image to be displayed, such that reading the display data of a first frame period from the first frame memory device is performed substantially simultaneously with the writing of the display data of a second frame period into the second memory device. A data line drive circuit determines a data voltage signal to be applied to the M data lines in accordance with a comparison between the selection voltage pattern applied by the scanning line drive circuit and the display data read from one of the first and second memory devices. The data line drive circuit also applies the determined data voltage signal to the M data lines.

50 Claims, 60 Drawing Sheets

U.S. PATENT DOCUMENTS

| | | | | |
|---|---|---|---|---|
| 4,309,701 | | 1/1982 | Nishimura . | |
| 4,608,558 | | 8/1986 | Amstutz et al. . | |
| 4,633,441 | | 12/1986 | Ishimoto . | |
| 4,672,683 | | 6/1987 | Matsueda . | |
| 4,683,497 | | 7/1987 | Mehrgardt . | |
| 4,693,569 | | 9/1987 | Harada et al. . | |
| 4,812,837 | | 3/1989 | Shiraishi et al. . | |
| 4,873,516 | | 10/1989 | Castleberry . | |
| 4,894,646 | | 1/1990 | Ryman . | |
| 5,075,683 | | 12/1991 | Ghis . | |
| 5,172,107 | | 12/1992 | Kanno et al. . | |
| 5,196,738 | * | 3/1993 | Takahara et al. | 307/296.1 |
| 5,262,881 | * | 11/1993 | Kuwata et al. | 359/55 |
| 5,280,280 | | 1/1994 | Hotto . | |
| 5,420,604 | | 5/1995 | Scheffer et al. . | |
| 5,459,495 | | 10/1995 | Scheffer et al. . | |
| 5,475,397 | | 12/1995 | Saidi . | |
| 5,485,173 | | 1/1996 | Scheffer et al. . | |
| 5,489,919 | * | 2/1996 | Kuwata et al. | 345/100 |
| 5,648,792 | * | 7/1997 | Sata et al. | 345/92 |
| 5,689,280 | * | 11/1997 | Asari et al. | 345/89 |
| 5,726,677 | | 3/1998 | Imamura | 345/99 |
| 5,754,157 | * | 5/1998 | Kuwata et al. | 345/100 |
| 5,771,031 | * | 6/1998 | Kinoshita et al. | 345/98 |
| 5,844,536 | * | 12/1998 | Okada et al. | 345/94 |
| 5,877,738 | | 3/1999 | Ito et al. | 345/94 |
| 5,900,856 | | 5/1999 | Lino et al. | 345/100 |
| 5,914,699 | | 6/1999 | Imamura | 345/99 |
| 5,963,189 | * | 10/1999 | Ito et al. | 345/100 |

FOREIGN PATENT DOCUMENTS

| | | |
|---|---|---|
| 0 349 415 | 1/1990 | (EP) . |
| 0 388 976 | 9/1990 | (EP) . |
| 0 479 450 | 4/1992 | (EP) . |
| 0 507 061 | 10/1992 | (EP) . |
| 0 569 974 | 11/1993 | (EP) . |
| 0 595 495 | 5/1994 | (EP) . |
| 0 617 399 | 9/1994 | (EP) . |
| 2 106 689 | 4/1983 | (GB) . |
| 2 179 185 | 2/1987 | (GB) . |
| 2 249 855 | 5/1992 | (GB) . |
| 2 271 458 | 4/1994 | (GB) . |
| 54-22856 | 8/1979 | (JP) . |
| 57-15393 | 3/1982 | (JP) . |
| 61-262724 | 11/1986 | (JP) . |
| 62-102230 | 5/1987 | (JP) . |
| 63-2923 | 1/1988 | (JP) . |
| 1-267694 | 10/1989 | (JP) . |
| 3-185490 | 8/1991 | (JP) . |
| 5-46127 | 2/1993 | (JP) . |
| 5-100642 | 4/1993 | (JP) . |
| 6-4049 | 1/1994 | (JP) . |
| 6-138853 | 5/1994 | (JP) . |
| 6-167947 | 6/1994 | (JP) . |
| 6-308914 | 11/1994 | (JP) . |
| 6-67628 | 11/1994 | (JP) . |
| 6-347751 | 12/1994 | (JP) . |
| 6-348237 | 12/1994 | (JP) . |
| WO 93/18501 | 9/1993 | (WO) . |
| WO 93/20550 | 10/1993 | (WO) . |
| WO 95/01628 | 1/1995 | (WO) . |

OTHER PUBLICATIONS

1994 SID International Symposium, "7.1:A9.4–in. Color VGA F–STN Display With Fast Response Time And High Contrast Ratio by Using MLS Method", H. Muraji, H. Koh, T. Kuwata, Y. Nakagawa; Asahi Glass Co., Ltd., Kanagawa, Japan, pp. 61–64.

SID 94 Digest, "7.2: An Addressing Technique with Reduced Hardware Complexity", T.N. Ruckmongathan, Raman Research Institute, Bangalore, India, pp. 65–68.

SID 94 Digest, 7.3: A Study of the Active Drive Method for STN–LCDs, Y. Fukui, M. Yumine, T. Matsumoto, Audio and Video Research Laboratory, Matsushita Electric Industrial Co., Ltd., Osaka, Japan, T. Otani, Y. Kobayashi, LCD Development Center, Matsushita Electric Industrial Co., Ltd., Osaka, Japan, pp. 69–72.

1992 SID International Symposium, May 1992, "Active Addressing Method For High–Contrast Video–Rate STN Displays," by T.J. Scheffer, B. Clifton, pp. 228–231.

2320 Proceedings of the S.I.D. vol. 24 (1983) No. 3, Los Angeles, CA USA "New Addressing Techniques for Multiplexed Liquid Crystal Displays" by T.N. Ruckmongathan and N.V. Madhusudana, pp. 259–262.

2449 Displays vol. 14 (1993) No. 2, Jordan Hill, Oxford, GB, "Active Addressing™ of STN displays for high–performance video applications" by T.J. Scheffer, B. Clifton, D. Prince and A.R. Conner, pp. 74–85.

Proceedings Japan Display '92, Hiroshima, Japan; B. Clifton, D. Prince, In Focus Systems, Inc. Tualatin, OR, USA "Hardware Architectures for Video–Rate, Active Addressed STN Displays", pp. 503, 506.

Japan Display 92, *Pulse Height Modulation (PHM) Gray Shading Methods for Passive Matrix LCDs*, A.R. Connor, T. J. Scheffer, pp. 69–72.

*Old Thinking, New Methods and Television*, Wireless, Jan. 1969.

Information And System Series From The Theory Of Matrix Construction To The Walsh Function, "The Hadamard Matrix And Its Application", Association of Electronics Communication Engineer, Feb. 1979, (Japanese and English Translation).

1988 International Display Research Conference; "A Generalized Addressing Technique For RMS Responding Matrix LCDS"; T.N. Ruckmongathan; Raman Research Institute, Bangalore 560080, India; pp. 80–85.

* cited by examiner

FIG._22A
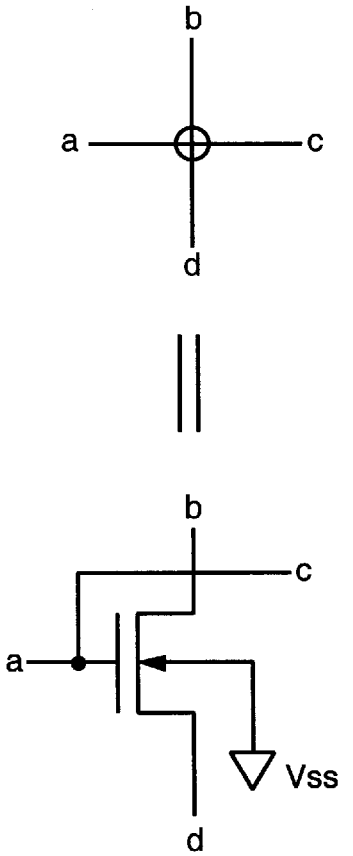
FIG._22B
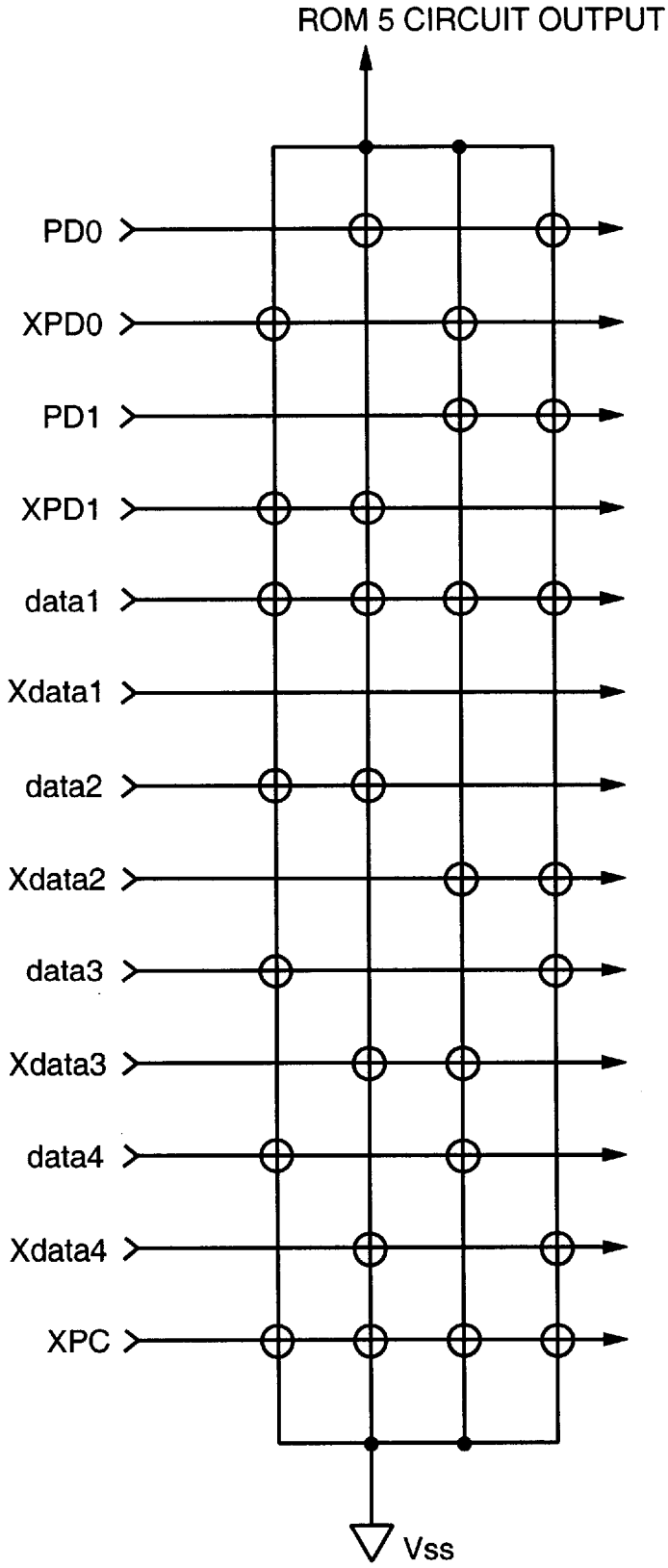
FIG._22C $$\begin{pmatrix} 1 & 1 & 1 & 1 \\ 1 & 1 & 0 & 0 \\ 1 & 0 & 0 & 1 \\ 1 & 0 & 1 & 0 \end{pmatrix}$$

$$\begin{pmatrix} 0 & 0 & 1 & 0 \\ 0 & 1 & 0 & 0 \\ 1 & 0 & 0 & 0 \\ 0 & 0 & 0 & 1 \end{pmatrix}$$

FIELDS

| | 1 | 2 | 3 | 4 |
|---|---|---|---|---|
| 1 LINE | + | + | + | + |
| 2 LINE | + | + | − | − |
| 3 LINE | + | − | − | + |
| 4 LINE | + | − | + | − |

FIELDS

| | 1 | 2 | 3 | 4 |
|---|---|---|---|---|
| 1 LINE | + | − | − | − |
| 2 LINE | − | + | − | − |
| 3 LINE | − | − | − | + |
| 4 LINE | − | − | + | − |

FIG._60A $$\begin{bmatrix} + & + & - & + \\ + & - & + & + \\ - & + & + & + \\ + & + & + & - \end{bmatrix}$$

FIG._60B $$\begin{array}{c} \begin{bmatrix} + & + & - & + \\ + & - & + & + \\ - & + & + & + \\ + & + & + & - \end{bmatrix} \\ \begin{array}{cccc} a & b & c & d \end{array} \end{array}$$

FIG._60C $$\begin{bmatrix} - & - & + & - \\ - & - & - & + \\ + & - & - & - \end{bmatrix}$$

FIG._61A
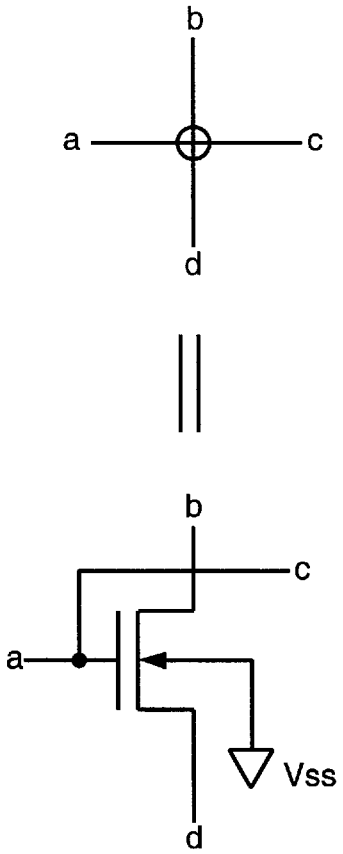
FIG._61B
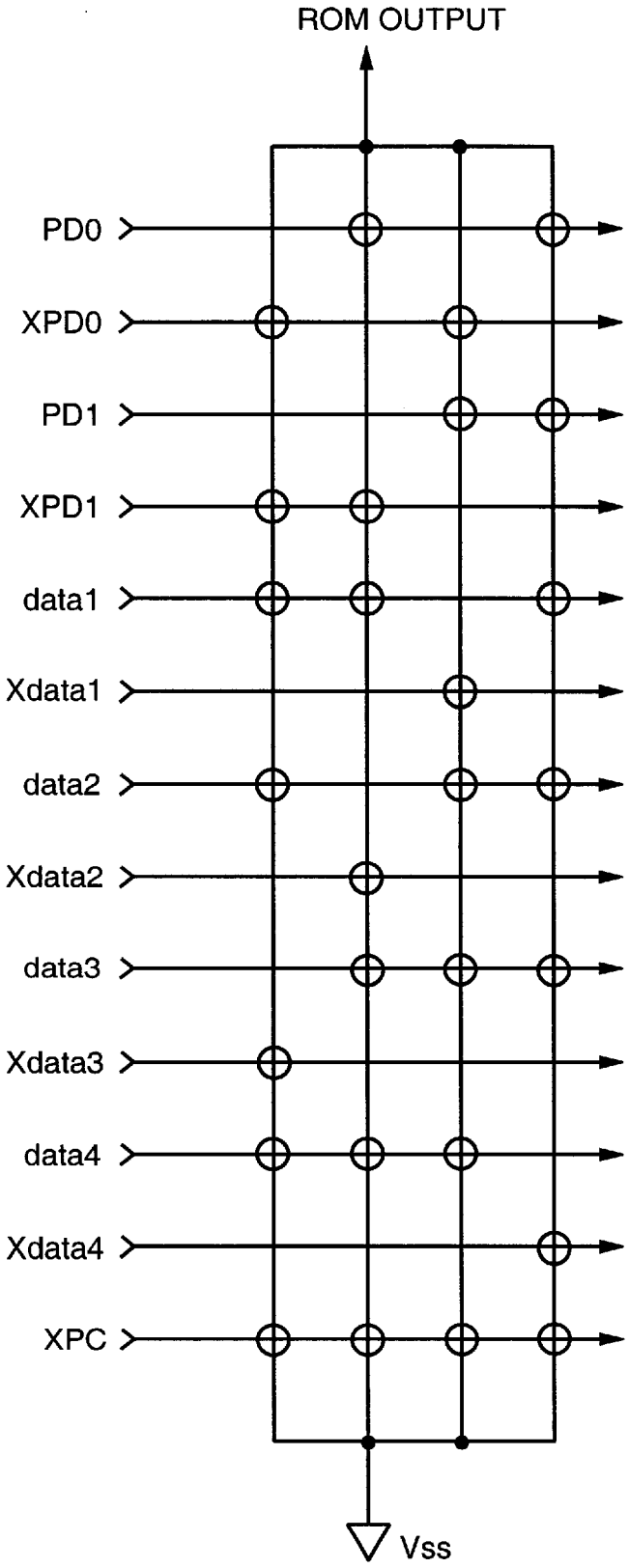
FIG._61C

DISPLAY DEVICE, DISPLAY DEVICE DRIVE METHOD, AND ELECTRONIC INSTRUMENT

FIELD OF THE INVENTION

The present information relates to a display device, a display device drive method, and an electronic instrument; and more particularly to a display device that uses the so-called multi-line drive method which simultaneously selects h scanning lines (where h is an integer of at least 2) out of all scanning lines for display, and the drive method thereof.

RELATED ART

Simple-matrix liquid crystal display devices need no expensive switching elements on the substrate and thus are cheaper than active-matrix liquid crystal display devices. As a result, simple-matrix liquid crystal display devices are widely used in equipment such as the monitor of portable personal computers.

The so-called multi-line drive method has been suggested, in order to lower the drive voltage for such simple-matrix liquid crystal display devices and to improve the display quality.

The multi-line drive method is discussed in the following articles, for example:

(1) A generalized addressing technique for RMS responding matrix LCDs, 1988 International Display Research Conference pp. 80–85.

(2) Publication of Unexamined Japanese Patent Applications, 1993 Gazette No. 46127.

(3) Publication of Unexamined Japanese Patent Applications, 1993 Gazette No. 100642.

(4) Publication of Unexamined Japanese Patent Applications, 1994 Gazette No. 4049.

The inventors of the present invention performed various types of evaluation on the data line drive circuits, scanning line drive circuits, and the related circuits of liquid crystal display devices utilizing the multi-line drive method, and as a result has identified the problems associated with the existing circuits.

The present invention is based on the evaluation results obtained by the above-mentioned inventor.

SUMMARY OF THE INVENTION

It is one of the objects of the invention to provide a display device utilizing the multi-line drive method, that can achieve natural, distortion-free display.

It is another object of the invention to simplify the configuration of the decoder in the data line drive circuit of display devices utilizing the multi-line drive method.

It is a further object of the invention to prevent the degradation in display quality of display devices utilizing the multi-line drive method by preventing a cross-talk phenomenon from occurring during the periods that do not contribute to image display.

It is a still further object of the invention to simplify the configuration of the scanning line drive circuit of display devices utilizing the multi-line drive method.

It is a still further object of the invention to prevent image flickering, etc. by suppressing the fluctuation in liquid crystal panel intensity during a single frame period.

In the display device according to the present invention utilizing the multi-line drive method, the frame memory (one of the comprising elements of the data line drive circuit) preferably consists of at least a first RAM and a second RAM, using the first RAM for reading data and the second RAM for writing data during one frame period, and using the second RAM for reading data and the first RAM for writing data during the following frame, thereafter alternating the two RAMs for reading and writing.

In this way, image data belonging to different frame periods do not coexist during the determination of the voltage to be supplied to the data lines, resulting in accurate display.

Furthermore, in an embodiment which uses only one frame memory device, the number of image data corresponding to the scanning lines to be simultaneously driven are preferably written into the frame memory simultaneously.

In this way, image data belonging to a different frame period will not become mixed in with part of multiple image data required for the determination of the voltage to be supplied to the data lines, preventing unwanted streak-line patterns from appearing in part of the display image and preventing image quality deterioration.

The above configuration achieves a display device utilizing the multi-line drive method, that can achieve natural, distortion-free display.

Additionally, in the display device according to the present invention utilizing the multi-line drive method, the decoder for determining the voltages to be supplied to the data lines preferably consists of ROMs.

In this way, the decoder configuration can be simplified, and results in a significant chip area reduction when the decoder is made into an integrated circuit (IC).

Furthermore, the display device according to the present invention utilizing the multi-line drive method, is preferably provided with a circuit for making the voltage to be supplied to the data line constant during the periods that do not contribute to image display. "Periods that do not contribute to image display" mean retrace lines periods and touch position detection periods in a touch panel.

In this way, cross-talk phenomena can be prevented from occurring during the periods that do not contribute to image display, and deterioration in the display quality of display devices utilizing the multi-line drive method can be prevented.

Furthermore, in the display device according to the present invention utilizing the multi-line drive method, the scanning line drive circuit preferably separates and processes the data required for selecting a scanning line and the data required for determining the voltage to be supplied to the scanning line.

In this way, the number of shift registers can be drastically reduced. That is, if h denotes the number of scanning lines simultaneously driven and n denotes the total number of scanning lines, the number of shift registers required is only n/h. This achieves the simplification of the configuration of the scanning line drive circuit in a display device utilizing the multi-line drive method.

Moreover, in the display device according to the present invention utilizing the multi-line drive method, the scanning line drive circuit and the data line drive circuit mutually provide and receive the information related to the scanning voltage pattern (also called "selection voltage pattern") when the scanning voltage pattern is cyclically changed within a single frame period.

In this way, the information related to the scanning voltage pattern need be input into either the scanning line drive circuit or the data line drive circuit, simplifying the control of the display device.

BRIEF EXPLANATION OF THE FIGURES

FIGS. 22A–C show a configuration example of the ROM shown in FIG. 21.

FIG, 35 shows yet another configuration example of a retrace line period detection circuit.

Figure 36:
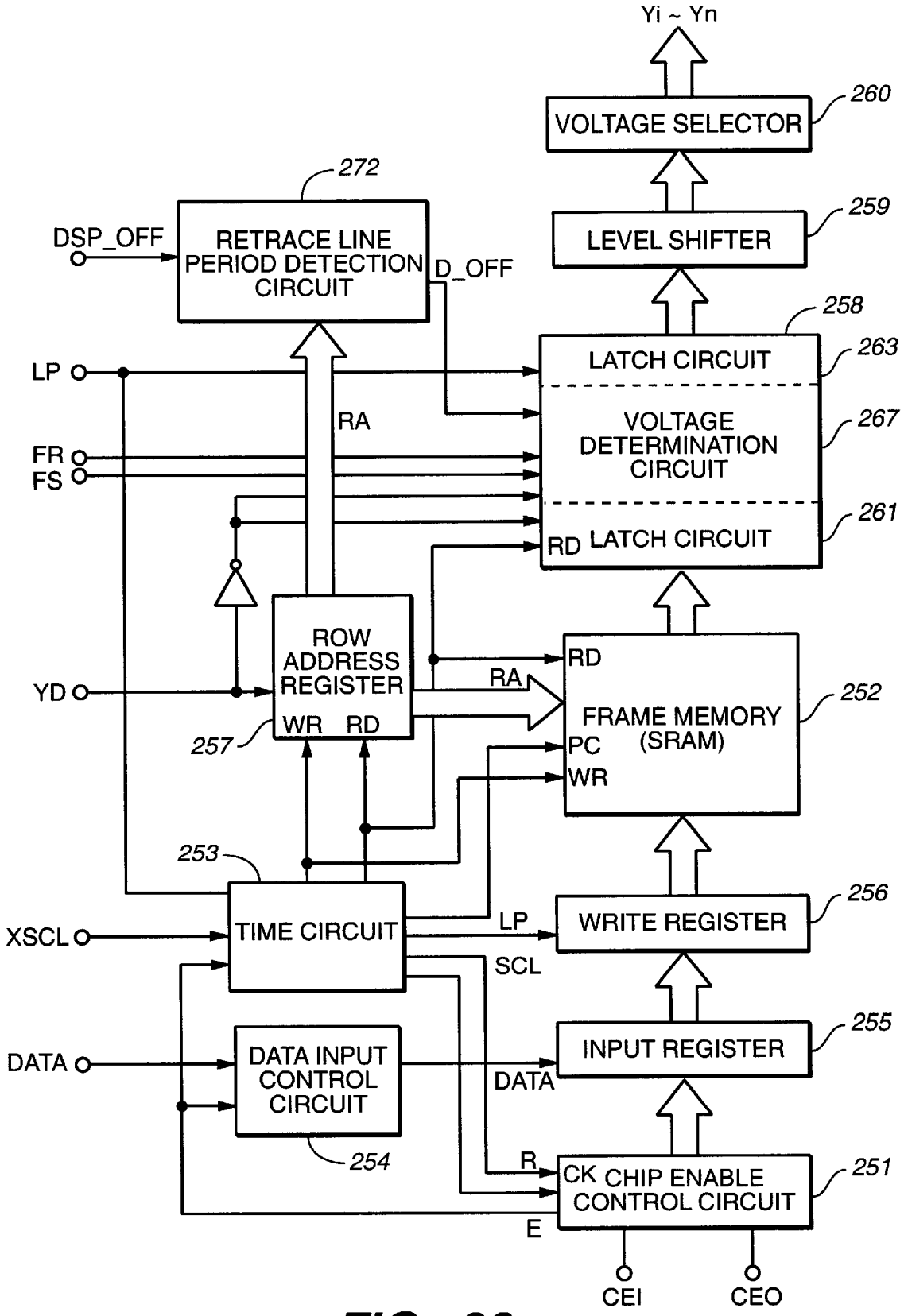

FIG. 36 is a block diagram showing another modified configuration example related to Embodiment 4.

Figure 37:
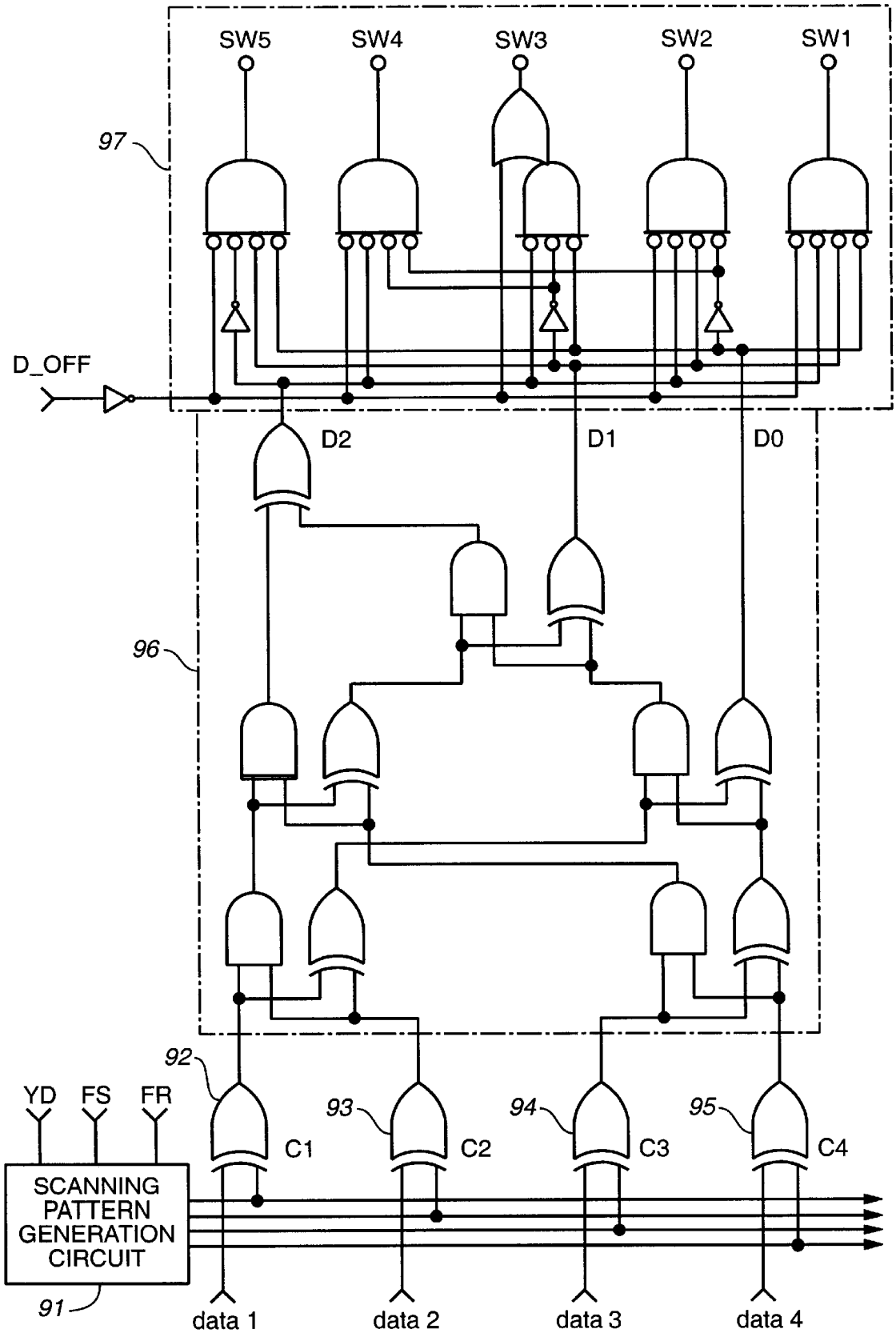

FIG. 37 is a circuit diagram showing a configuration example of voltage determination circuit 267 shown in FIG. 36.

Figure 38:
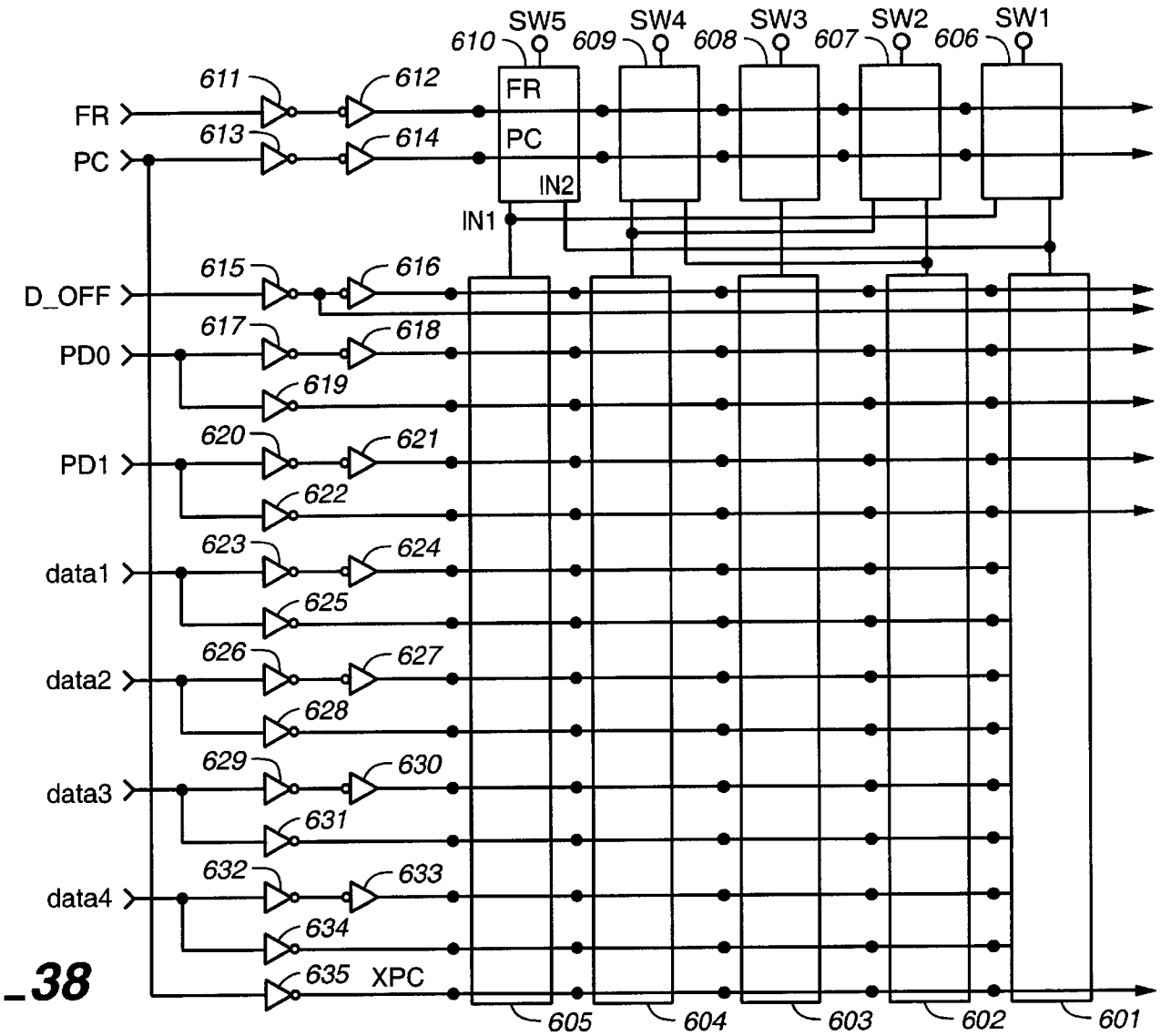

FIG. 38 shows an example in which voltage determination circuit 267 is configured using ROMs.

Figure 39B:
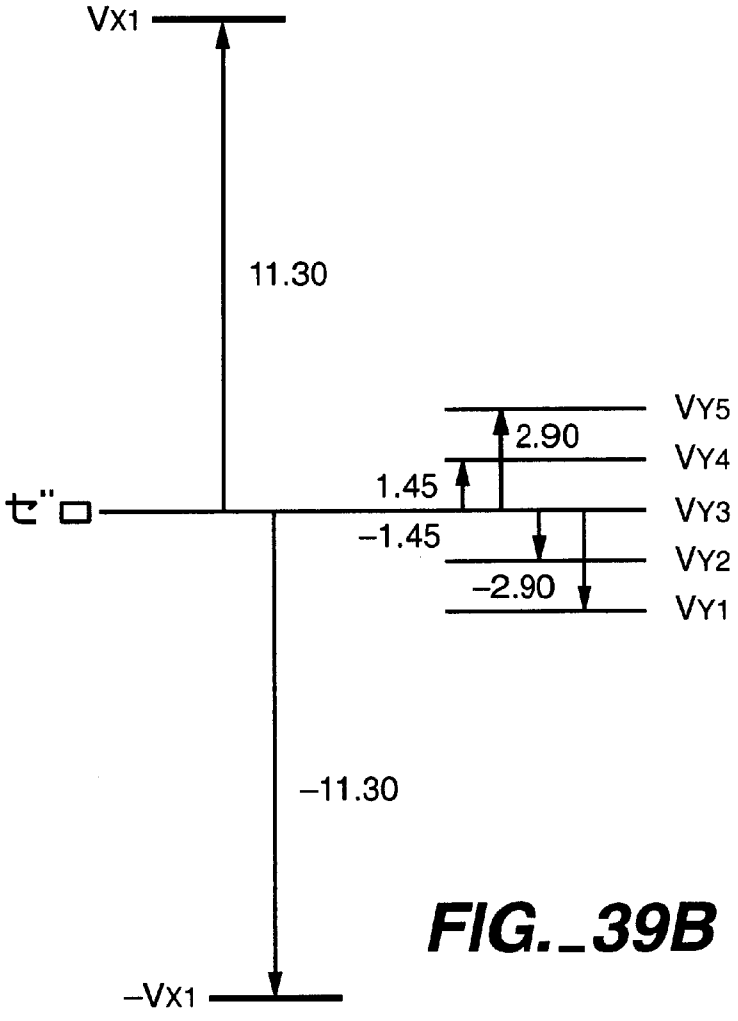
Figure 39A:
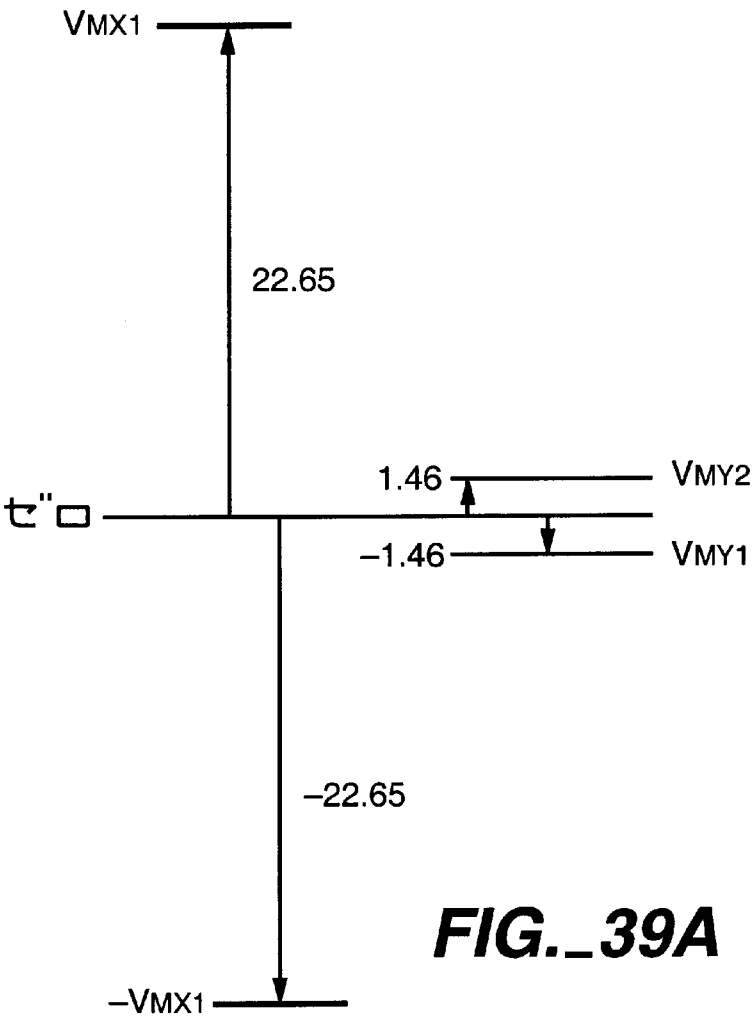

FIG. 39A shows the data line drive potential in multiplexed drive. FIG. 39B shows the data line drive potential in multi-line drive.

Figure 40:
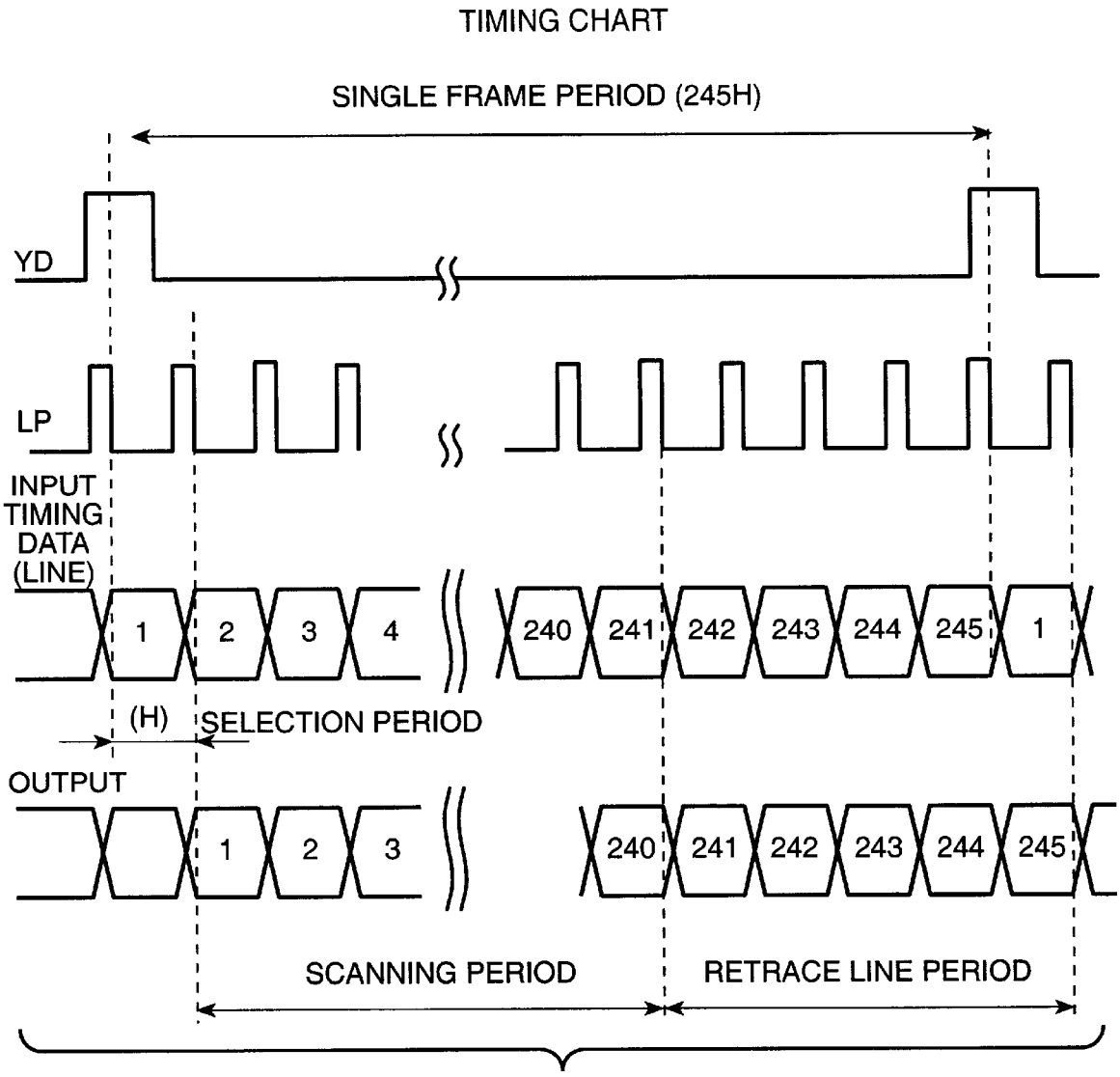

FIG. 40 is a timing chart showing the timing of data transfer to the data line drive circuit.

Figure 41:
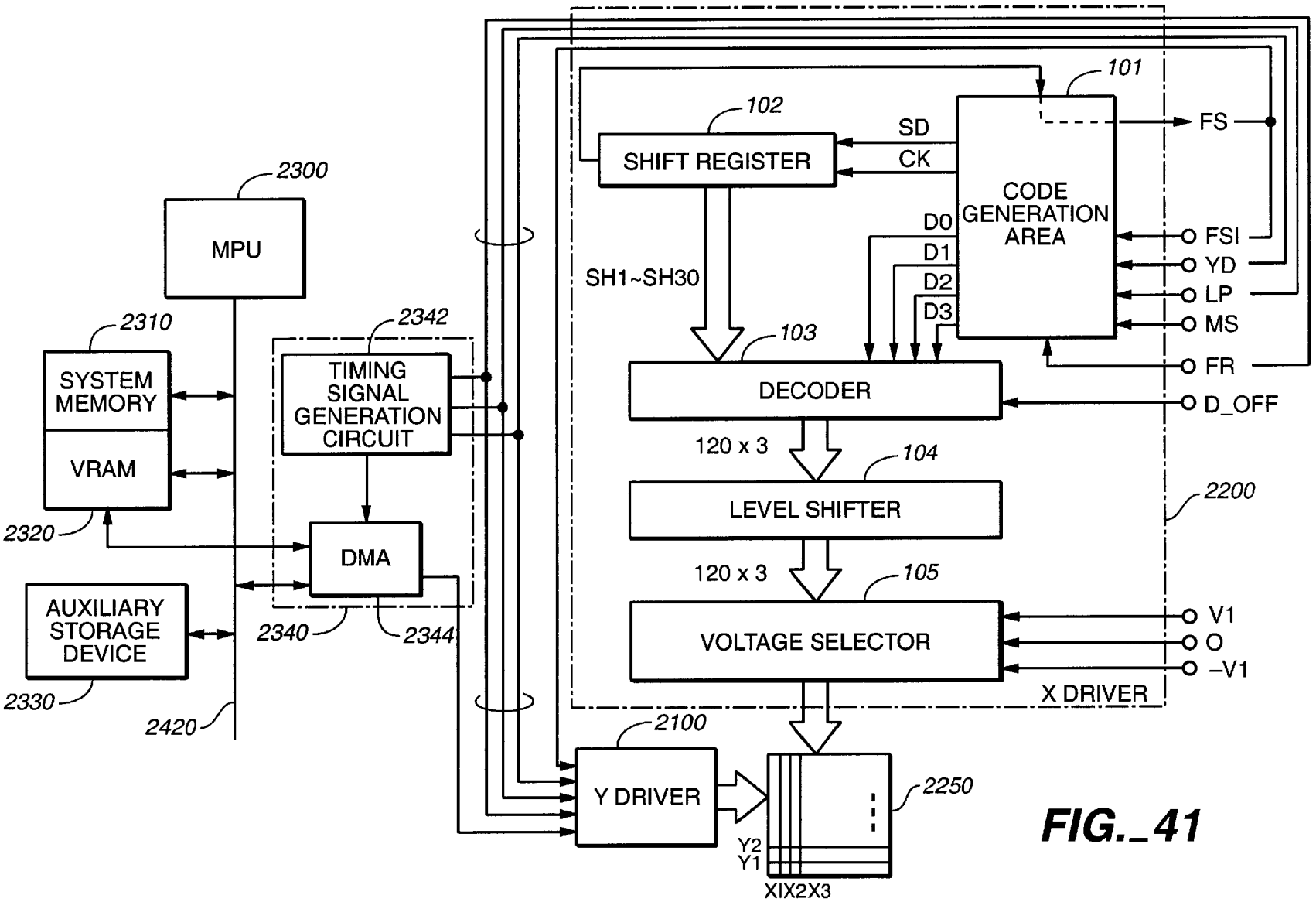

FIG. 41 shows the overall configuration of Embodiment 5 of the invention.

Figure 42:
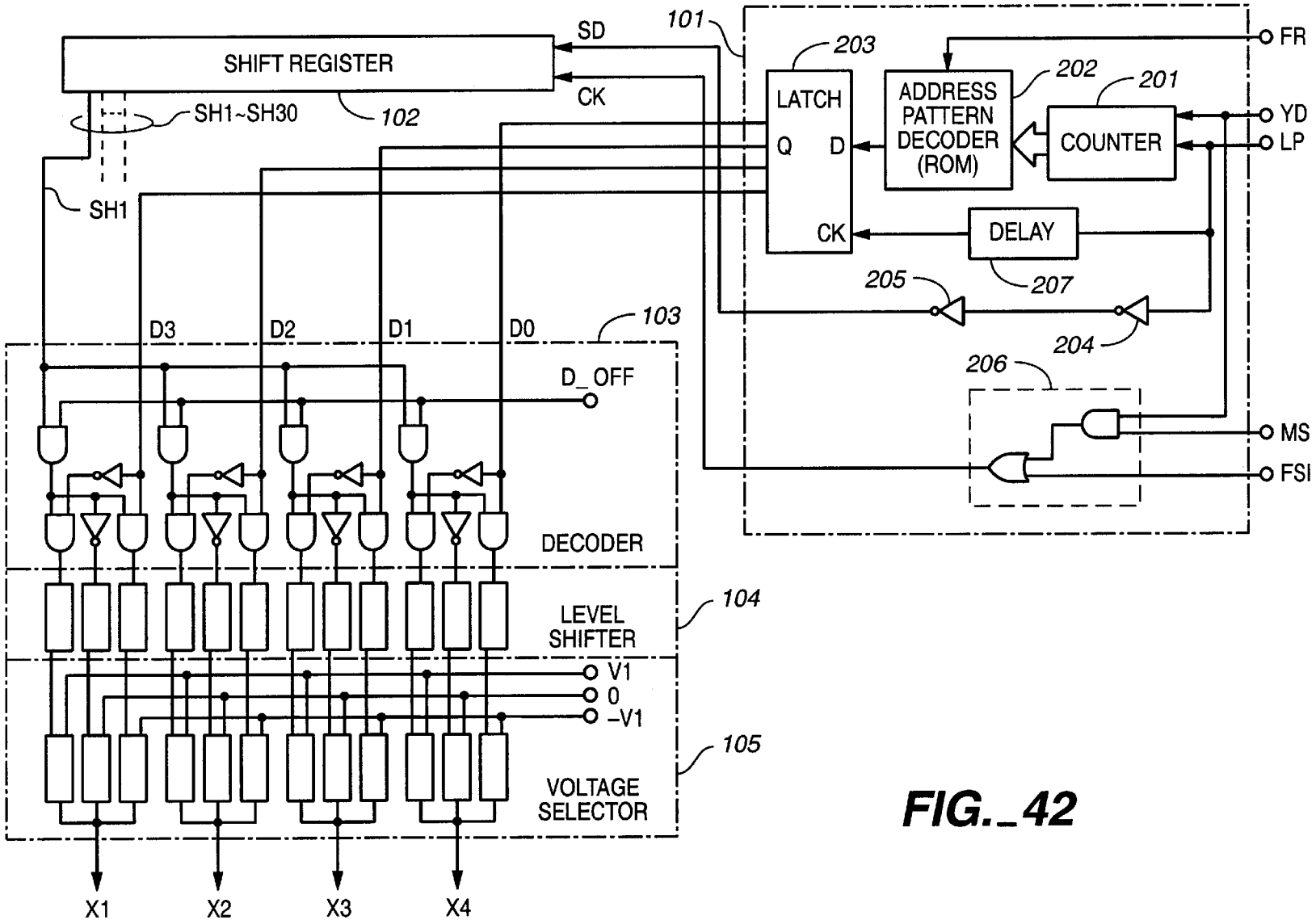

FIG. 42 shows a configuration example of the major area of Embodiment 5 of the invention.

Figure 43:
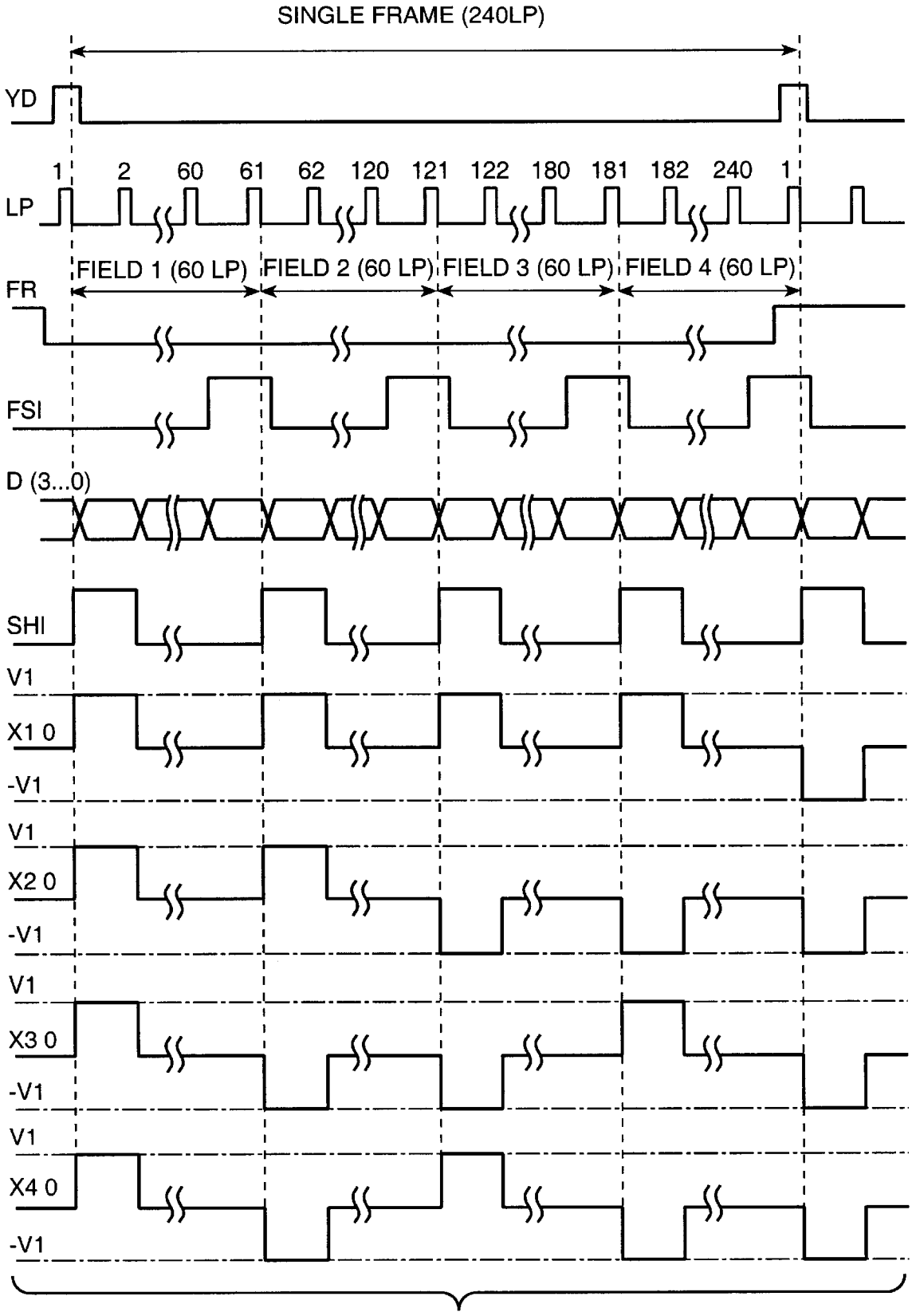

FIG. 43 is a timing chart explaining the operation of the circuits in FIGS. 41 and 42.

Figure 44:
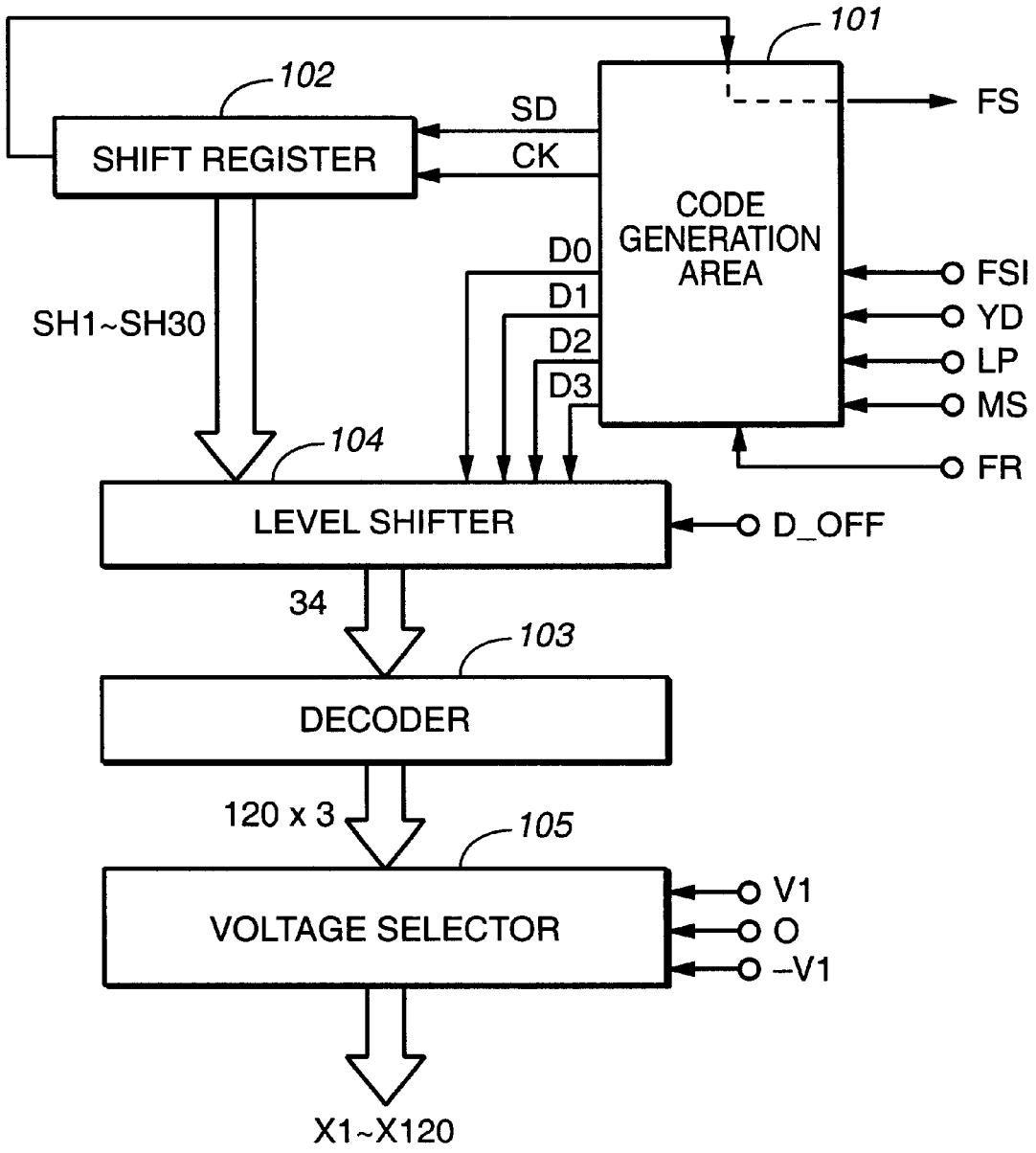

FIG. 44 extracts and shows part of the circuit shown in FIG. 41.

Figure 45:
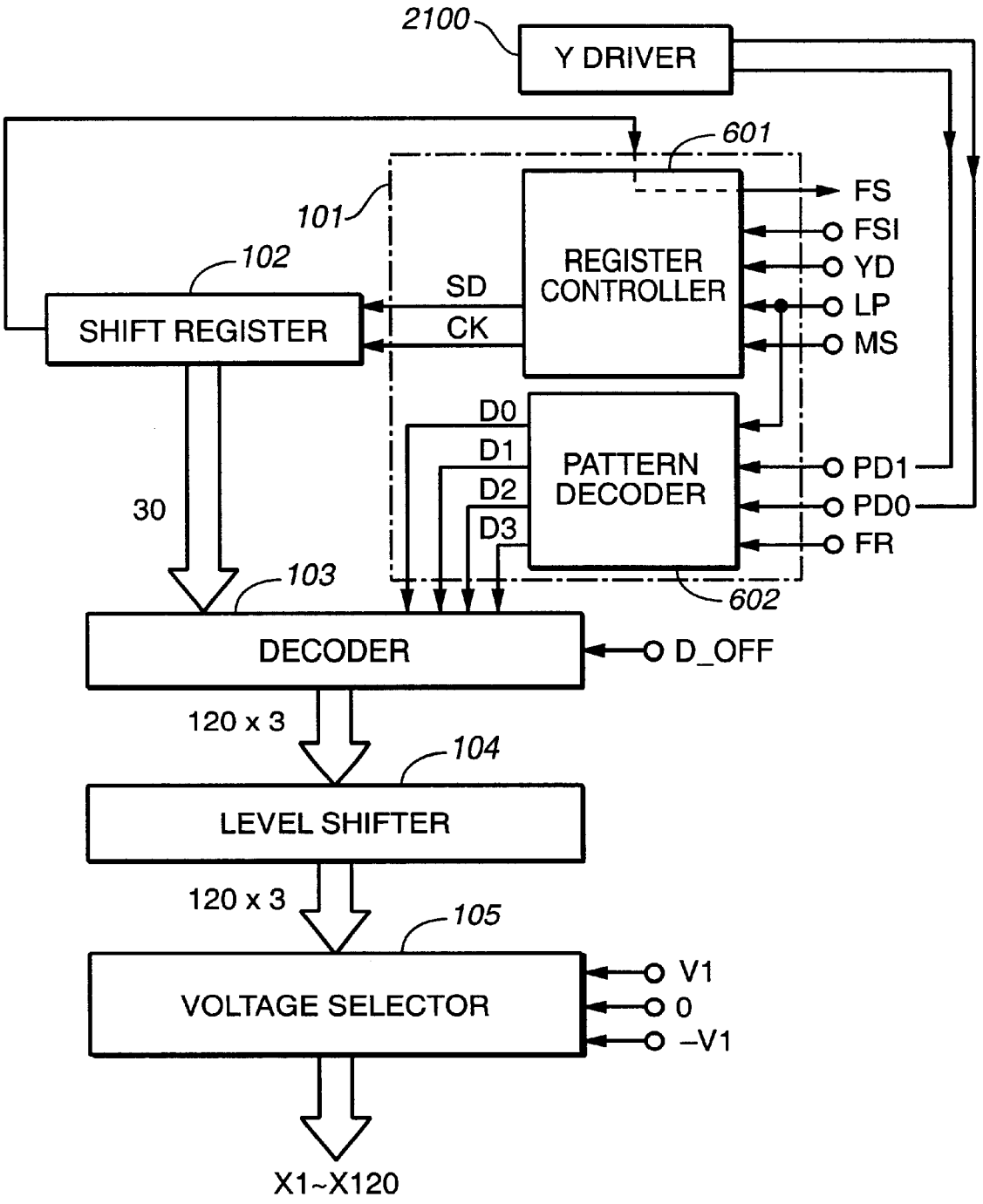

FIG. 45 shows a modified configuration example (configuration example of the scanning line drive circuit) related to Embodiment 5.

Figure 46:
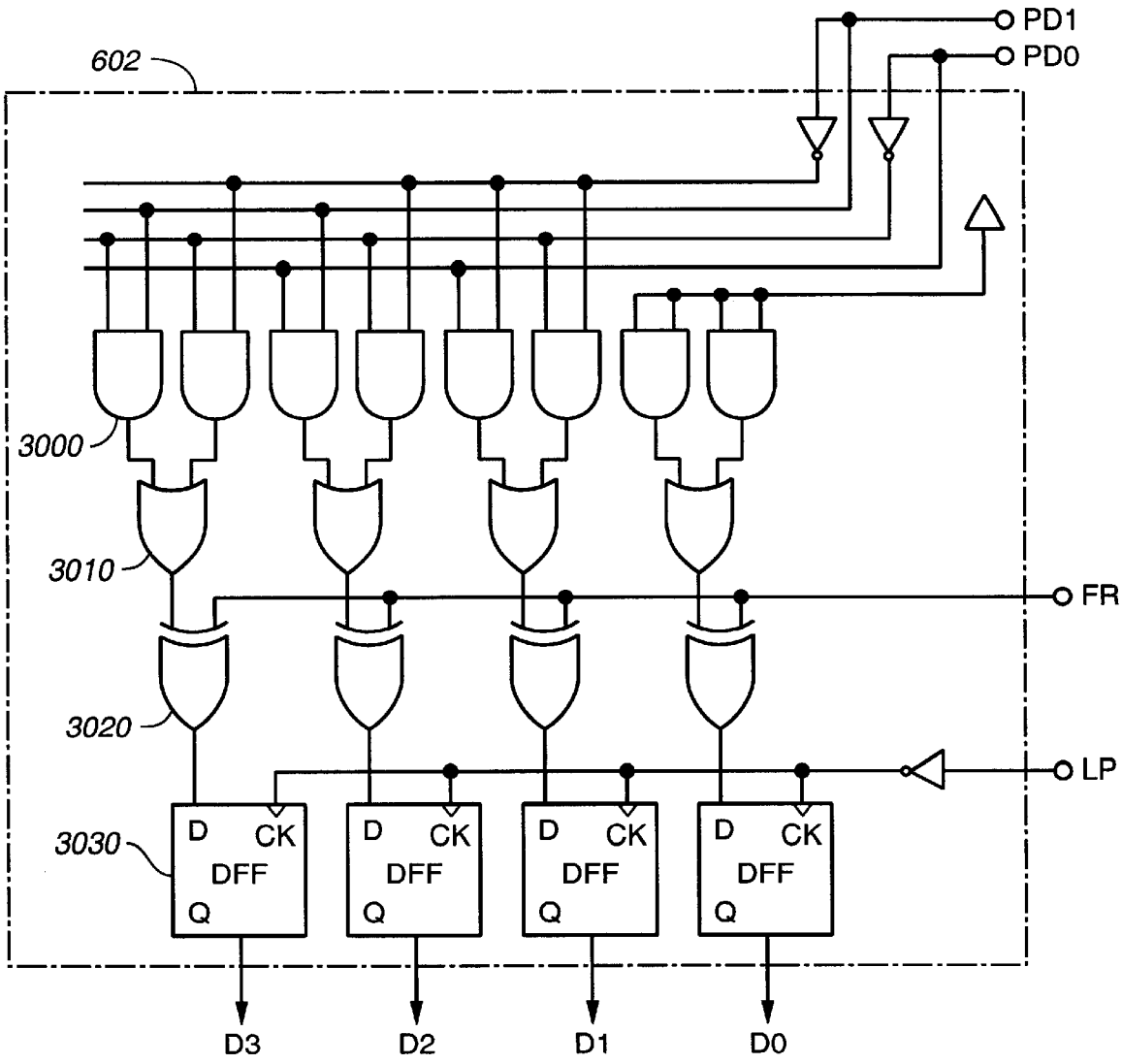

FIG. 46 shows a configuration example of pattern decoder 602 shown in FIG. 45.

Figures 47, 48A, 48B:
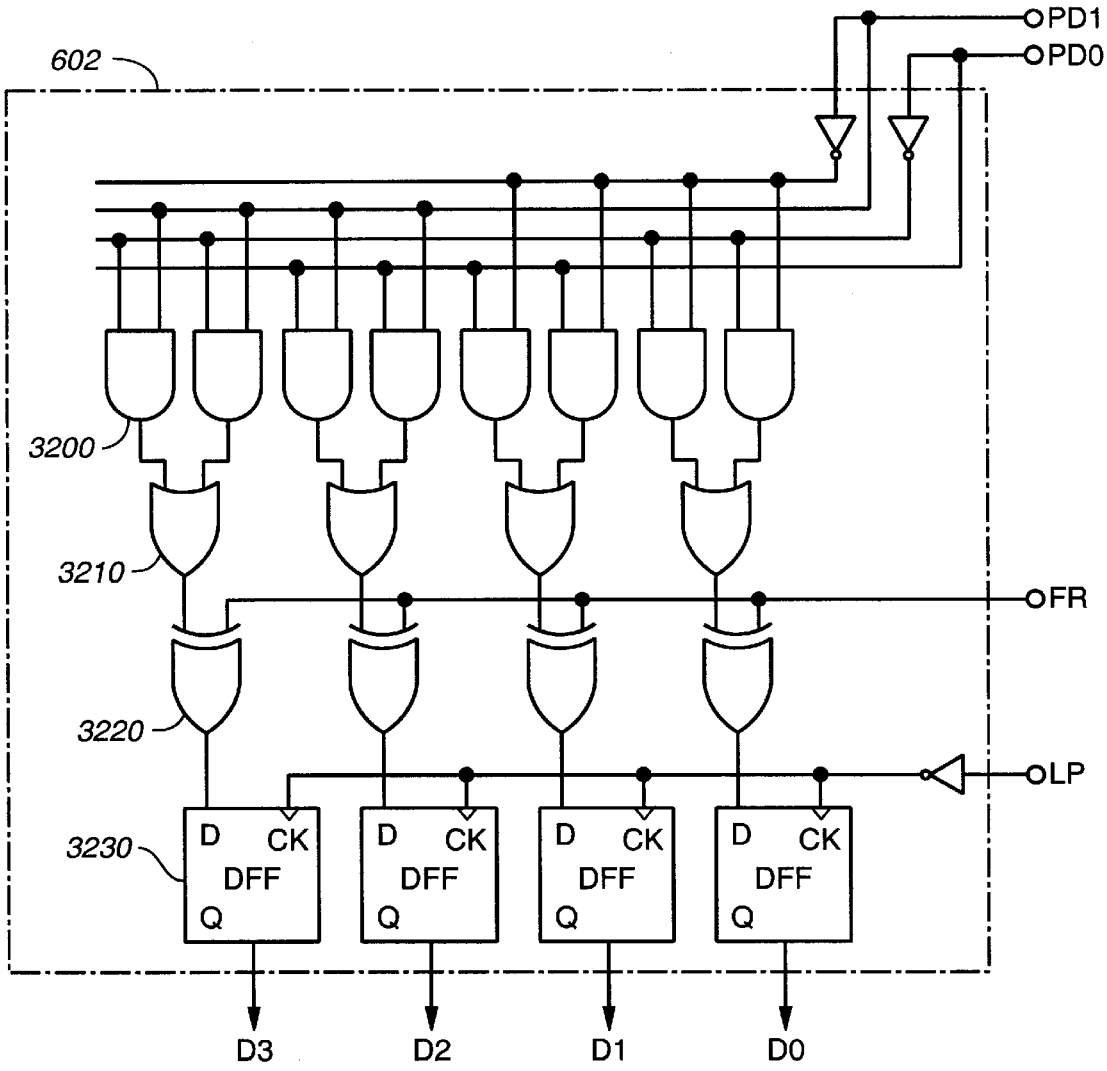

FIG. 47 shows another configuration example of pattern decoder 602 shown in FIG. 45.

FIG. 48A shows a scanning pattern example, and FIG. 48B shows another scanning pattern example.

Figure 49:
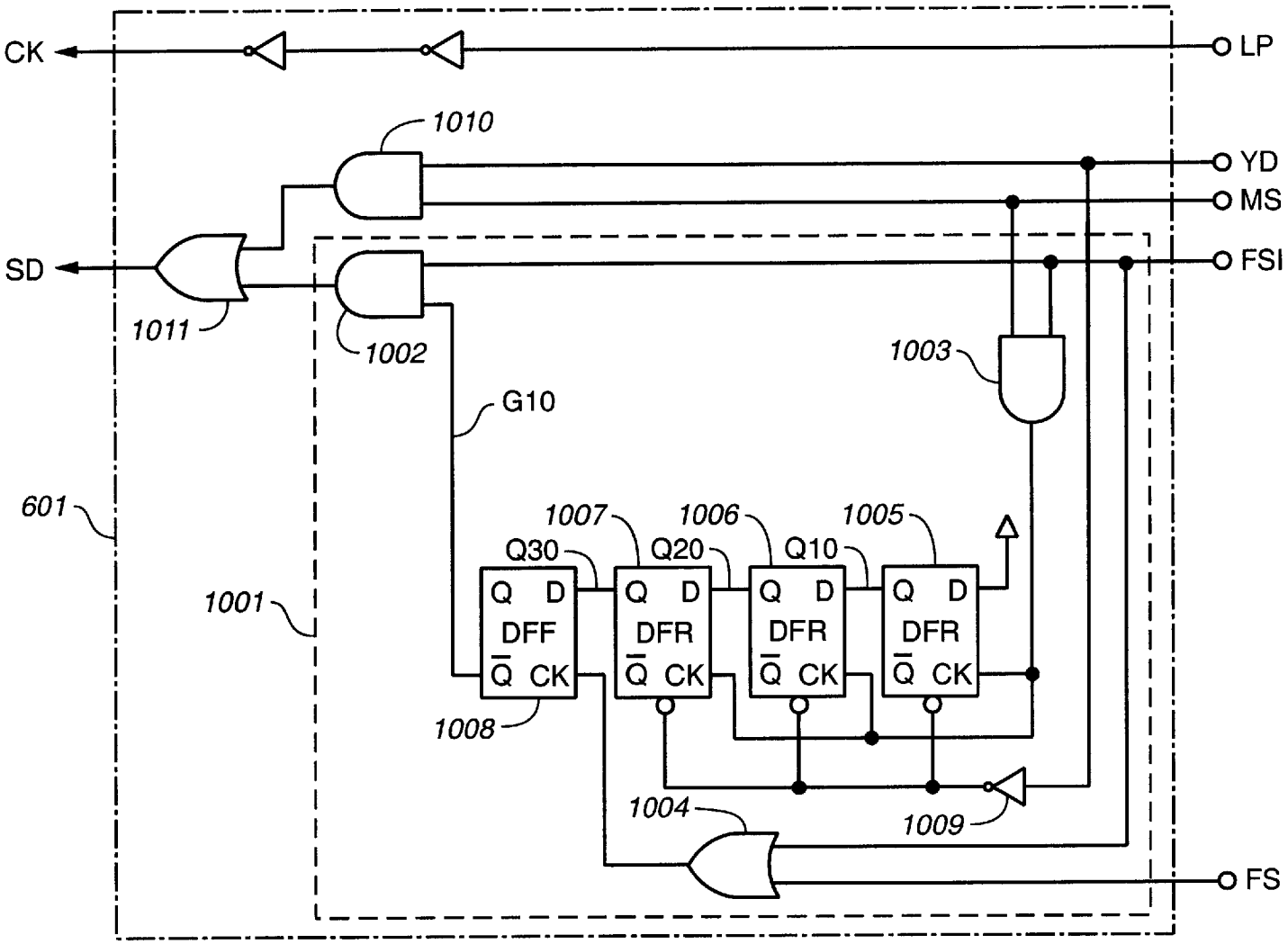

FIG. 49 shows a configuration example of register controller 601 shown in FIG. 45.

Figure 50:
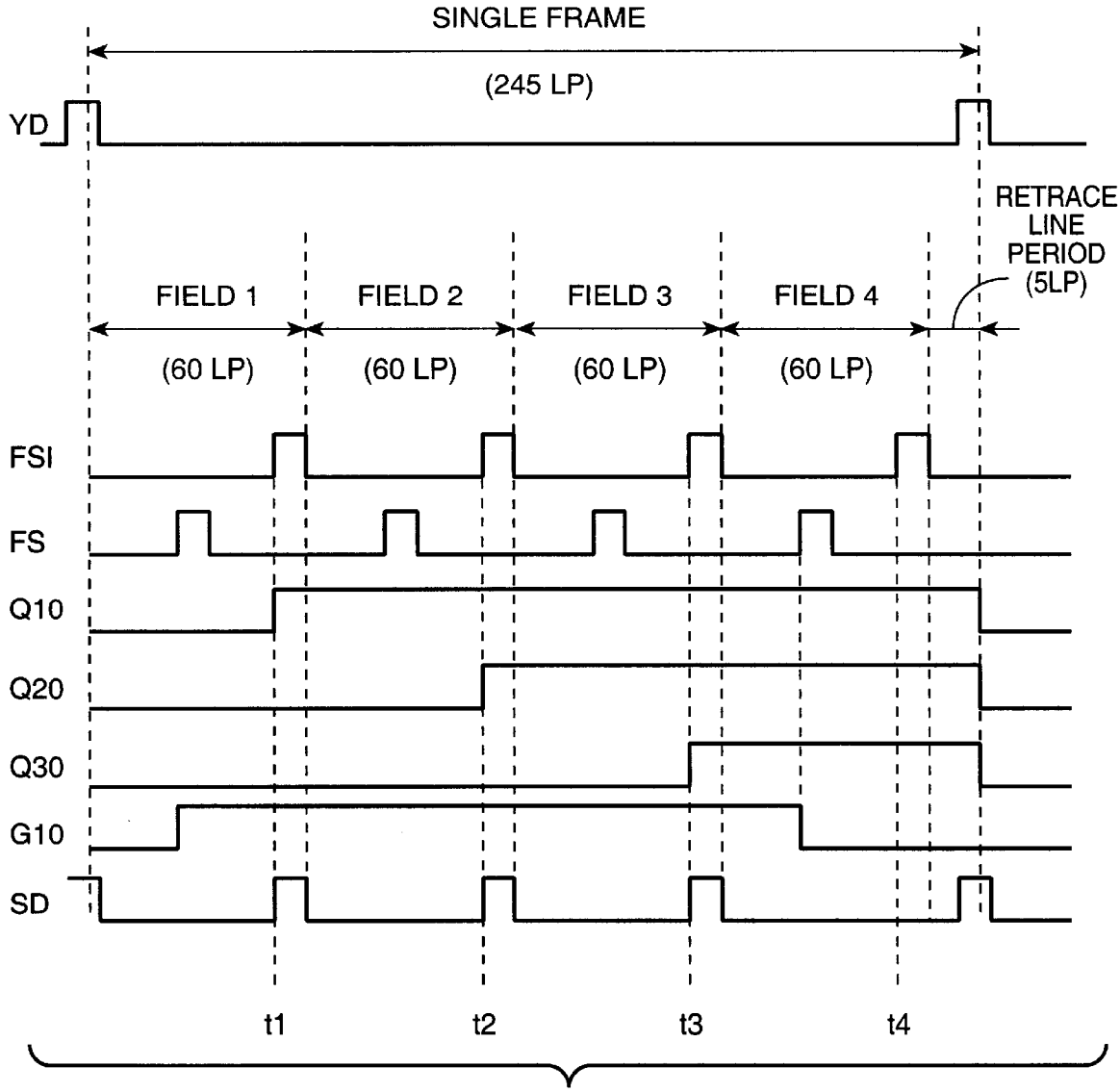

FIG. 50 is a timing chart showing the operation of the circuit shown in FIG. 49.

Figure 51:
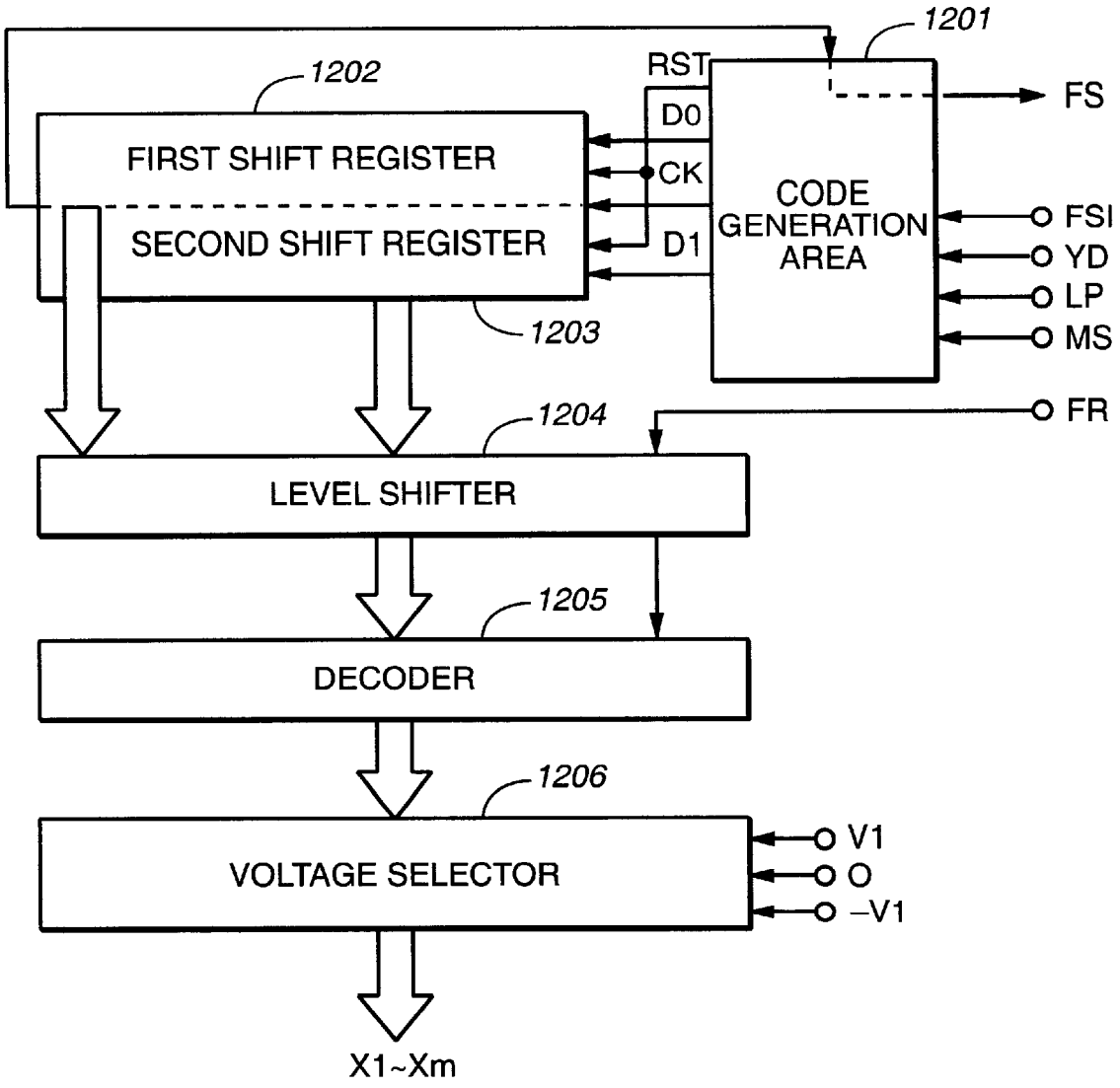

FIG. 51 shows a configuration example of the scanning line drive circuit evaluated by the inventors before conceiving the present invention.

Figure 52:
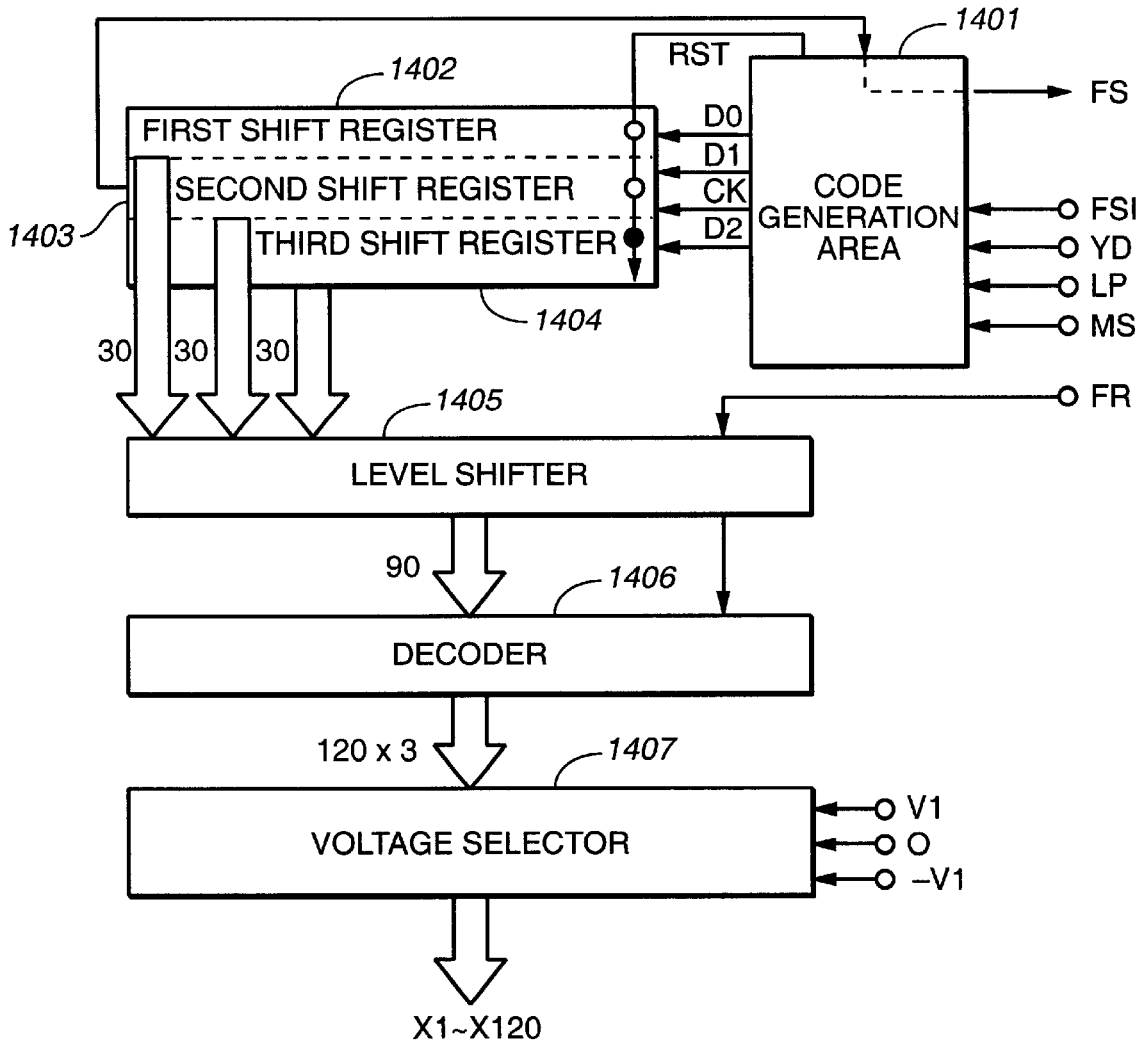

FIG. 52 shows another configuration example of the scanning line drive circuit evaluated by the inventors before conceiving the present invention.

Figure 53:
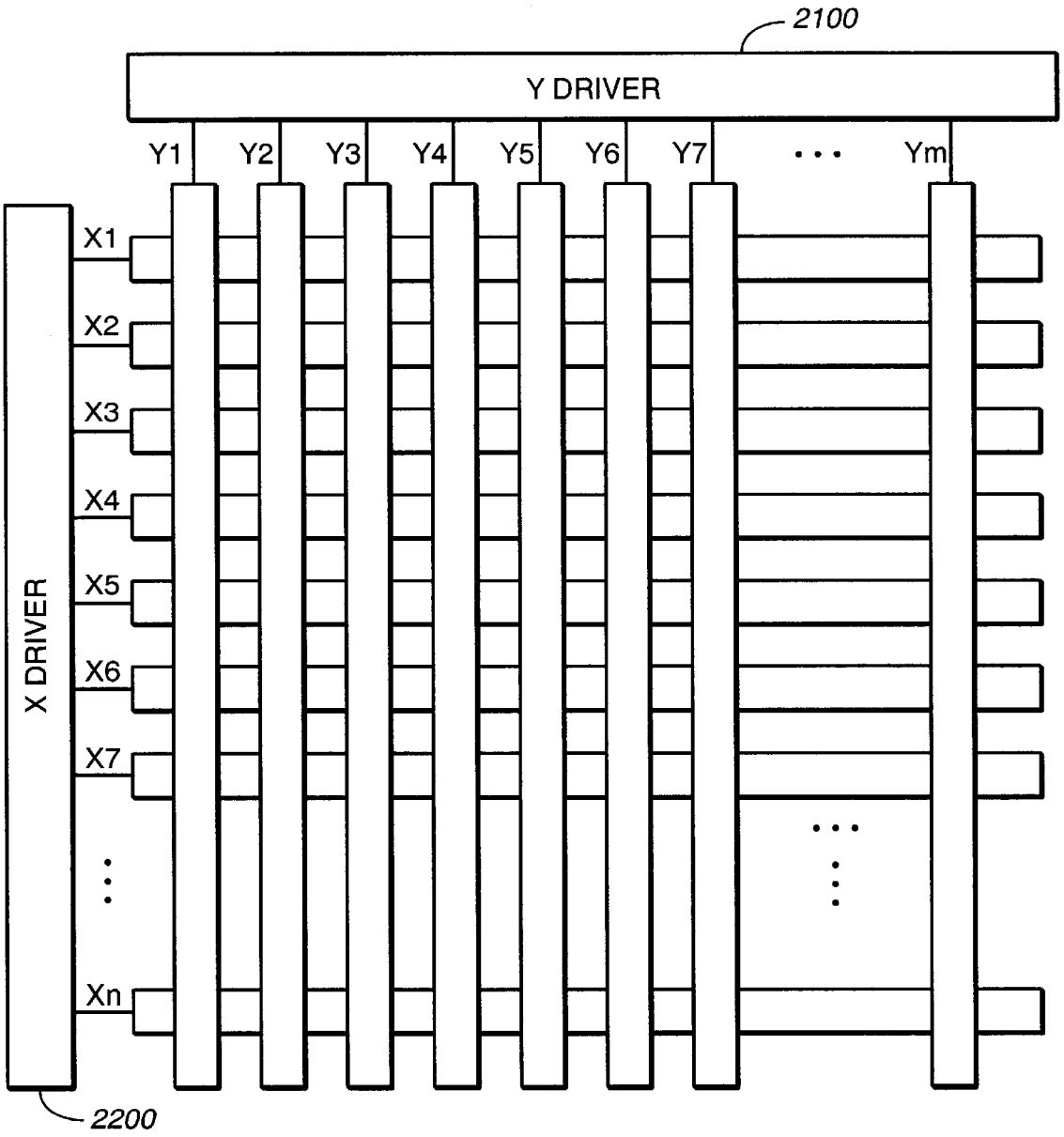

FIG. 53 shows the locations of the electrodes in a liquid crystal display panel.

Figure 54:
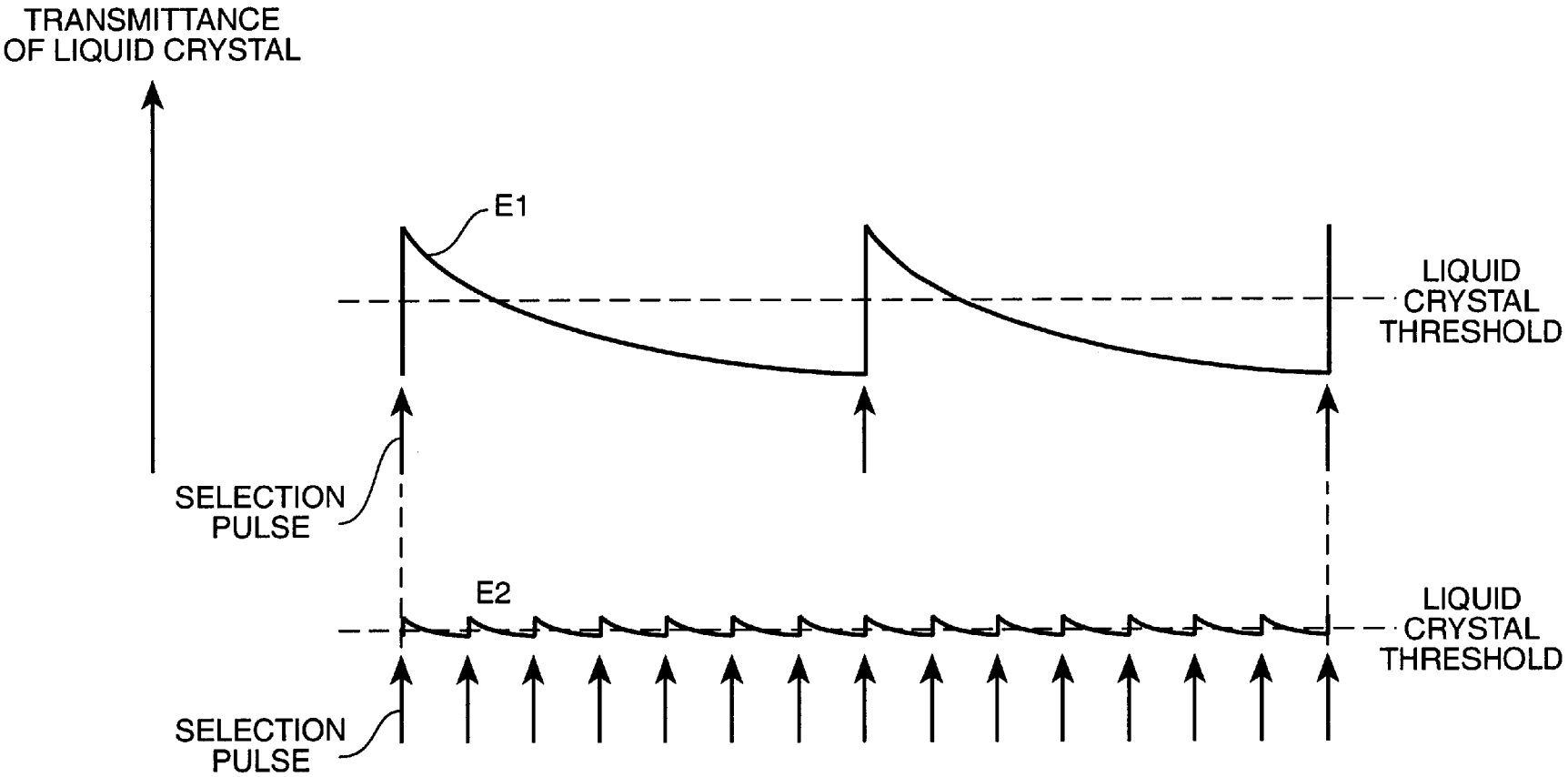

FIG. 54 explains the benefits obtained by using the multi-line drive method.

Figure 55:
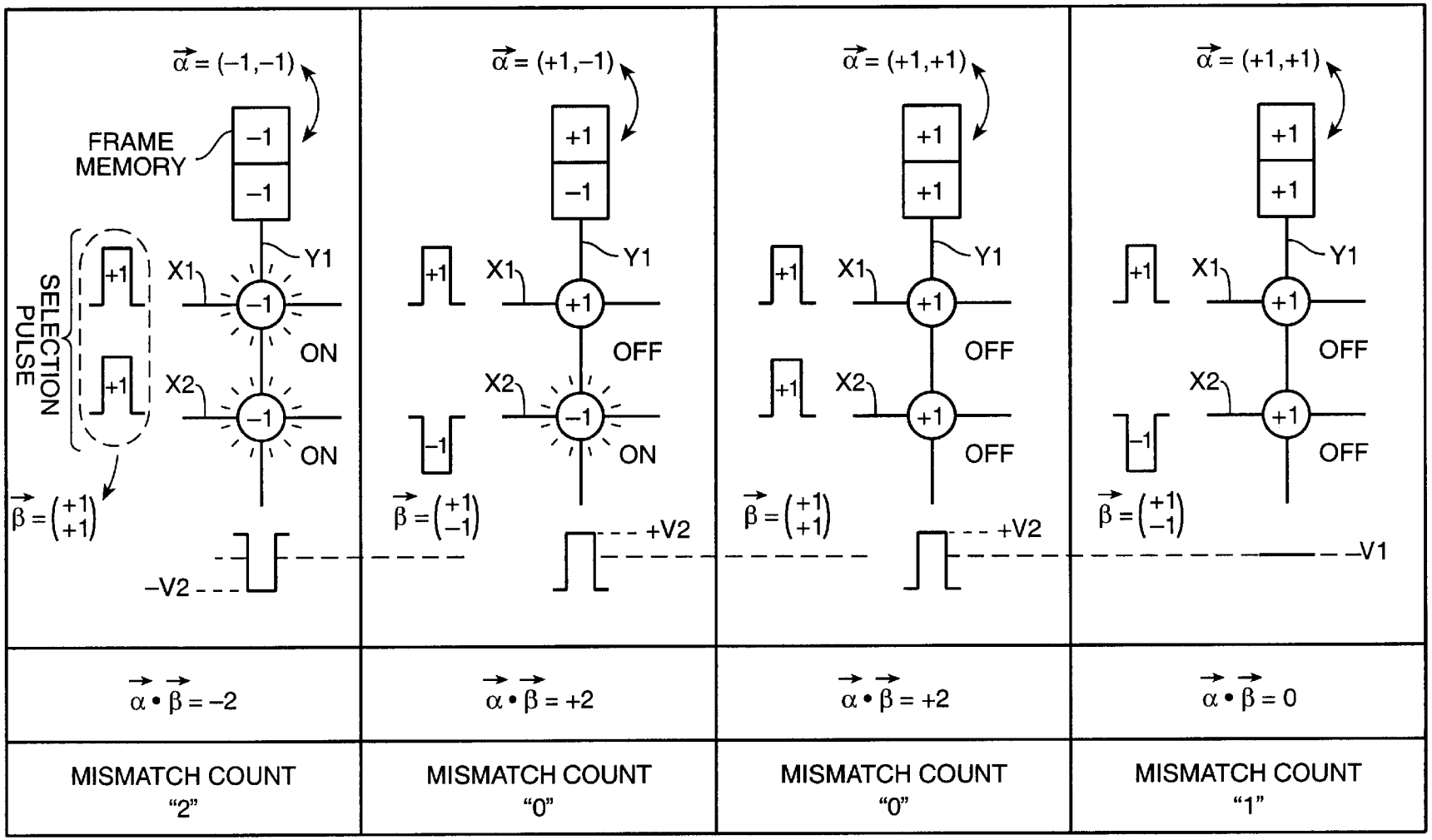

FIG. 55 explains the content of the multi-line drive method.

Figure 56A:
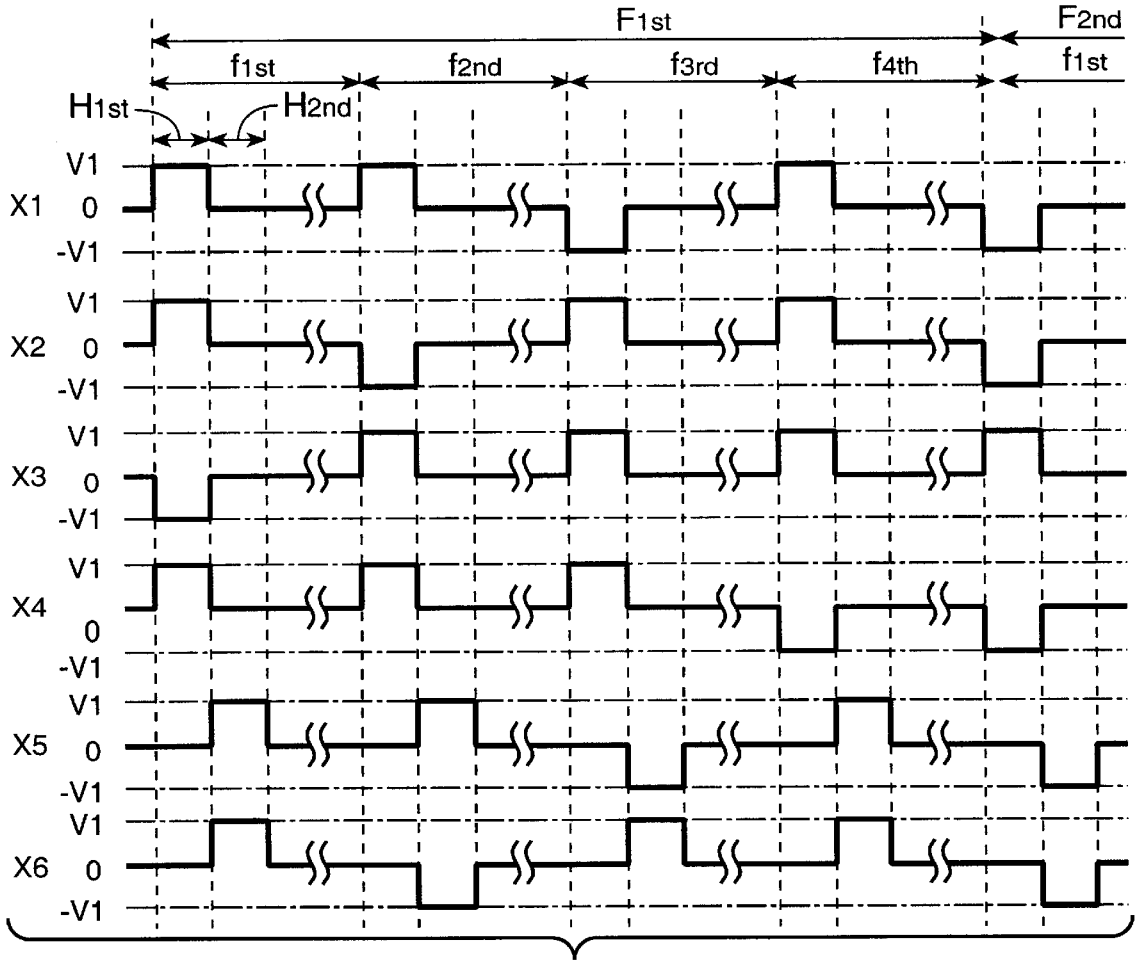
Figure 56B:
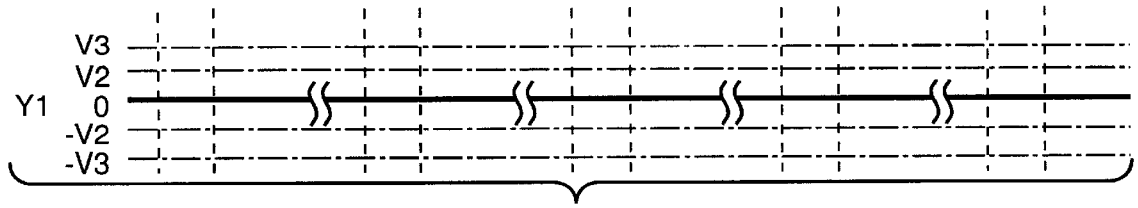
Figure 56C:
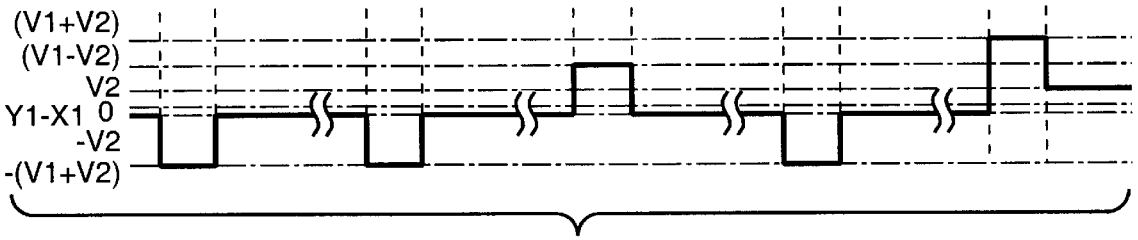

FIGS. 56A–56C are timing charts for explaining the operation of the drive circuit when the multi-line drive method is used.

Figure 57:
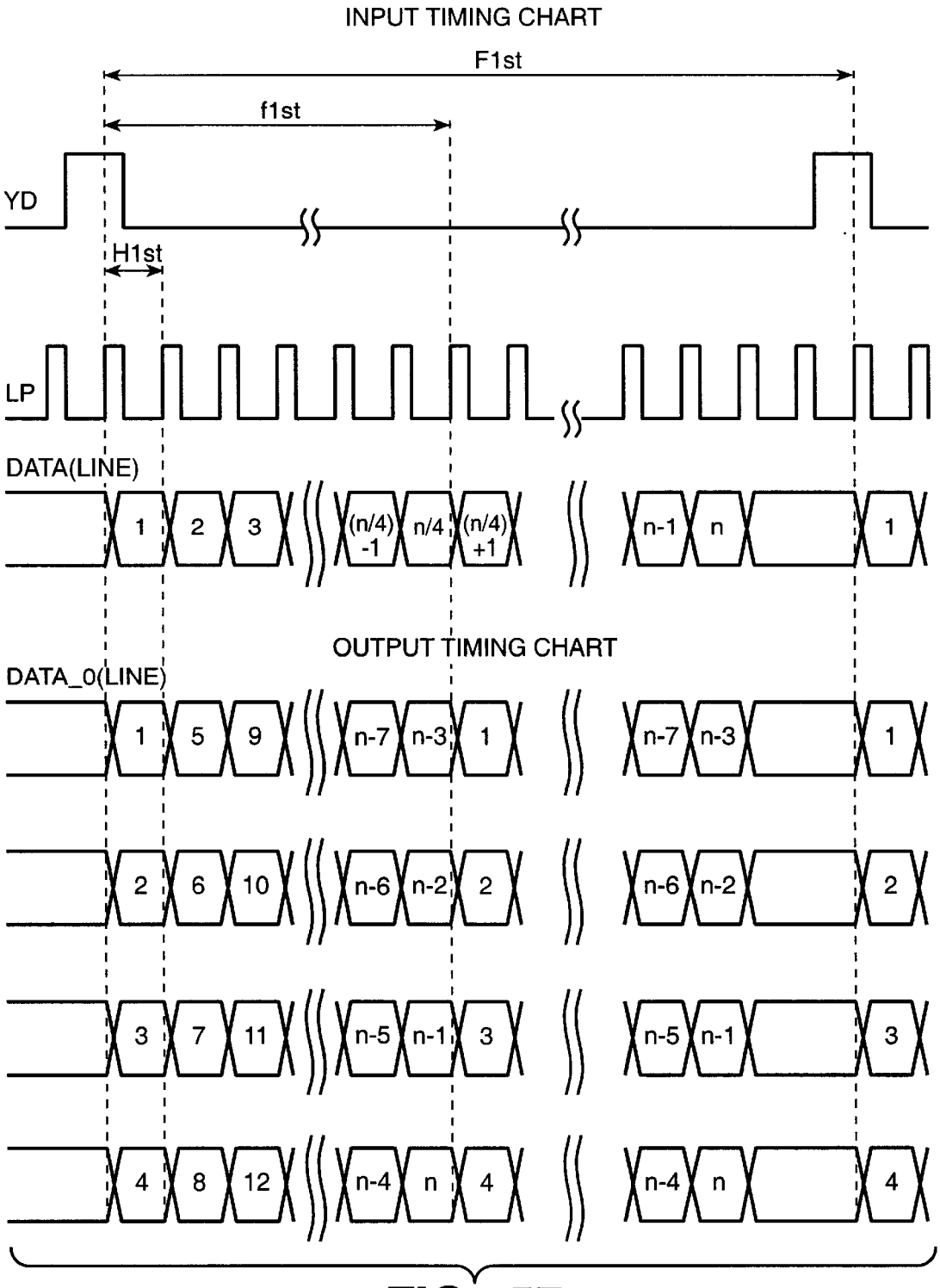

FIG. 57 is a timing chart showing the data input/output operation to/from the frame memory included in the data line drive circuit when the multi-line drive method is used.

Figure 58:
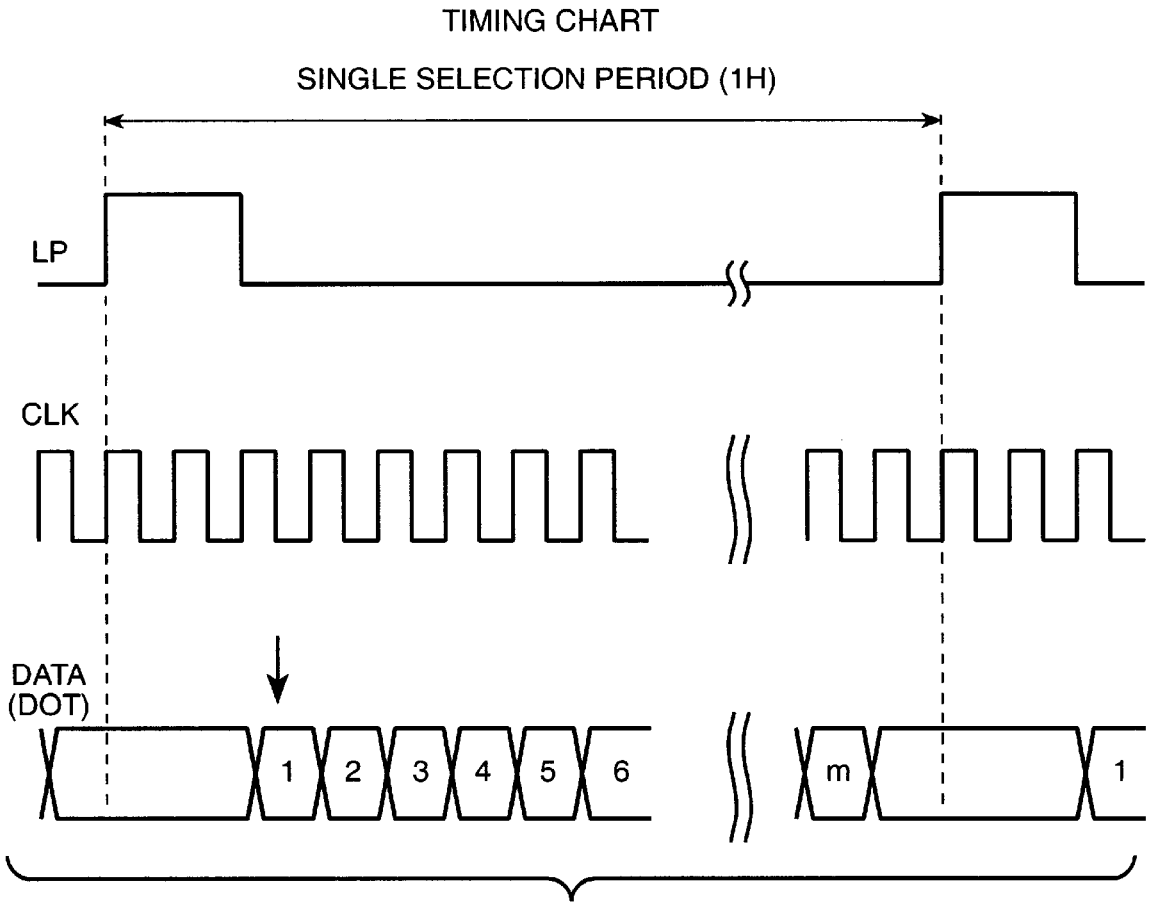

FIG. 58 is a timing chart showing the data input into the frame memory included in the data line drive circuit when the multi-line drive method is used.

Figure 59:
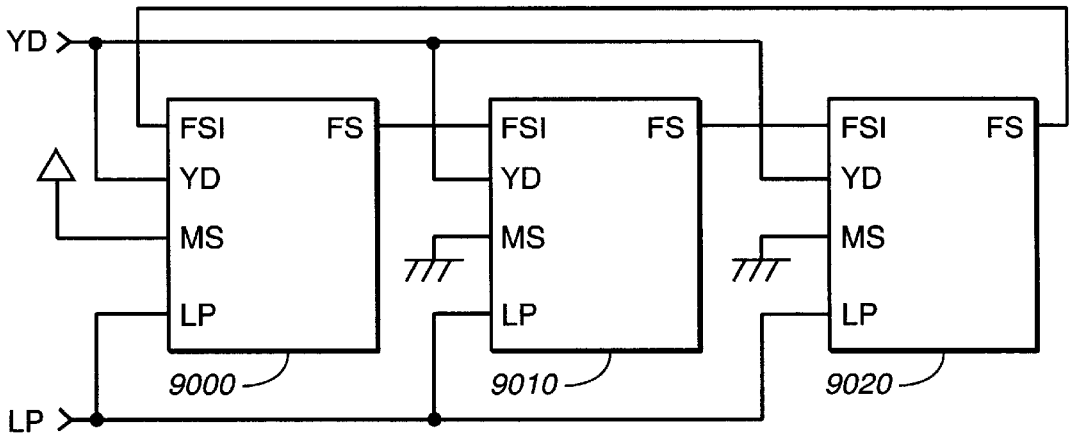

FIG. 59 is a block diagram showing an example in which the scanning line drive circuit is configured by cascading multiple integrated circuit (IC) chips.

FIG. 60A shows an example of the scanning voltage pattern (selection voltage pattern) when four lines are simultaneously driven in Embodiment 6 of the invention; FIG. 60B explains the column pattern positioning; and FIG. 60C shows an example of the scanning voltage pattern (selection voltage pattern) when three lines are simultaneously driven.

FIG. 61A–61C show the configuration of the decoder (ROM) of the data line drive circuit (Y driver) related to Embodiment 6 of the invention.

Figure 62A:
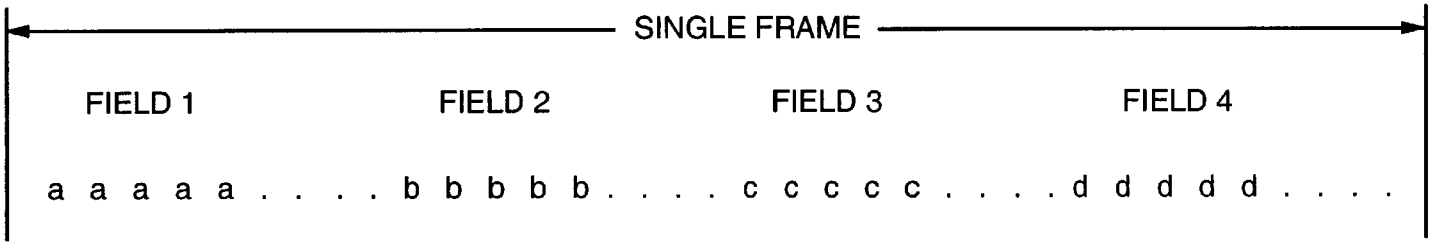
Figure 62B:
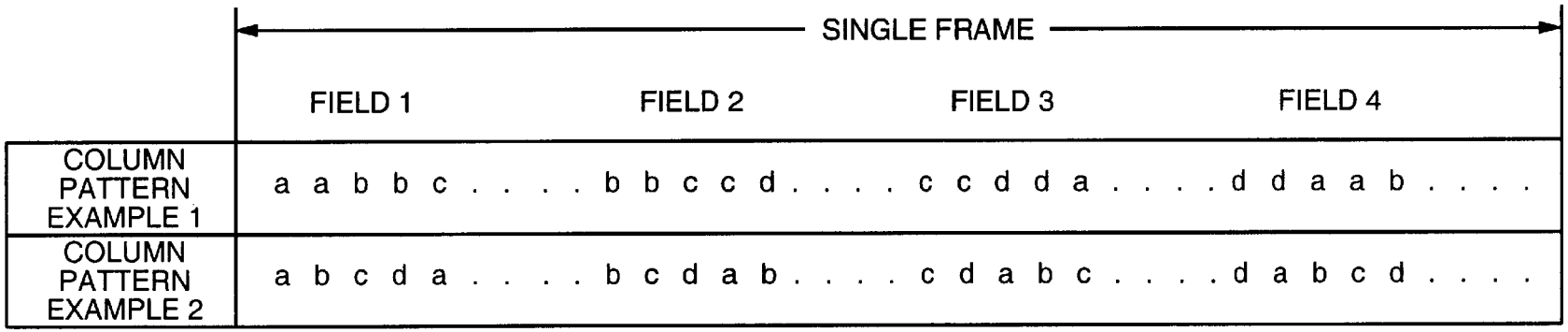

FIG. 62A shows an example of a conventional scanning voltage pattern; and FIG. 62B shows the change in the scanning voltage pattern related to Embodiment 6 of the invention.

Figure 63:
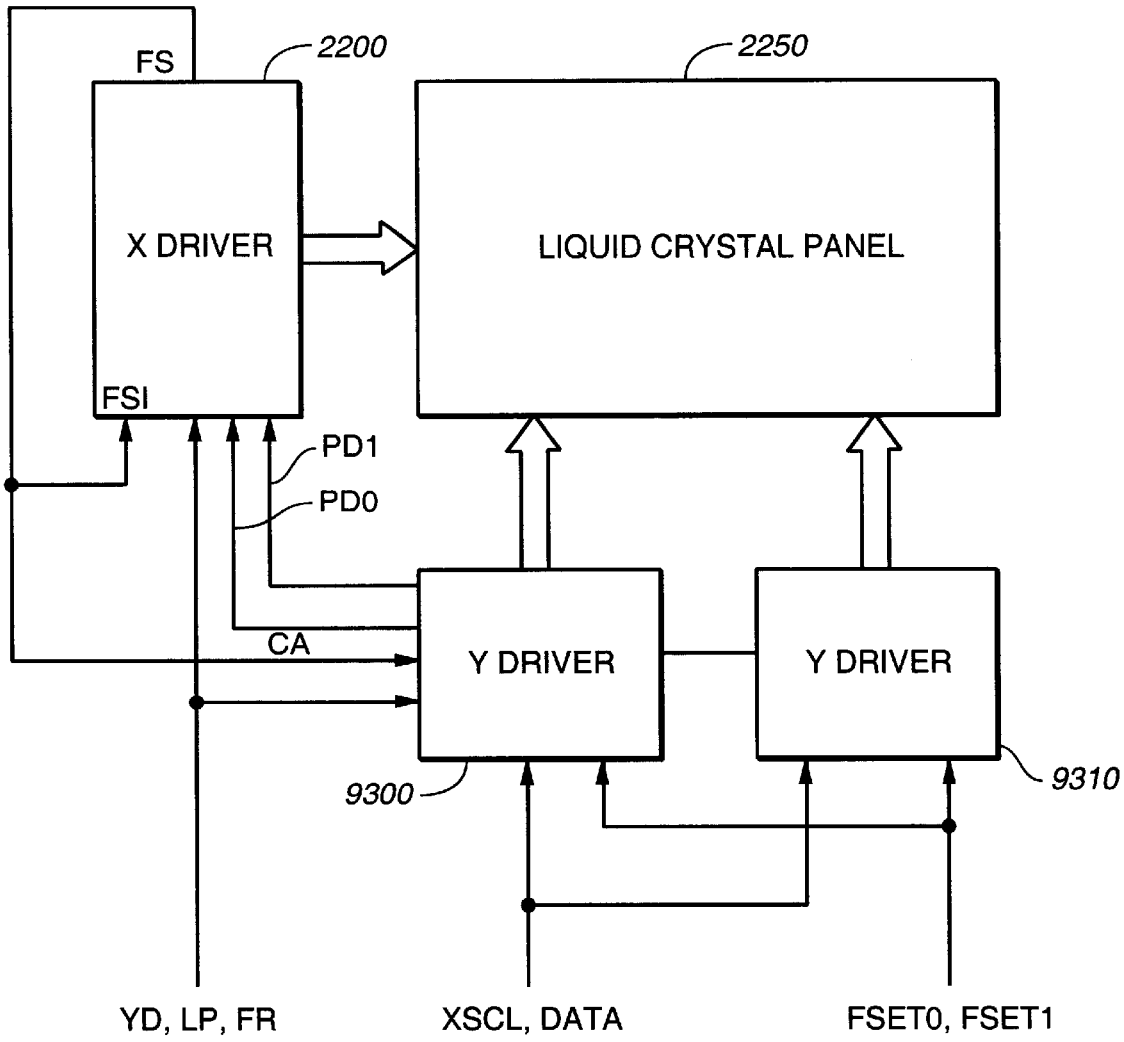

FIG. 63 shows an overall configuration example of the liquid crystal display device related to Embodiment 6 of the invention.

Figure 64:
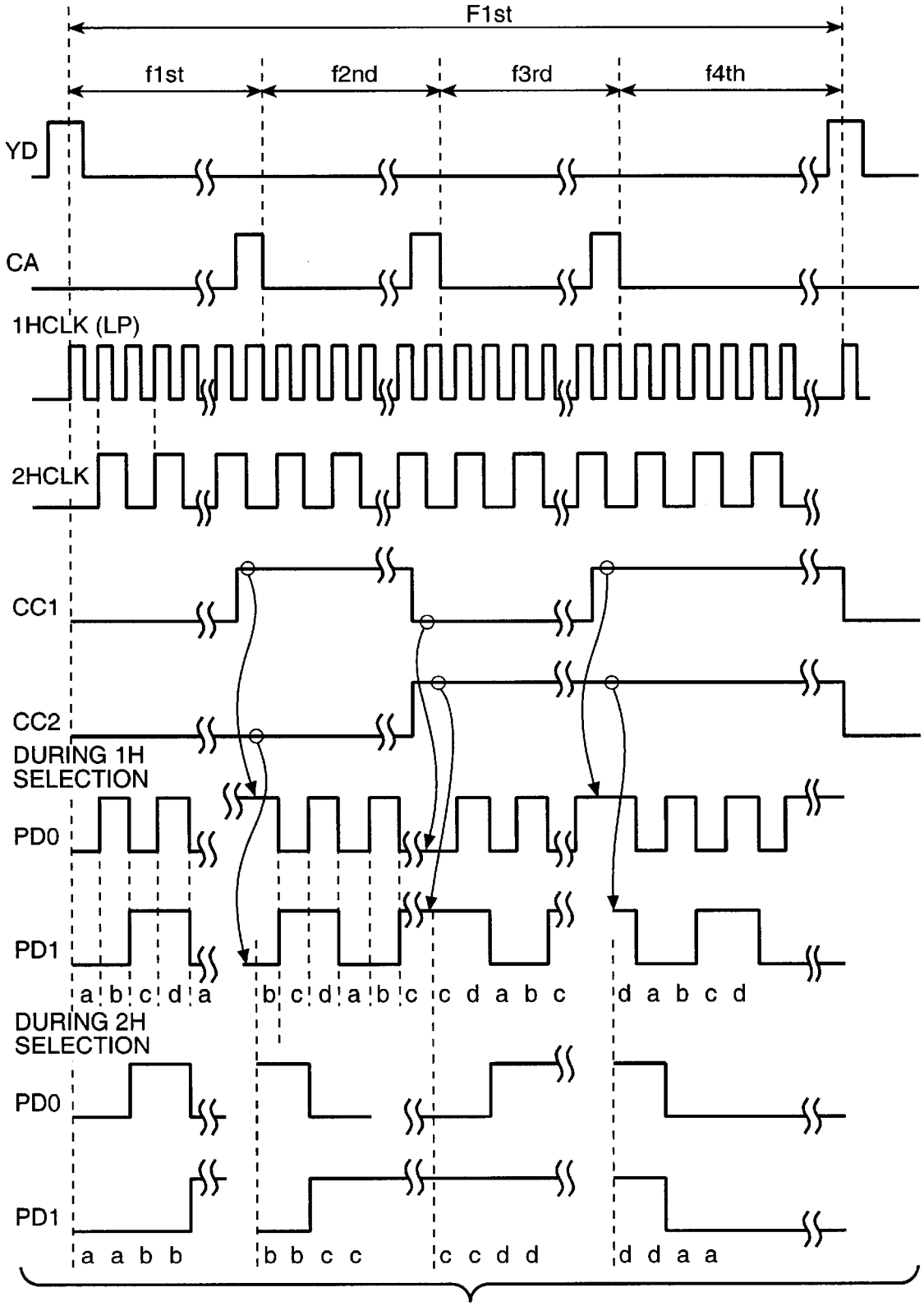
Figure 65:
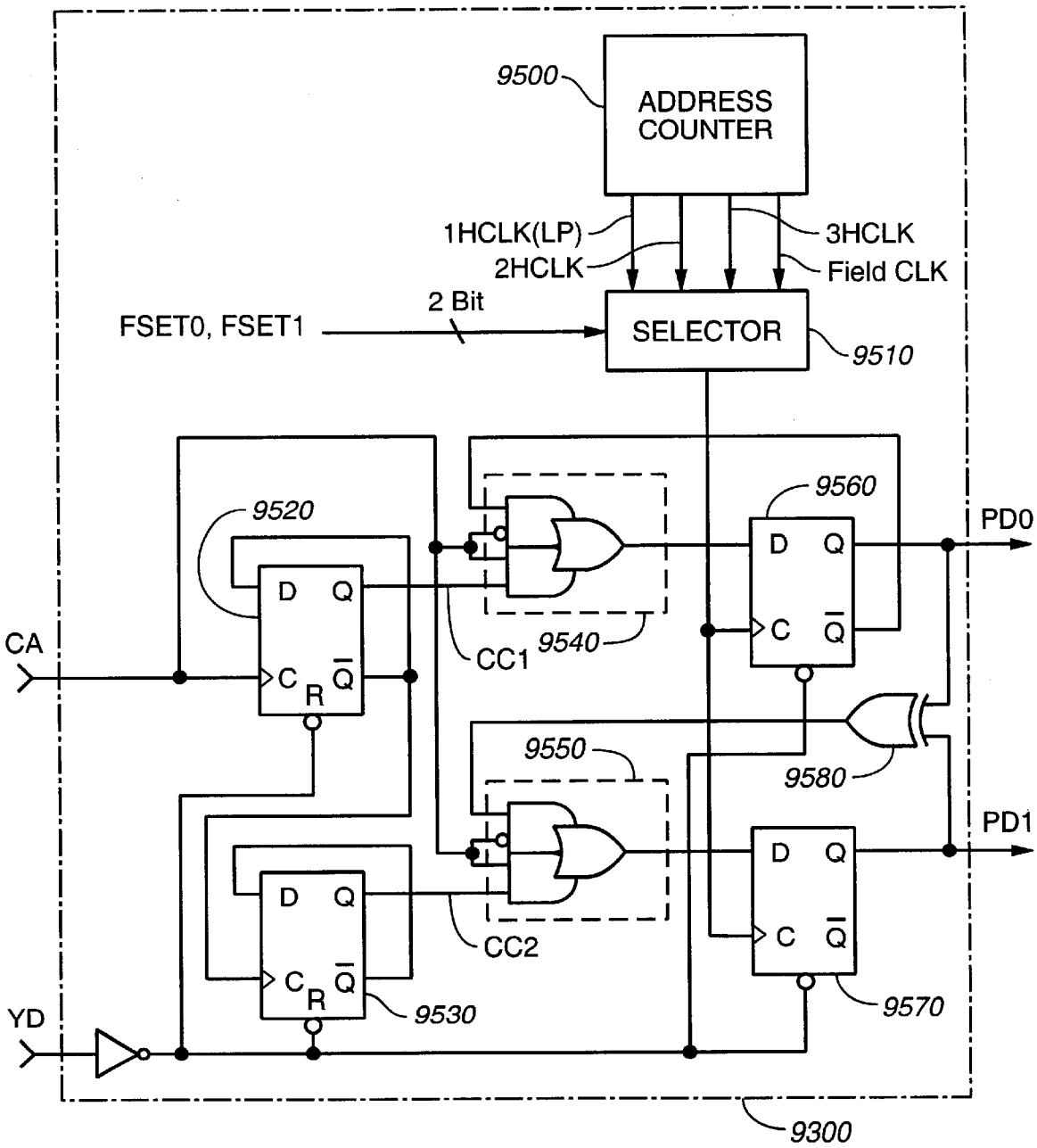

FIG. 64 is a timing chart explaining the operation of the circuit shown in FIG. 65.

FIG. 65 shows the configuration of the pattern data generation circuit inside the data line drive circuit related to Embodiment 6 of the invention.

PREFERRED EMBODIMENTS OF THE INVENTION

The present invention relates to the design of circuits by focusing on the characteristics of the multi-line drive method (hereafter referred to as "MLS drive method"). Since familiarity with the MLS drive method is important for understanding the present invention, an overview of the MLS drive method is provided below.

A. Advantages of the MLS Drive Method

The MLS drive method is a technique for simultaneously selecting multiple scanning lines in a simple-matrix liquid crystal panel, such as an STN (Super Twisted Nematic) liquid crystal panel.

This technique can lower the drive voltage for the scanning lines.

As shown in the upper portion of FIG. 54, the interval between selected pulses is wide in the conventional sequential line drive method and the transmittance of the liquid crystal deteriorates as time passes, resulting in poor contrast of the displayed image and lower intensity when the liquid crystal is turned on. In contrast, the MLS drive method shown on the lower portion of FIG. 54 can narrow the interval between selected pulses, and thus can improve both contrast and intensity.

B. Principle of the MLS Drive Method

As shown in FIG. 55, it is assumed that two scanning lines X1 and X2 are simultaneously driven and the pixels located at the intersections between these scanning lines and data line Y1 are turned ON/OFF.

The ON and OFF pixels will be denoted as "−1" and "+1", respectively. The data that indicates ON/OFF is stored in the frame memory. The selection pulse is expressed as either "+1" or "−1.". The drive voltage of data line Y1 is expressed as "−V2," "+V2," or "V1."

Which of the three voltage values ("−V2," "+V2," or "V1") should be applied to data line Y1 is determined by the product of display data vector and selection matrix β.

×β=−2 in FIG. 55(*a*); ×β=+2 in FIG. 55(*b*); ×β=+2 in FIG. 55(*c*); and ×β=0 in FIG. 55(*d*).

When the product of display data vector and selection matrix β is "−2," data line drive voltage of "−V2" is selected; when the product is "+2," "+V2" is selected; and when the product is "0," "V1" is selected.

To use an electronic circuit to obtain the product of display data vector and selection matrix β, the circuit can be installed for determining the number of mismatches between the corresponding data of display data vector and selection matrix β.

In other words, if the number of mismatches is "2," data line drive voltage of "−V2" is selected. If the number of mismatches is "0," data line drive voltage of "+V2" is selected. If the number of mismatches is "1," data line drive voltage of "V1" is selected. In an MLS drive method that simultaneously selects two lines, a pixel is turned ON/OFF by making two selections within a single frame period by determining the data line drive voltages explained above. Consequently, the drive voltage can be kept low, and moreover the contrast and intensity are improved by leaving an interval between the end of the first selection period and the start of the second selection period.

In order to implement such MLS drive, it is necessary to determine the mismatch between the display image data (i.e., the display pattern) and the selection pulse pattern or the scanning voltage pattern (sometimes referred to as "selection voltage pattern").

Since the display image data is stored in the frame memory, this memory must be accessed effectively. Furthermore, in order to increase the size of liquid crystal panels, the mismatch determination circuit must be simplified. It is also important to prevent display quality from deteriorating by focusing on the characteristics of the MLS drive. Additionally, it is important to simplify the configuration of the scanning line drive circuit while always maintaining the compatibility between the display image data and the selection pulse pattern.

C. Specific Examples of the MLS Drive Method

Specific examples are explained below in which four scanning lines are simultaneously selected for driving a simple-matrix liquid crystal display device, with reference to FIGS. 53, 56, 57, and 58.

In FIG. 53, scanning lines (X1–Xn) and data lines (Y1–Ym) are formed using transparent electrodes on two transparent glass substrates, and liquid crystals are sandwiched between the two substrates.

Data lines are connected to data line drive circuit (Y driver) 2100; and the scanning lines, to scanning line drive circuit (X driver) 2200. Note that, in the FIG., the data line drive circuit is described as "Y driver" and the scanning line drive circuit as "X driver" for the sake of simplicity.

A pixel is formed at each intersection of a scanning line and a data line, and the display element of the pixel is driven by the scanning signal and the data signal supplied to each scanning line and each data line, respectively.

The scanning line drive circuit is controlled by a controller (not shown in FIG. 53). One of three voltage levels (+V1, 0, and −V1) is selected as appropriate according to the scanning voltage pattern defined by a preselected system of orthogonal functions, and is applied to each of the four scanning lines. For example, four scanning lines X1–X4 shown in FIG. 56A are simultaneously selected.

The scanning pattern in effect is then compared to the display pattern determined based on the data to be displayed on the pixel on the selected line, and the voltage level determined based on the number of mismatches (one of five voltage levels; −V3, −V2, 0, +V2, and +V3) is applied from the data line drive circuit to each data line. The process of determining the voltage level to be applied to the data line is explained below.

Scanning voltage pattern is defined as (+) or (−) when the selection voltage is +V1 or −V1, respectively. The display pattern is defined as (+) for ON display data and (−) for OFF display data. No mismatch count is considered for non-selection periods.

In FIGS. 56A–56C, the period necessary for displaying a single screen is defined as one frame period (F), the period necessary for selecting all scanning lines once is defined as one field period (f), and the period necessary for selecting a scanning line once is defined as one selection period (H).

Note that, in FIGS. 56A–56C, $H_{1st}$ denotes the first selection period and $H_{2nd}$ denotes the second selection period. Additionally, $f_{1st}$ denotes the first field period and $f_{2nd}$ denotes the second field period. $F_{1st}$ denotes the first frame period and $F_{2nd}$ denotes the second frame period.

In FIG. 56A, since the scanning pattern for the four lines (X1–X4) to be selected in the first selection period $H_{1st}$ inside the first filed period $f_{1st}$ is preset as shown in the figure, it is always (++−+) regardless of the display screen status.

If the entire screen is to be turned on, the display pattern in the first column corresponding to pixels (X1, Y1), (X2, Y1), (X3, Y1), and (X4, Y1) is (++++). The comparison of the two patterns shows that the polarity of the first, second, and fourth pixels is identical, while that of the third pixel is not. In other words, the mismatch count is "1." When the mismatch count is "1," −V2 is selected from the five voltage levels (−V3, −V2, 0, +V2, and +V3). The selection of −V2 raises the voltage to be applied to the liquid crystal elements of scanning lines X1, X2, and X4 which have selected +V1. On the other hand, the selection of −V2 lowers the voltage to be applied to the liquid crystal elements of scanning line X3 which has selected −V1.

In this way, the voltage to be applied to data lines corresponds to "vector weight" during orthogonal conversion, and adding all of the weights for four scanning patterns sets the voltage level such that a true display pattern can be reproduced.

Likewise, −V3 is selected if the mismatch count is "0"; 0 level is selected if the mismatch count is "2"; +V2 is selected if the mismatch count is "3"; and +V3 is selected if the mismatch count is "4." V2 and V3 are set such that their voltage ratio is V2:V3=1:2.

Using the same procedure, the mismatch counts for data line columns Y2 through Ym for four scanning lines X1–X4 are determined, the data of the selection voltage obtained is then transferred to the data line drive circuit, and the voltage determined by the above procedure is applied to the first selection period.

Likewise, when the above procedure is repeated for all scanning lines (X1–Xn), the operation in the first field period ($f_{1st}$) is finished.

Likewise, when the above procedure is repeated for all scanning lines in the second and subsequent field periods, one frame ($F_{1st}$) is finished, and a single screen is displayed.

FIG. 56B shows the voltage waveform that is determined according to the above procedure and that is to be applied to data line (Y1) when the entire screen is ON. FIG. 56C shows the voltage waveform to be applied to pixel (X1, Y1).

When following the above procedure, determining all mismatch counts in a single field period requires all data to be displayed on the screen (all data for a single frame period).

For drive involving simultaneous selection of four lines as in FIG. 56A, all data for a single frame period is required for each field period. In other words, all image data must be fetched from the frame memory a total of four times during a single frame period.

In the case of simultaneous selection of eight lines, all data for a single frame period is required for each field period, and thus all image data must be fetched from the frame memory a total of eight times during a single frame period. In the case of simultaneous selection of 16 lines, all image data must be fetched from the frame memory a total of 16 times during a single frame period. In the case of simultaneous selection of 32 lines, all image data must be fetched from the frame memory a total of 32 times during a single frame period.

In order to maintain orthogonality, all data for a single frame (a total of four times) is required for each field period for simultaneous selection of three lines; all data for a single frame (a total of eight times) is required for each field period for simultaneous selection of five to seven lines; all data for a single frame (a total of 16 times) is required for each field period for simultaneous selection of 9 to 15 lines; and all data for a single frame (a total of 32 times) is required for each field period for simultaneous selection of 17 to 31 lines.

Specific examples of the MLS drive method were explained above.

D. Characteristics of the Preferred Embodiments of the Invention

Figure 1:
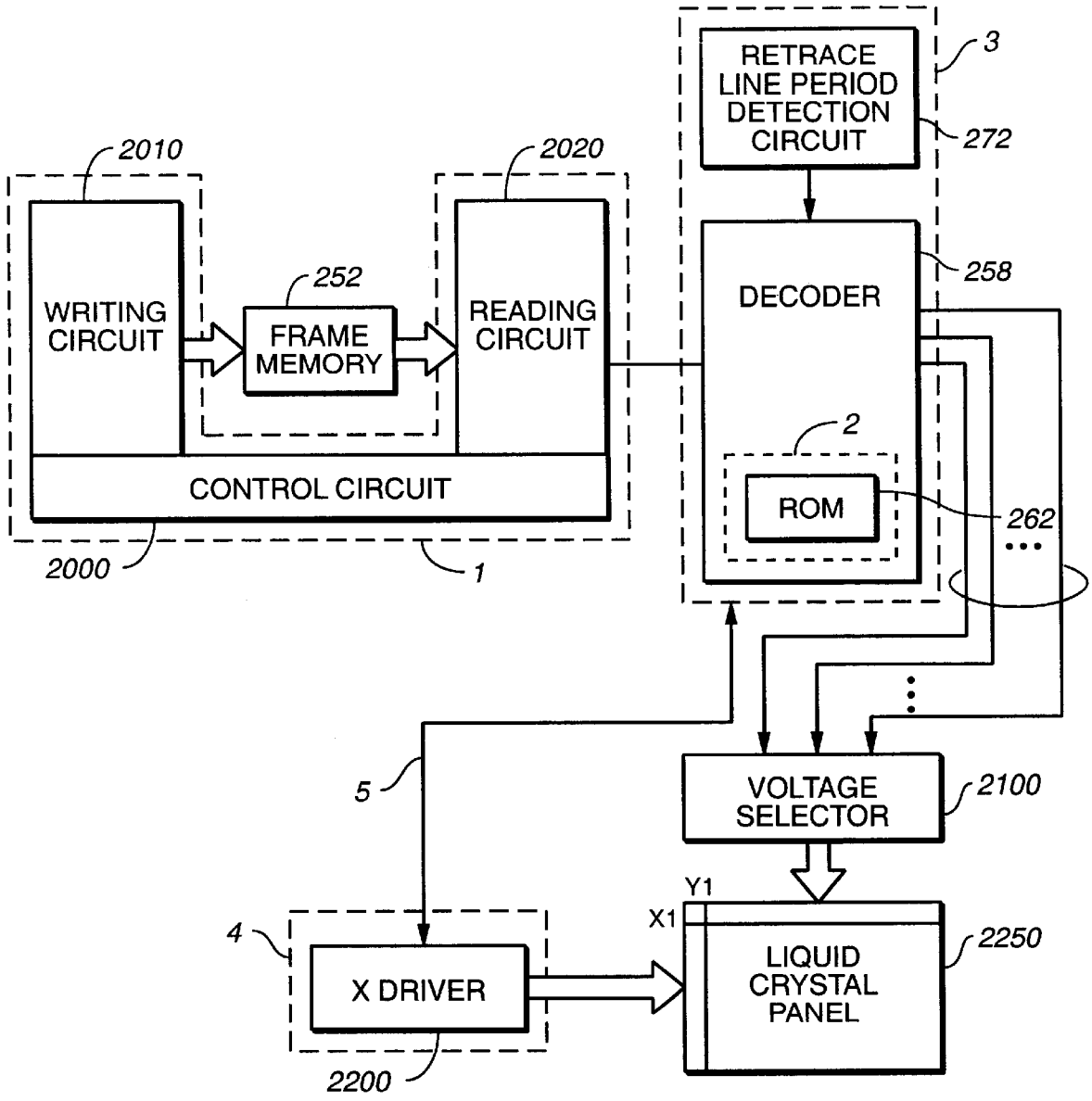
FIG. 1 provides an overview of the present invention.

One of the preferred embodiments of the invention (Embodiments 1 and 2) relates to controlling data input into the frame memory, as indicated by FIG. 1 (1). Input/output can be switched for each frame if more than one frame memory device 252 is used, or multiple pieces of data can be written if a single frame memory is used.

In another preferred embodiment of the invention (Embodiment 3), the mismatch determination circuit inside decoder 258 is configured using ROM 262, as shown in FIG. 1 (2).

In still another preferred embodiment of the invention (Embodiment 4), the voltage to be applied to the data line of liquid crystal panel 2250 becomes fixed when a retrace line period is detected by retrace line period detection circuit 272, as shown in FIG. 1 (3).

In still another preferred embodiment of the invention (Embodiment 5), scanning line drive circuit (X driver) 2200 separates and processes the data required for selecting a scanning line and the data required for determining the voltage to be supplied to the scanning line, thus simplifying the configuration of the scanning line drive circuit, as shown in FIG. 1 (4).

In still another preferred embodiment of the invention (Embodiment 6), flicker, etc. are prevented by modifying the scanning voltage pattern; and as shown in FIG. 1 (5), the scanning voltage pattern is changed while relaying the scanning pattern information between scanning line drive circuit (X driver) 2200 and data line drive circuit (Y driver), thus preventing crosstalk, etc.

The embodiments of the invention are explained below.

EMBODIMENT 1

This embodiment relates to frame memory device 252 shown in FIG. 1.

(A) Explanation of Data Transfer

FIG. 57 shows a timing chart for a single frame period. In this figure, YD is the frame signal indicating the start of a single frame period, and LP is the selection signal indicating the start of a single selection period.

The upper portion of FIG. 57 shows the write timing of the write data (DATA (LINE)) for a line, and the lower portion of FIG. 57 shows the read timing of the read data (DATA_O (LINE)) for a line.

FIG. 58 shows the data transfer timing in a single selection period on a dot unit basis, and shows the details of the operation within a single selection period in FIG. 57. The LP signal in FIG. 57 is the same as the LP signal in FIG. 58. As is clear from FIG. 58, the display data (m pieces) for one scanning line is transferred during a single selection period. Therefore, the display data (n×m pieces) for one screen is transferred during a single selection period.

Furthermore, as is clear from FIG. 57, the ratio between the data input speed and the data output speed is 1:4 when four scanning lines are simultaneously driven.

(B) Problems Identified by the Inventor (1) First problem

In the conventional multiplex drive method, performing ordinary read/write to a single frame memory was sufficient since one scanning line is selected only once during a single frame period.

However, in MLS drive, the number of times all data is read during a single frame period is 2, 4, 4, 8, 8, 8, and 8 when the number of scanning lines to be simultaneously selected is 2, 3, 4, 5, 6, 7, and 8, respectively. Furthermore, the input/output speed ratio is 1:1, 1:1.3, 1:1, 1:1.16, 1:13, 1:1.11, and 1:1 when the number of scanning lines is 2, 3, 4, 5, 6, 7, and 8, respectively.

Consequently, if input and output are simultaneously made to a single frame memory, the subsequent data is written one after another while all data is being read twice, four times, four times, eight times, etc. during a single frame period, mixing the old and new data. As a result, the content of the data that is read will be different every time all data is read twice, four times, four times, eight times, . . .

(2) Second problem

As explained in FIG. 55, to simultaneously select h scanning lines, two, four, four, eight, eight, eight, eight, sixteen, etc. pieces of image data must be simultaneously read from the frame memory, and the mismatch with the selection pattern must be detected. In this case, if both the new and old data coexist in the data that is simultaneously read, mismatch determination will be incorrect, producing meaningless streaks in some areas of the displayed image, for example, and as a result the display quality will be significantly lowered.

Figure 4A:
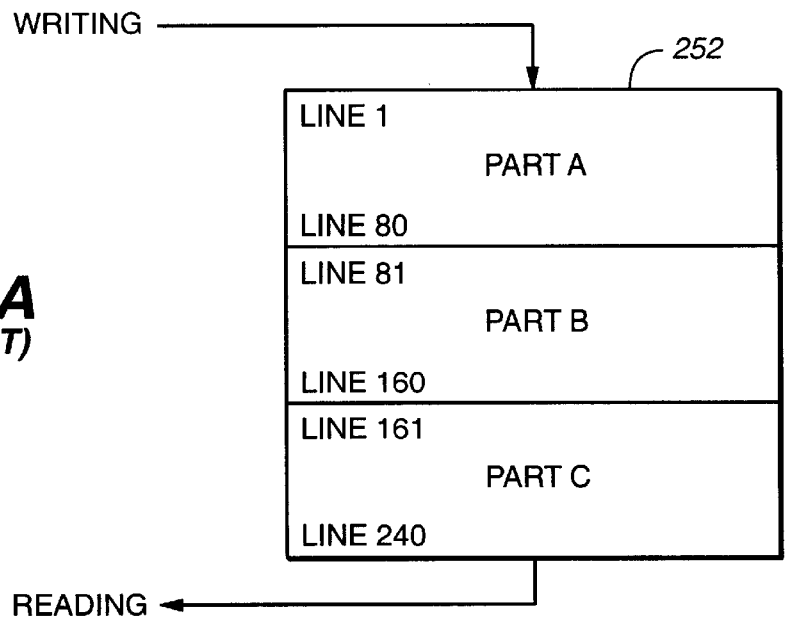
FIG. 4A (PRIOR ART)
FIG. 4A is a drawing that explains the problem associated with the use of a conventional frame memory access technology.
Figure 4B:
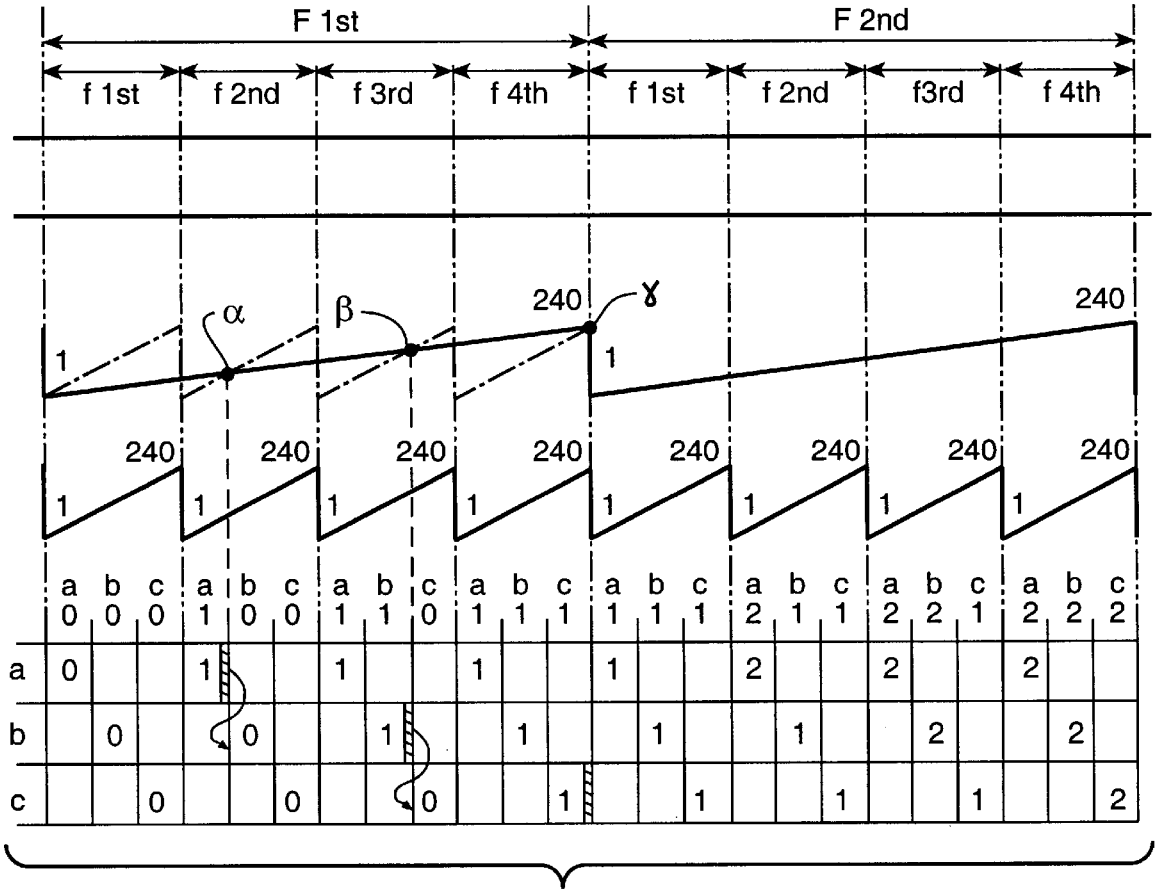
FIG. 4B (PRIOR ART)
FIG. 4B is another drawing that explains the problem associated with the use of a conventional technology.
Figure 7:
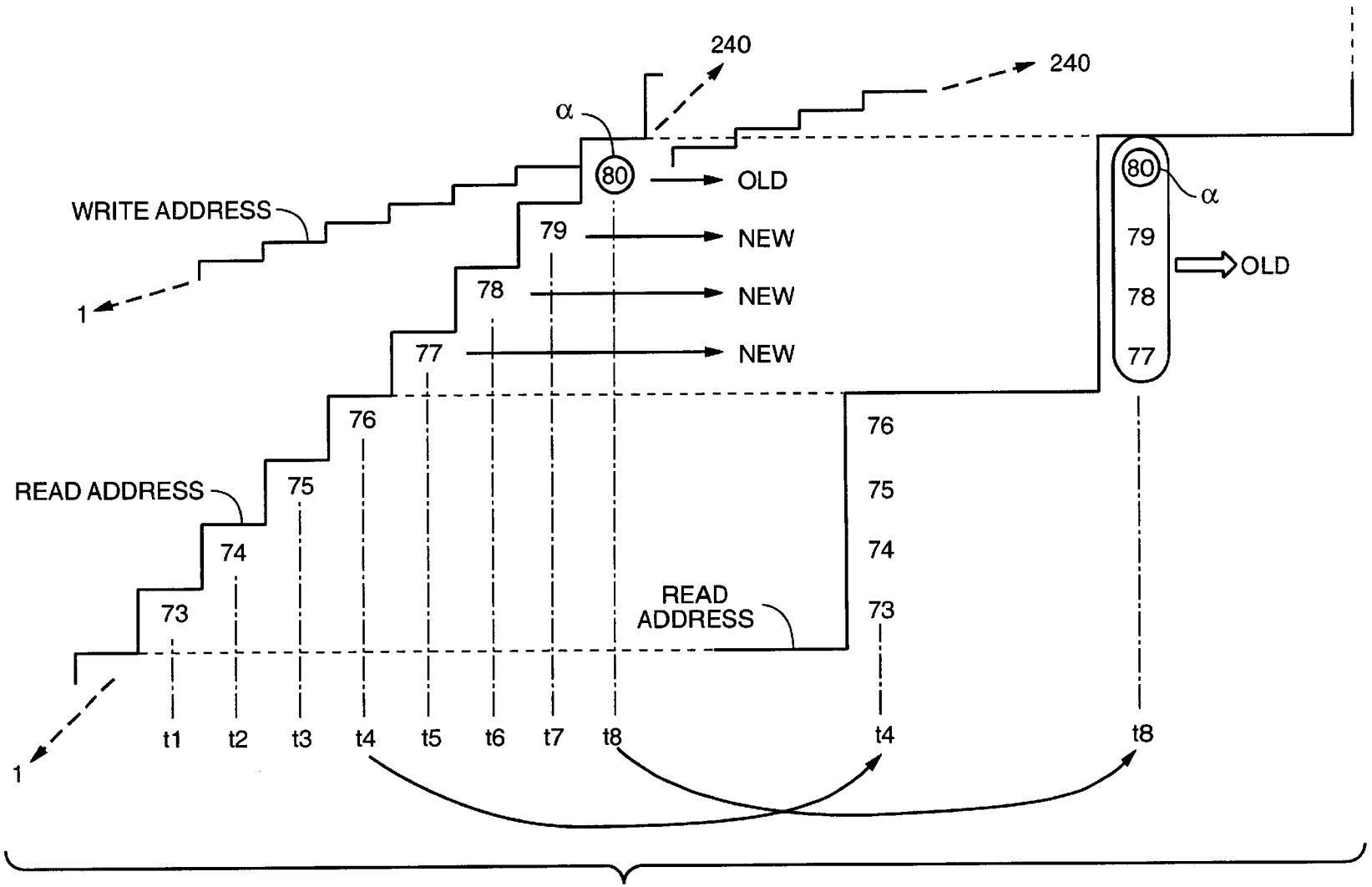
FIG. 7 is a drawing that explains the reason why the frame memory access technology in Embodiment 2 shown in FIG. 6B solves the problem.

This problem is shown in FIGS. 4B and 7.

FIG. 4B shows read/write to a single frame memory when four scanning lines are simultaneously selected and the total number of scanning lines n=240.

As shown in FIG. 4A, the interior of a single frame memory is divided into parts a, b, and c each consisting of 80 scanning lines. As shown in FIG. 4B, in the first field period ($f_{1st}$) of the first frame period ($F_{1st}$), only the data belonging to the pervious frame (old data which is shown as "0" on the bottom column of FIG. 4B) is read. In the second field period ($f_{2nd}$), the read data corresponding to part a of the frame memory becomes the data newly written during the current frame period (new data which is shown as "1" on the bottom column of FIG. 4B). This results in coexistence of new and old data.

The relationship between the read address and the write address in the second field period ($f_{2nd}$) is shown on the left side of FIG. 7.

As shown on the left side of FIG. 7, the write address matches the read address at the address corresponding to line 80. This address corresponds to point α in FIG. 4B.

The four pieces of data corresponding to lines 77, 78, 79, and 80 are the data necessary for mismatch determination. In this case, as explained in FIG. 7, the data corresponding to lines 77, 78, and 79 is new, and only the data corresponding line 80 is old. In other words, new and old data coexist inside the data for lines 77–80. As a result, accurate mismatch count cannot be obtained, causing distortion in the display.

That is, new and old data are read together when the memory write address exceeds the read address, resulting in a meaningless display state.

This kind of address overrun also occurs in line 160 (point β in FIG. 4B) and line 240 (point γ in FIG. 4B).

In general, when the data for line n is written and the data for lines n−3–n is read, the data of line n belongs to the previous frame while the data for lines n−3 through n−1 is the newly written data.

These problems were identified through the investigation by the inventor.

(C) Content of Embodiment 1

Figure 5A:
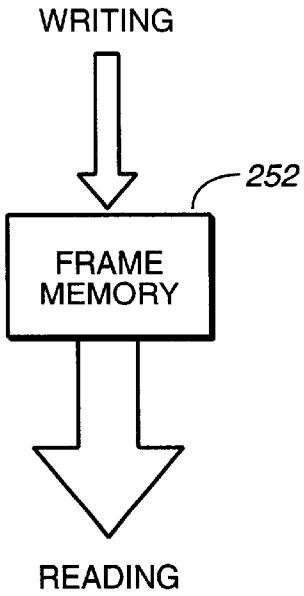
FIG. 5A (PRIOR ART)
FIG. 5A is a drawing that explains a conventional frame memory access technology.
Figure 5B:
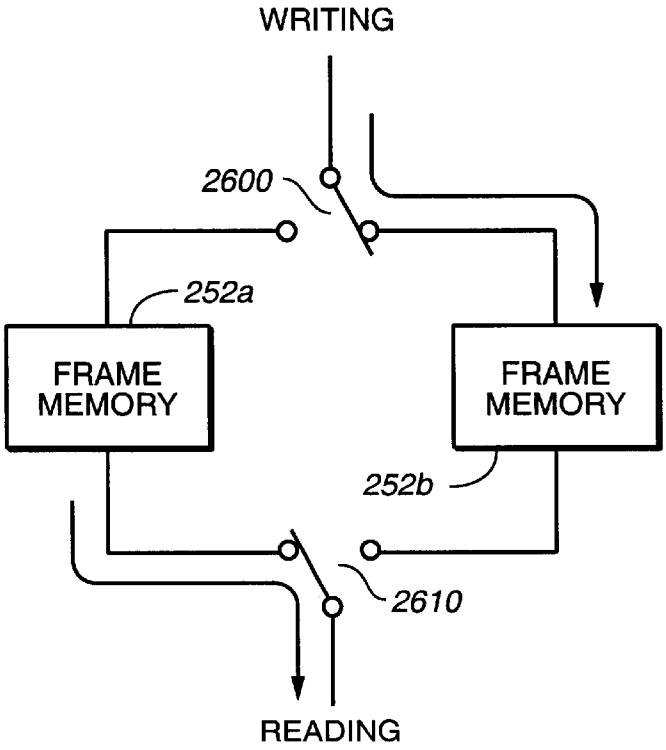
FIG. 5B is a drawing that explains the access technology in Embodiment 1 of the invention.

As shown in FIG. 5B, two frame memory devices 252*a* and 252*b*, each possessing sufficient capacity for a single frame, are provided, and input switch 2600 and output switch 2610 are switched to opposite phases for each frame during the same cycle. In other words, data is read/written in a double-buffering format.

This configuration eliminates coexistence of display data from different frames during a single frame period when the mismatch count is determined. Therefore, the mismatch count determination, and the display as a consequence, can be accurately performed. As a result, even when display involves frequent screen changes, natural display can be achieved. That is, above-mentioned problems (1) and (2) are solved.

EMBODIMENT 2

(A) Characteristics of Embodiment 2

Since frame memory is expensive, it is often strongly desirable to reduce the required frame memory capacity.

In such a case, as shown in FIG. 5A, only one frame memory device 252 is used as is conventionally done, and only above-mentioned problem (2) (the problem associated with mixing of data belonging to different frame periods into the multiple pieces of data necessary for mismatch determination) is solved by changing the data write method.

In this case, above-mentioned problem (1) still occurs. However, since the data of continuous frames is nearly identical in the case of still or semi-still images, acceptable images can be formed. Furthermore, even for moving image display, since the response speed of liquid crystal is around 50 msec, i.e., approximately three times a single frame period (16.6 msec), minimally acceptable display can be achieved even if data belonging to new and old frames is mixed in.

Figure 6A:
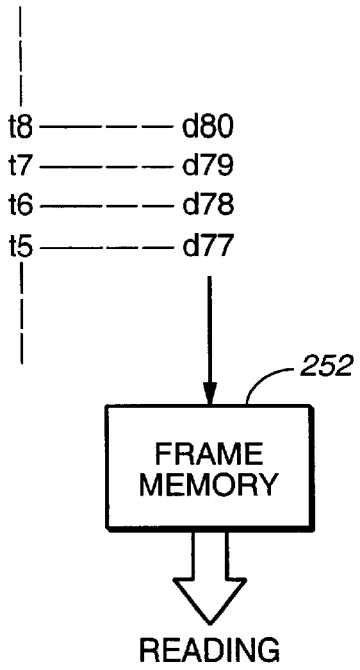
FIG. 6A (PRIOR ART)
FIG. 6A is a drawing that explains a conventional frame memory access technology.
Figure 6B:
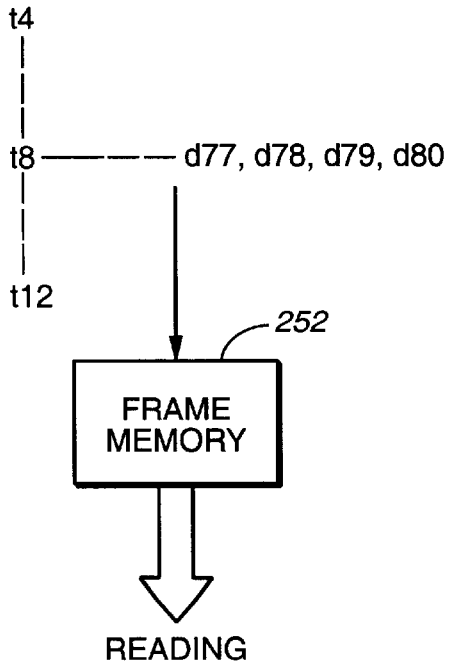
FIG. 6B is a drawing that explains the access technology in Embodiment 2 of the invention.

To solve above-mentioned problem (2) while using only one frame memory as before, the write method shown in FIG. 6B or on the right side of FIG. 7 is used.

That is, as shown on the right side of FIG. 7, multiple pieces of data to be used for mismatch determination are written all in a batch. In other words, as shown in FIG. 7, four pieces of data corresponding to lines 77, 78, 79, and 80 are simultaneously written at time t8. Since these pieces of data are simultaneously written, they belong to the same frame period, and thus mixing of new and old data is prevented. As a result, distorted display is prevented from occurring.

Note that FIG. 6A shows the data write method using a conventional technique.

(B) Overall Configuration of a Liquid Crystal Display Device

Figure 2:
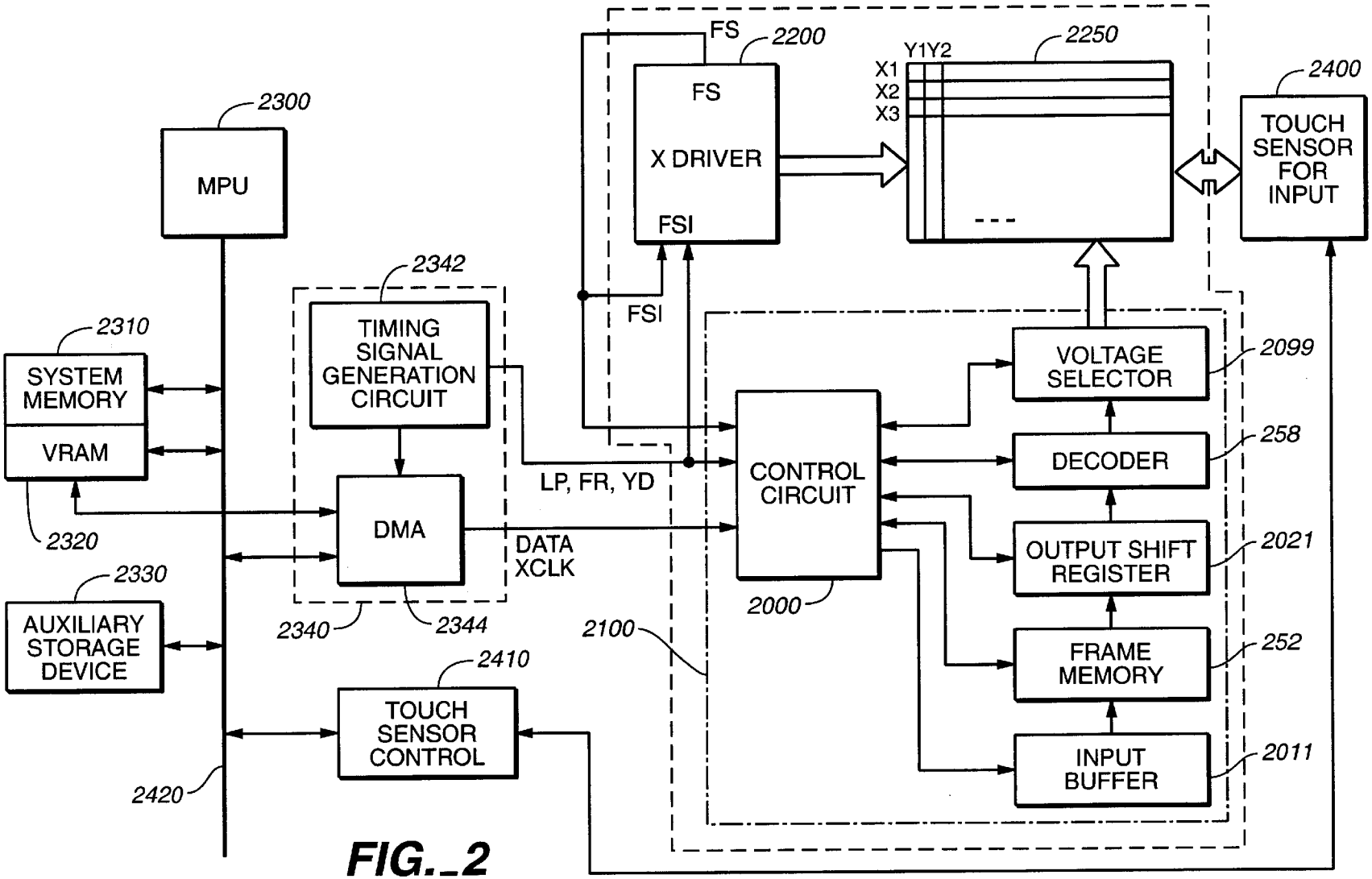
FIG. 2 shows the overall configuration of the display device according to the present invention.

FIG. 2 shows the overall configuration of a liquid crystal display device.

When an instruction is received from the microprocessor (MPU) 2300, DMA control circuit 2344 inside module controller 2340 accesses video RAM (VRAM) 2320, reads one frame's worth of image data via system bus 2420, and sends that image data (DATA) along with the clock signal (XCLK) to the data line drive circuit (surrounded by the dot-dashed line in FIG. 2) 2099.

Data line drive circuit 2099 is provided with control circuit 2000, input buffer 2011, frame memory 252, output shift register 2021, decoder 258, and voltage selector 2100.

Reference number 2400 indicates an input touch sensor and reference number 2410 indicates a touch sensor control circuit. Input touch sensor 2400 and touch sensor control circuit 2410 can be eliminated if unnecessary.

Figure 3B:
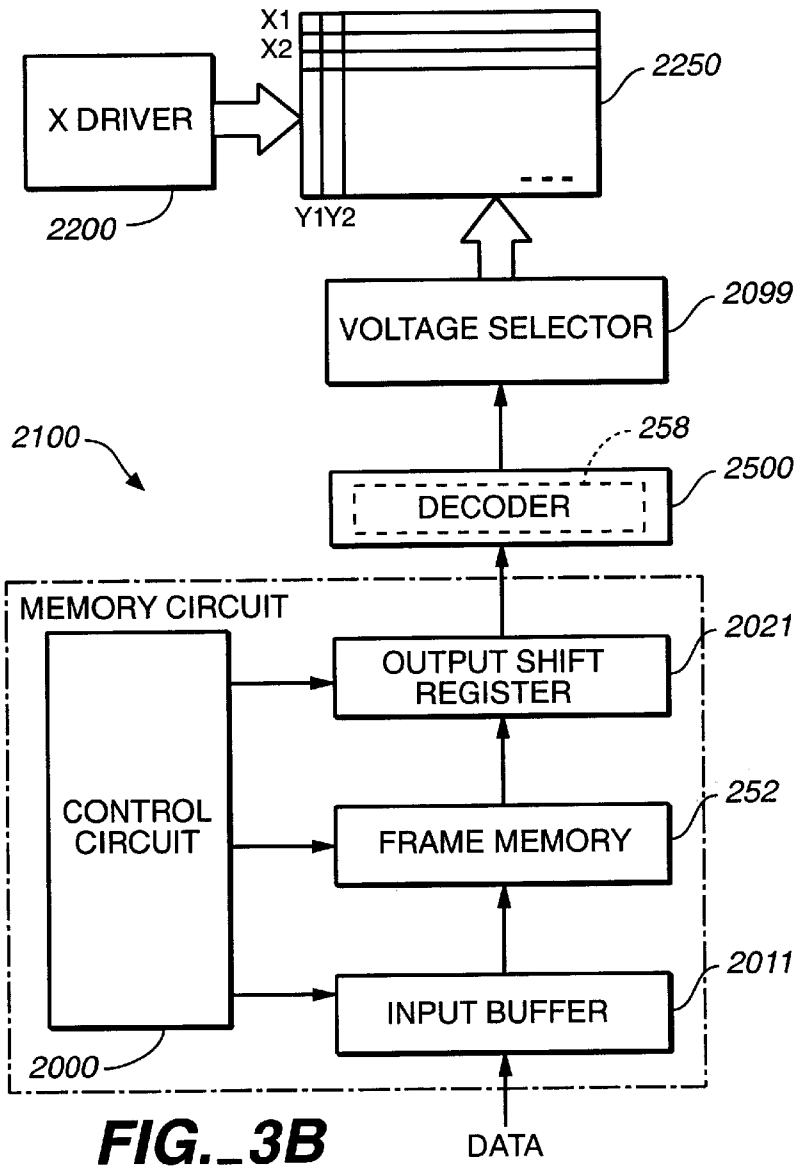
FIG. 3B shows another positioning example of the circuit for driving the data line.
Figure 3A:
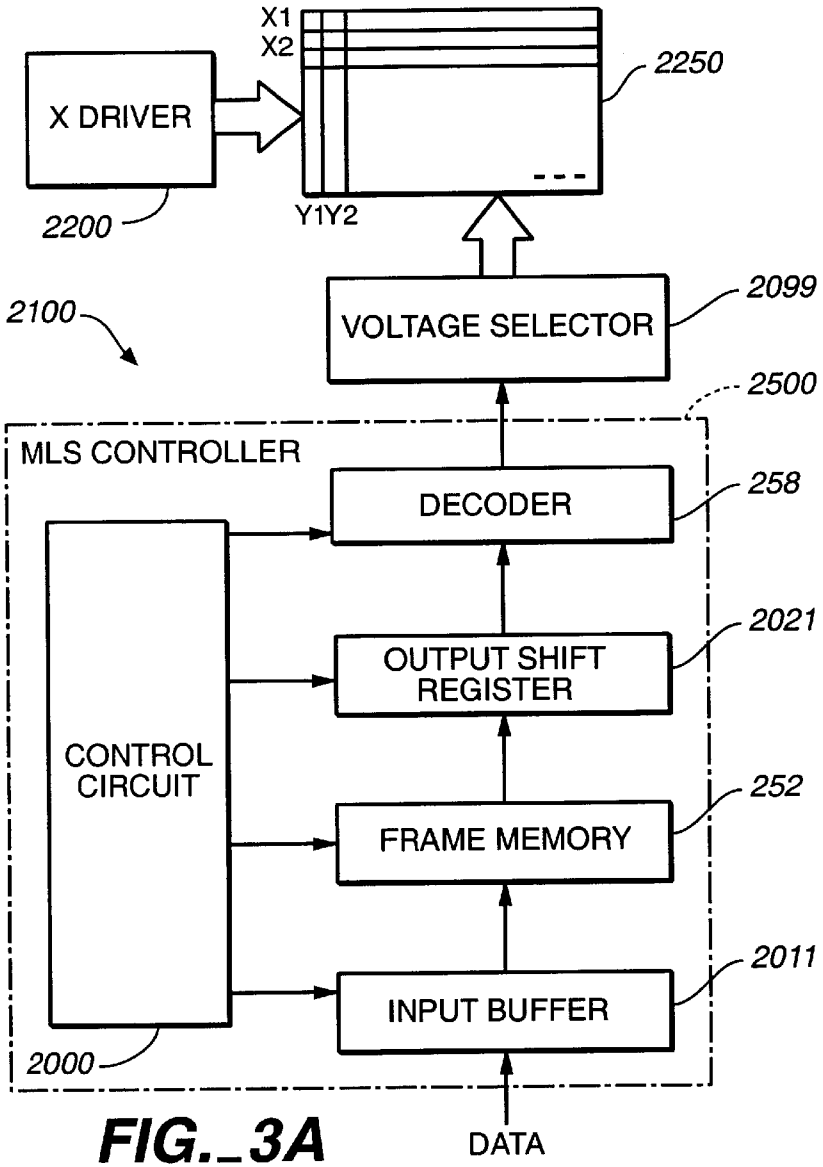
FIG. 3A shows a positioning example of the circuit for driving the data line.

In addition to the configuration shown in FIG. 1, configurations shown in FIGS. 3A and 3B can also be used. In the configuration in FIG. 3A, control circuit 2000, input buffer 2011, frame memory 252, output shift register 2021, and decoder 258 are contained inside MLS decoder 2500. In the configuration in FIG. 3B, only decoder 258 is integrated inside MLS decoder 2500, and control circuit 2000, input buffer 2011, frame memory 252, and output shift register 2021 are integrated inside memory circuit 2510.

(C) Specific Circuit Configuration

Figure 8:
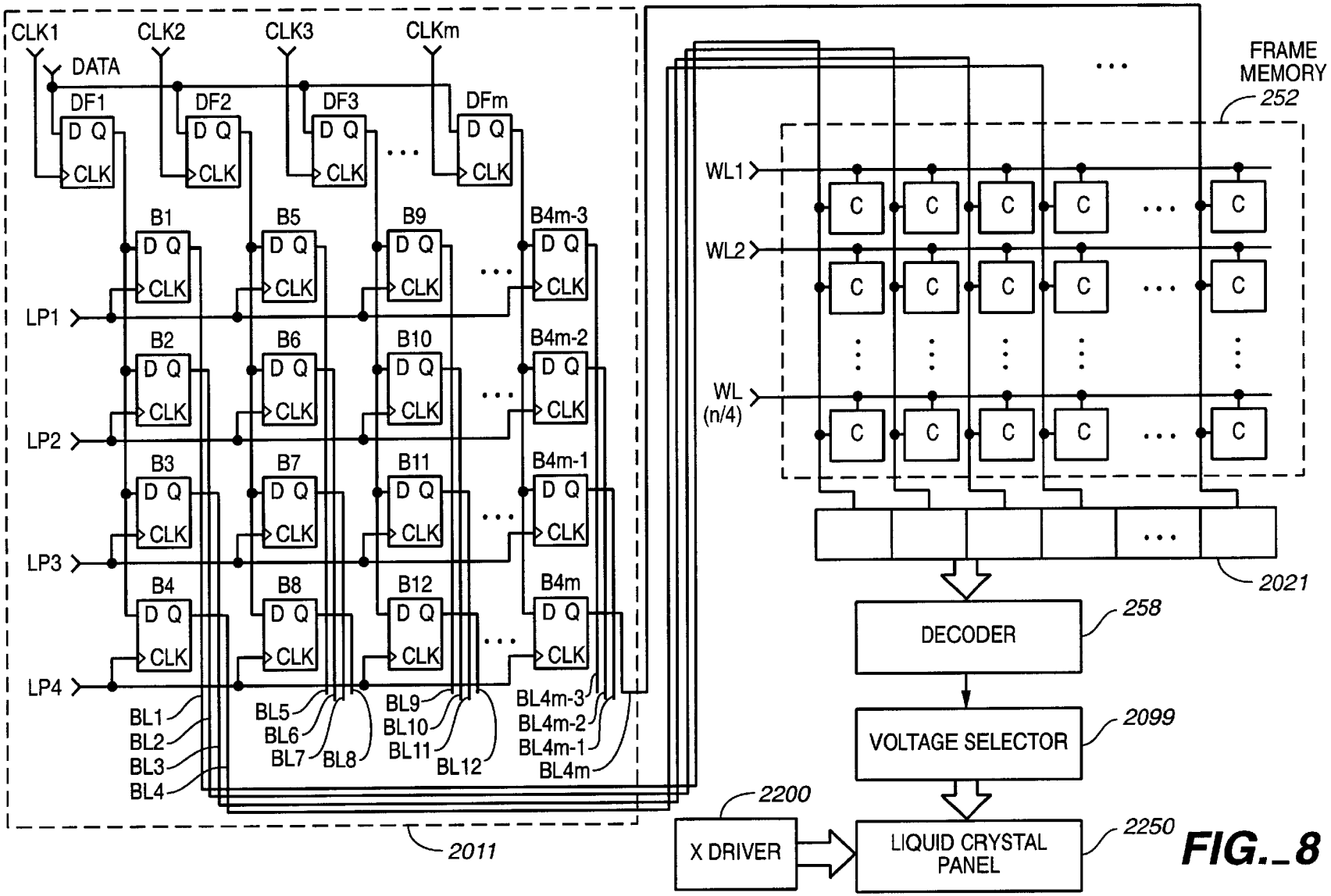
FIG. 8 shows a circuit configuration for achieving the frame memory access shown in FIG. 6B.
Figure 9:
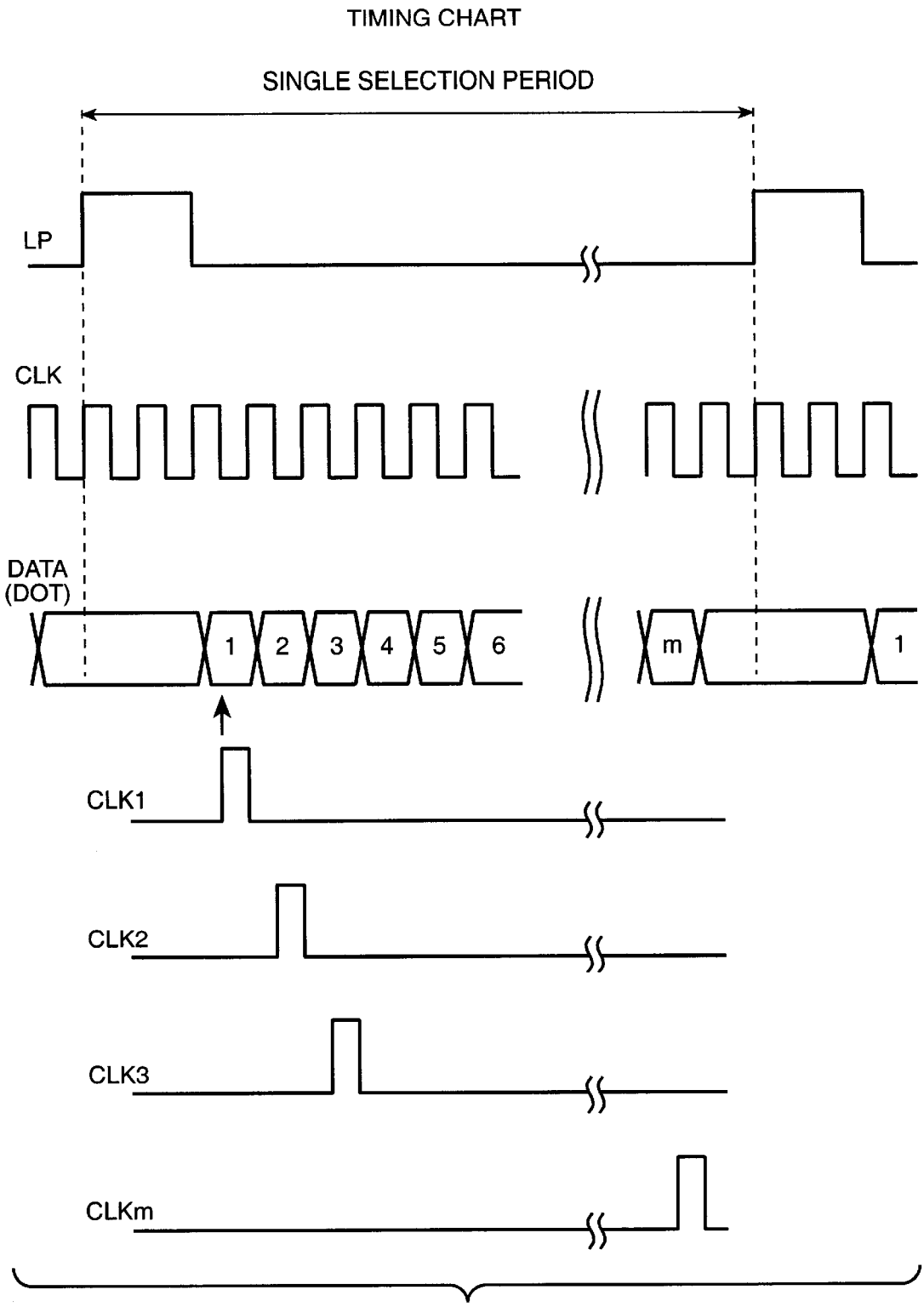
FIG. 9 is a timing chart showing the operation of input buffer circuit 2011 shown in FIG. 8.
Figure 10:
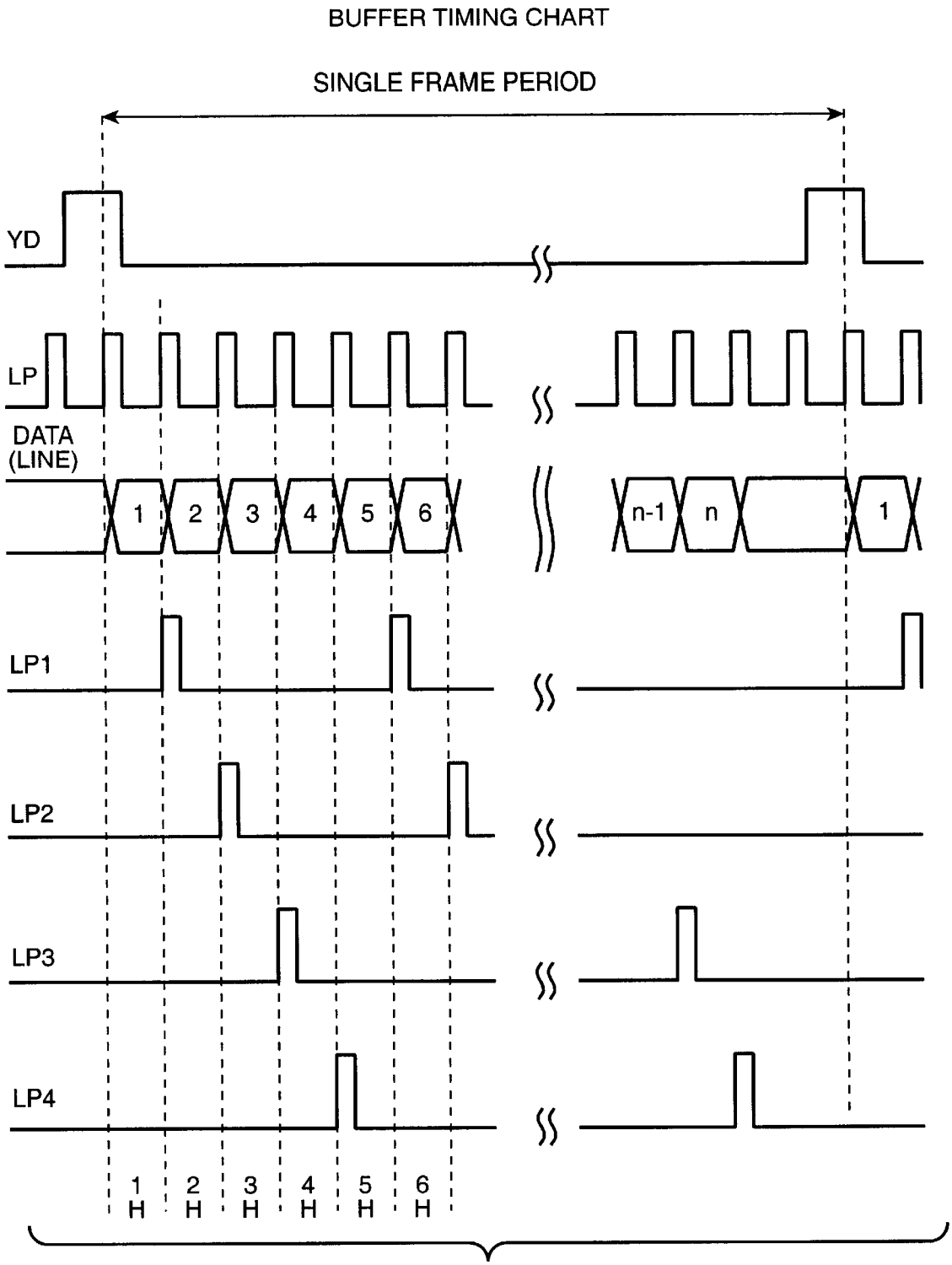
FIG. 10 is also a timing chart showing the operation of input buffer circuit 2011 shown in FIG. 8.

FIG. 8 shows specific configurations of input buffer circuit 2011 and frame memory 252 shown in FIG. 2. FIGS. 9 and 10 are timing charts showing the operation of input buffer circuit 2011.

Control circuit 2000 shown in FIG. 2 creates control signals CLK1–CLKm and LP1–LP4 based on the clock signal sent from DMA control circuit 2344, and accumulates four lines' worth of image data in input buffer circuit 2011.

As shown in FIG. 8, input buffer circuit 2011 comprises D flip-flops (DFFs) DF1–DFm which store one line worth of input data and DFFs B1–B4*m* which store four lines' worth of input data.

As shown in FIGS. 9 and 10, in the first selection period ($H_{1st}$), the data to be displayed in the pixel at the intersection of X1 and Y1 (DOT1) is stored in DF1 when CLK1 is input in DF1. Likewise, the data to be displayed in the pixel at the intersection of X1 and Y2 (DOT2) is stored in DF2 when CLK2 is input in DF2, and the data to be displayed in the pixel at the intersection of X1 and Ym (DOTm) is stored in DFm when CLKm is input in DFm.

Data stored in DF1–DFm (LINE1) is moved to B1, B5, B9, . . . , B4*m*-3 based on signal LP1.

Likewise, in the next (second) selection period $H_{2nd}$, the data to be displayed in the pixels at the intersections of X2 and Y1–Ym (LINE2) is stored in DF1–DFm based on CLK1–CLKm. The data stored in DF1–DFm is moved to B2, B6, B10, . . . , B4*m*-2 based on signal LP2.

Likewise, in the next (third) selection period $H_{3rd}$, the data to be displayed in the pixels at the intersections of X3 and Y1–Ym (LINE3) is stored in DF1–DFm based on CLK1–CLKm. The data stored in DF1–DFm is moved to B3, B7, B11, . . . , B4*m*-1 based on signal LP3.

Likewise, in the last (fourth) selection period $H_{4th}$, the data to be displayed in the pixels at the intersections of X4 and Y1–Ym (LINE4) is stored in DF1–DFm based on CLK1–CLKm. The data stored in DF1–DFm is moved to B4, B8, B12, . . . , B4*m* based on signal LP4.

After the first four lines (X1–X4) worth of image data is stored in input buffer circuit 2011 and before the next field period, control circuit 2000 selects word line WL1 of data accumulation means 19 and that data is stored in the RAM 252 connected to WL1 and to BL1 through BL4*m* of FIG. 5. The data for the next four lines (X5–X8) and subsequent lines is also stored in the same way.

Frame memory 252 is configured using SRAM manufactured in an ordinary CMOS process.

In other words, frame memory 252 possesses 4m bit lines (BLs) and n/4 (integer) word lines (WLs). The capacity of the RAM is 4m×(n/4)=m×n (data line count x scanning line count) and is sufficient for one frame. In FIG. 8, the symbol C inside frame memory 252 indicates a memory cell. Note that DRAM, high-resistance RAM, or other memory device that can temporarily store data can be used in place of the SRAM.

Control circuit 2000 reads data for each word line (WL) and outputs to output shift register 2021. Consequently, the data for four continuous lines within the same frame period is output at the same time.

Output shift register 2021 outputs the data for four pixels necessary for mismatch determination to decoder 258.

As explained in FIG. 55, decoder 258 determines the mismatch count by comparing the scanning pattern with the image data, and sends the signal for determining the data line drive voltage to voltage selector 2100. Voltage selector 2100 selects a voltage that corresponds to the signal received and applies that voltage to the data line. FIG. 56B shows an example of data line drive voltage waveform.

Scanning line drive circuit 2200 forms the scanning voltage waveform shown in FIG. 56A.

As explained above, in the case of simultaneous selection of four lines, if the input buffer circuit has the capacity for a total of five lines (i.e., one line+four lines), the data for line n will be stored in the data storage means at the same timing as the data for lines n−3 through n−1 even if reading occurs at the conventional timing. Therefore, data from different frames will not be mixed in the four lines simultaneously selected. Moreover, the frame memory only needs capacity that is large enough for one frame.

Although the above explanation is for four lines, it is applicable to simultaneous selection of three, five, six, seven, or eight lines, etc. That is, if the buffer means possesses capacity that is equal to the display data for one line plus the display data for the lines to be simultaneously selected, data from different frames will not be mixed in the simultaneously selected lines. Furthermore, this buffer is useful for converting image data to mismatch count data for voltage selection because processing can be performed based on the unit of data for the simultaneously selected lines.

Furthermore, although the above explanation used a simple-matrix liquid crystal panel, the present invention is not limited to such an application, and is applicable to display devices using an MIM or EL panel.

A modified example of Embodiment 2 is explained below.

Figure 11:
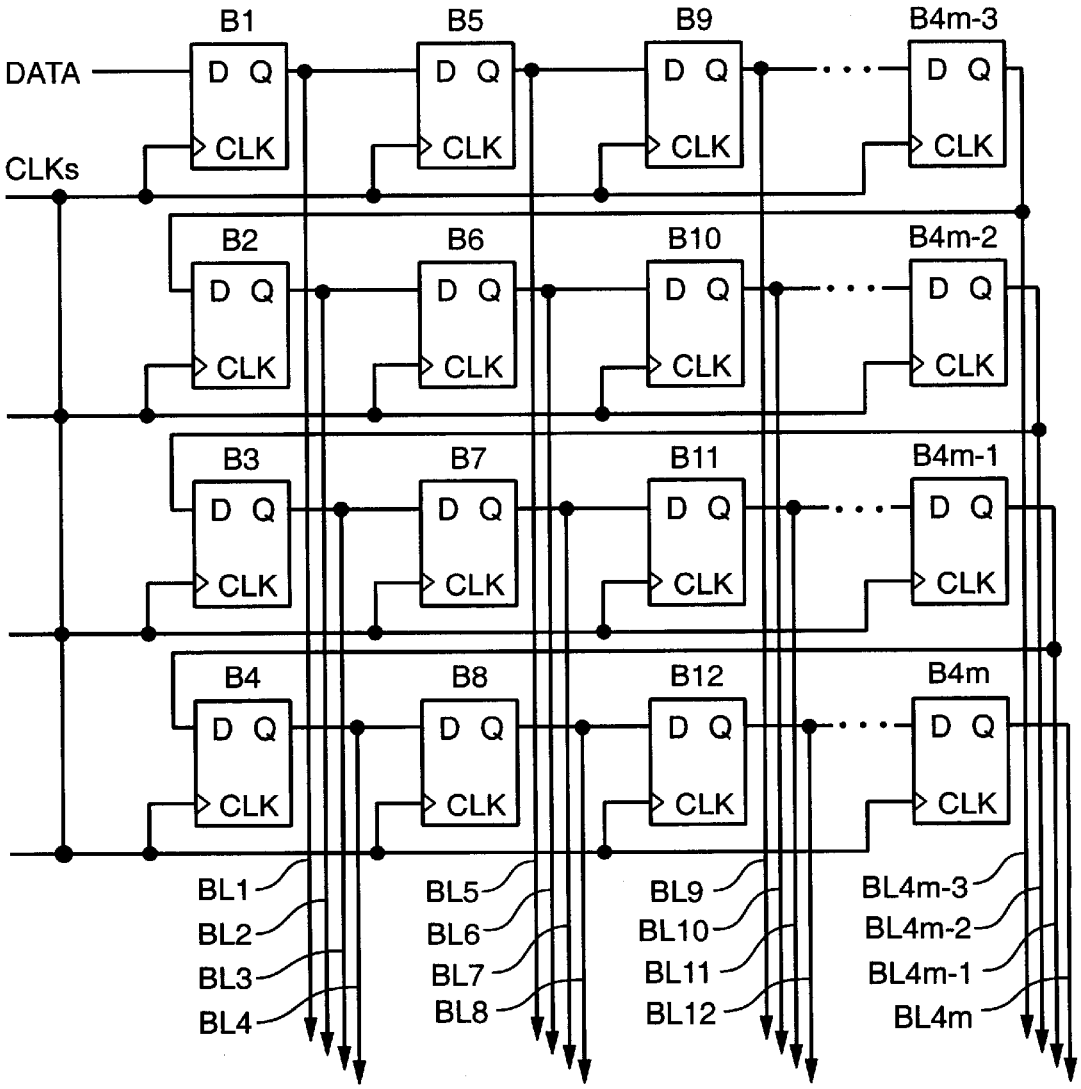
FIG. 11 shows a configuration example of part of input buffer circuit 2011 shown in FIG. 8.

In the modified example shown in FIG. 11, input buffer circuit 2011 is configured using shift registers possessing sufficient capacity for storing the data for lines to be simultaneously selected.

FIG. 11 shows a configuration example of input buffer circuit 2011. Input buffer circuit 2011 comprises 4m DFFs (B1–B4*m*, where 4m is [number of lines to be simultaneously selected]×[data line output count]). These DFFs are shift registers that shift from B1 to B4*m*, and the order of shift is B1, B5, B9, . . . , B4*m*-3, B2, B6, B10, . . . , B4*m*-2, B3, B7, B11, . . . , B4*m*-1, B4, B8, B12, . . . , B4*m*. The outputs of B1–B4*m* are connected to bit lines BL1–BL4*m*, respectively, of the data accumulation means in FIG. 5.

Figure 12:
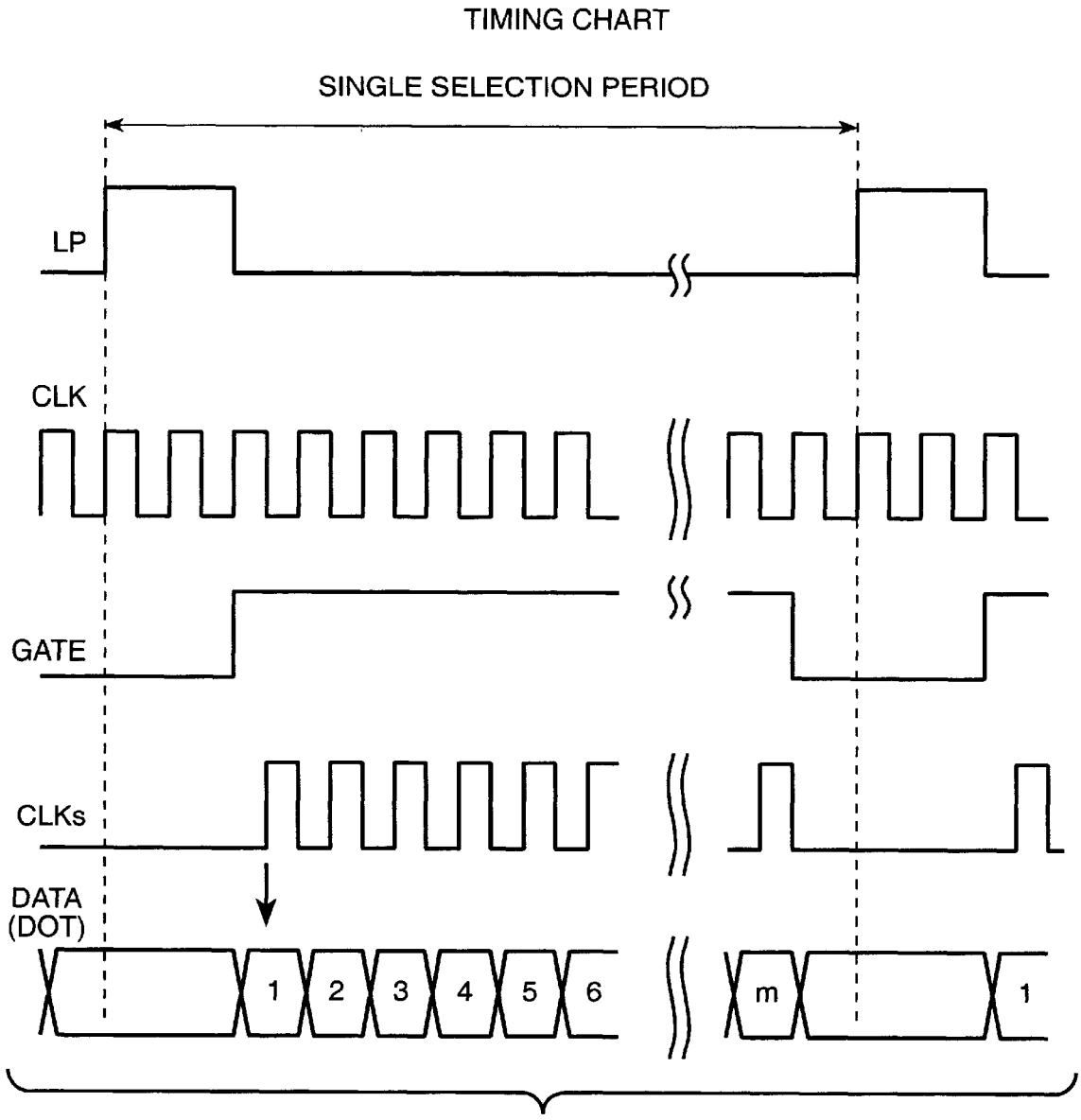
FIG. 12 is a timing chart showing the operation of the circuit shown in FIG. 11.

Signal CLKs connected to the CLK pin of DFFs is obtained by using control circuit 2000 to extract and reverse CLK in FIG. 58 after masking the portion in which data is present (see FIG. 12). When signal DATA is input from B1 and shifted by CLKs at the timing shown in FIG. 12, and four lines' worth of data is stored, that data is transferred to the frame memory in the operation described above.

Since all DFFs run synchronously with CLKs in this modified example, the number of DFFs can be reduced by m (one line's worth), resulting in lower cost and smaller space requirement.

Next, the modified example shown in FIG. 13 will be explained.

Figure 13:
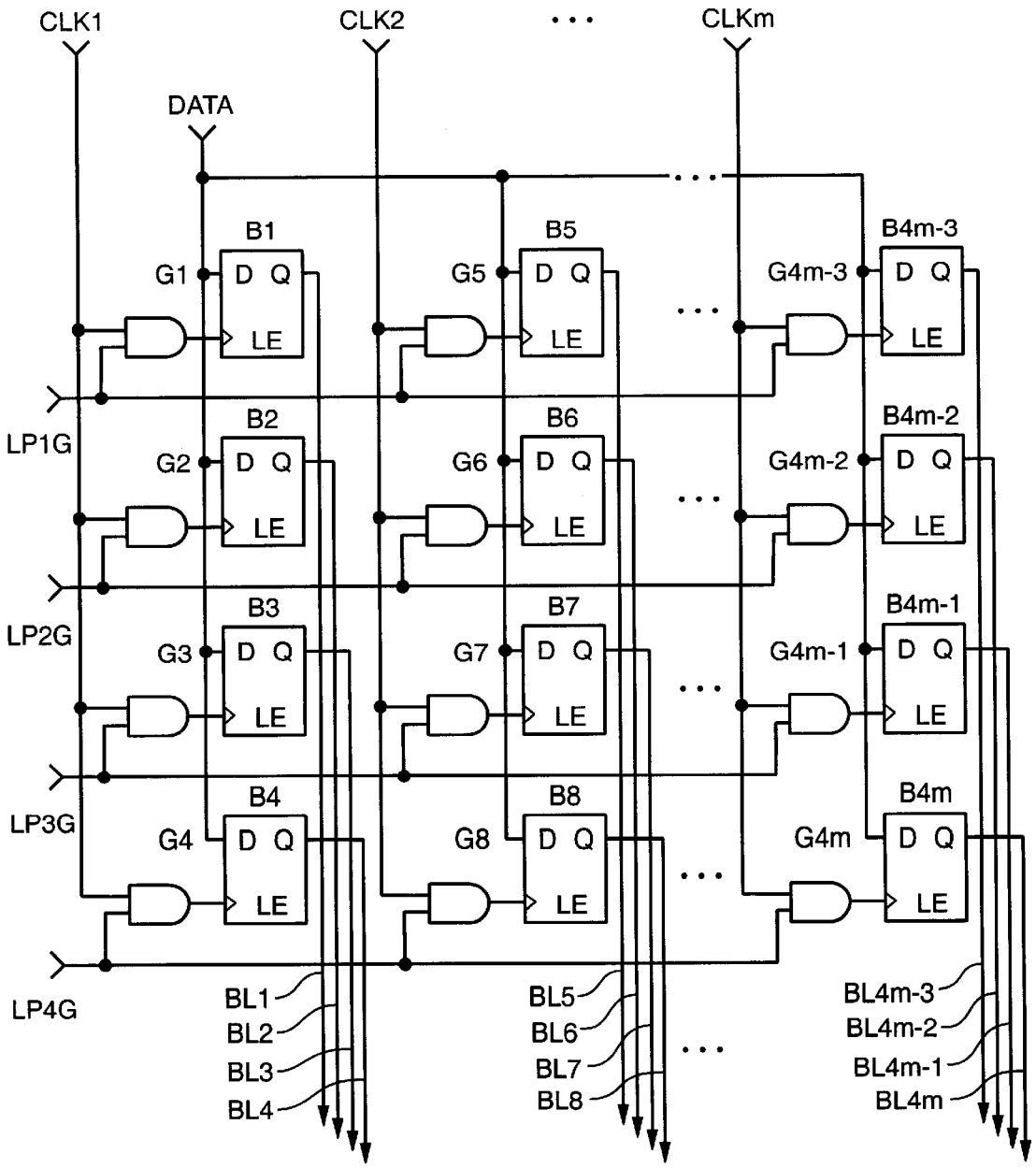
FIG. 13 shows another configuration example of part of input buffer circuit 2011 shown in FIG. 8.

The characteristic of the modified example in FIG. 13 is that input buffer circuit 2011 is configured using D-type transparent latches (DTLs) for storing the data for the lines to be simultaneously selected and AND gates.

A DTL is an element that is also called a through latch which passes through the data connected to pin D if the latch enable (LE) pin is High (active), and which holds the state of pin D (data) that was valid immediately before LE fell if the latch enable (LE) pin is Low (inactive).

The input buffer circuit in FIG. 13 comprises 4m DTLs (B1–B4*m*, where 4m is [number of lines to be simultaneously selected]×[signal electrode output count]). An AND gate G1, G2, G3 . . . G4*m* is connected to each of these DTLs. A transparent latch DTL usually has a smaller circuit configuration than a DFF because of the smaller number of internal gates. Therefore, even when an AND gate is added to a DTL, the resulting circuit is only as large as a DFF. Consequently, the circuit can be configured with a size that is about the same as that in FIG. 11, and with an operation that is the same as that of Embodiment 1.

Figure 14:
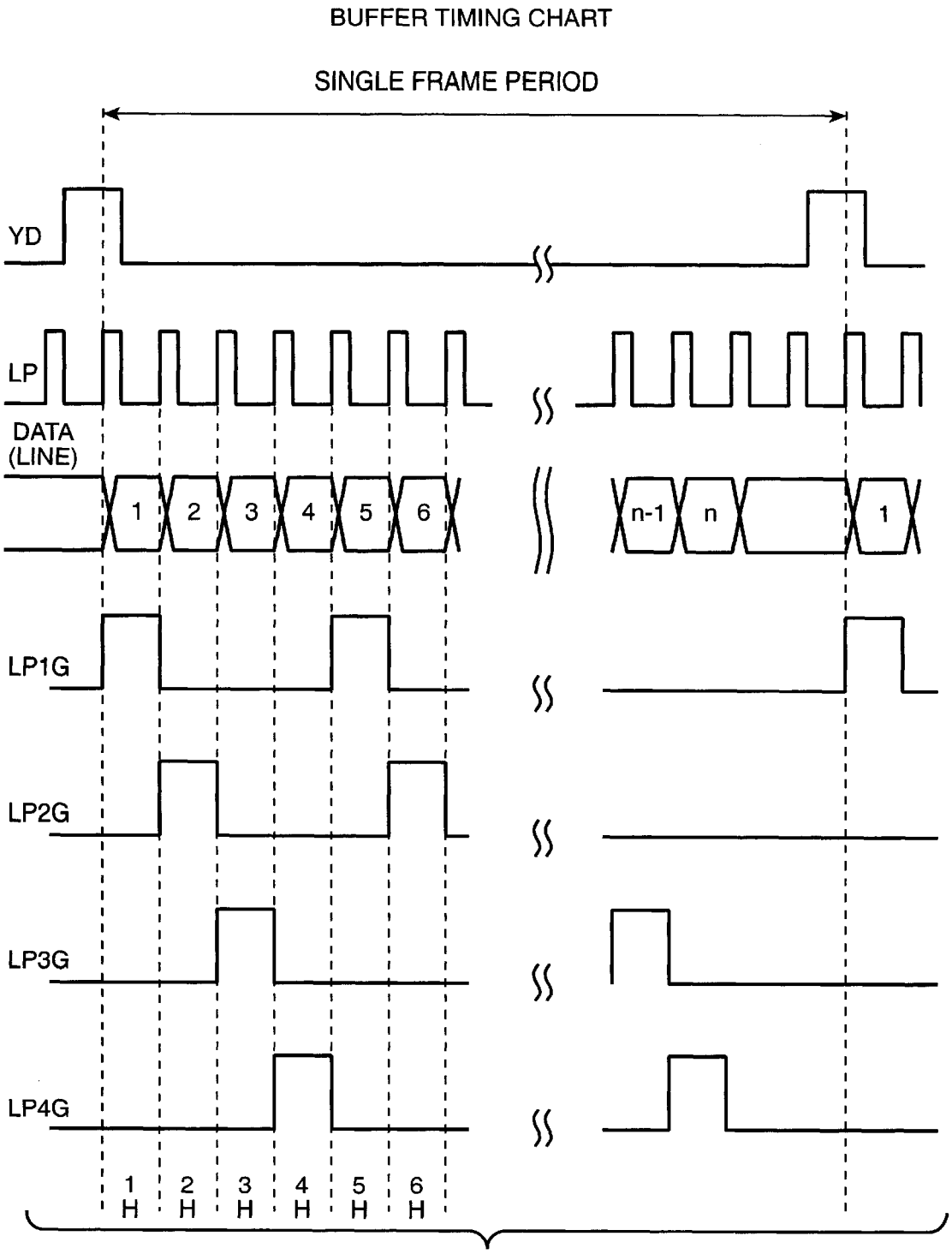
FIG. 14 is a timing chart showing the operation of the circuit shown in FIG. 13.
Figure 15:
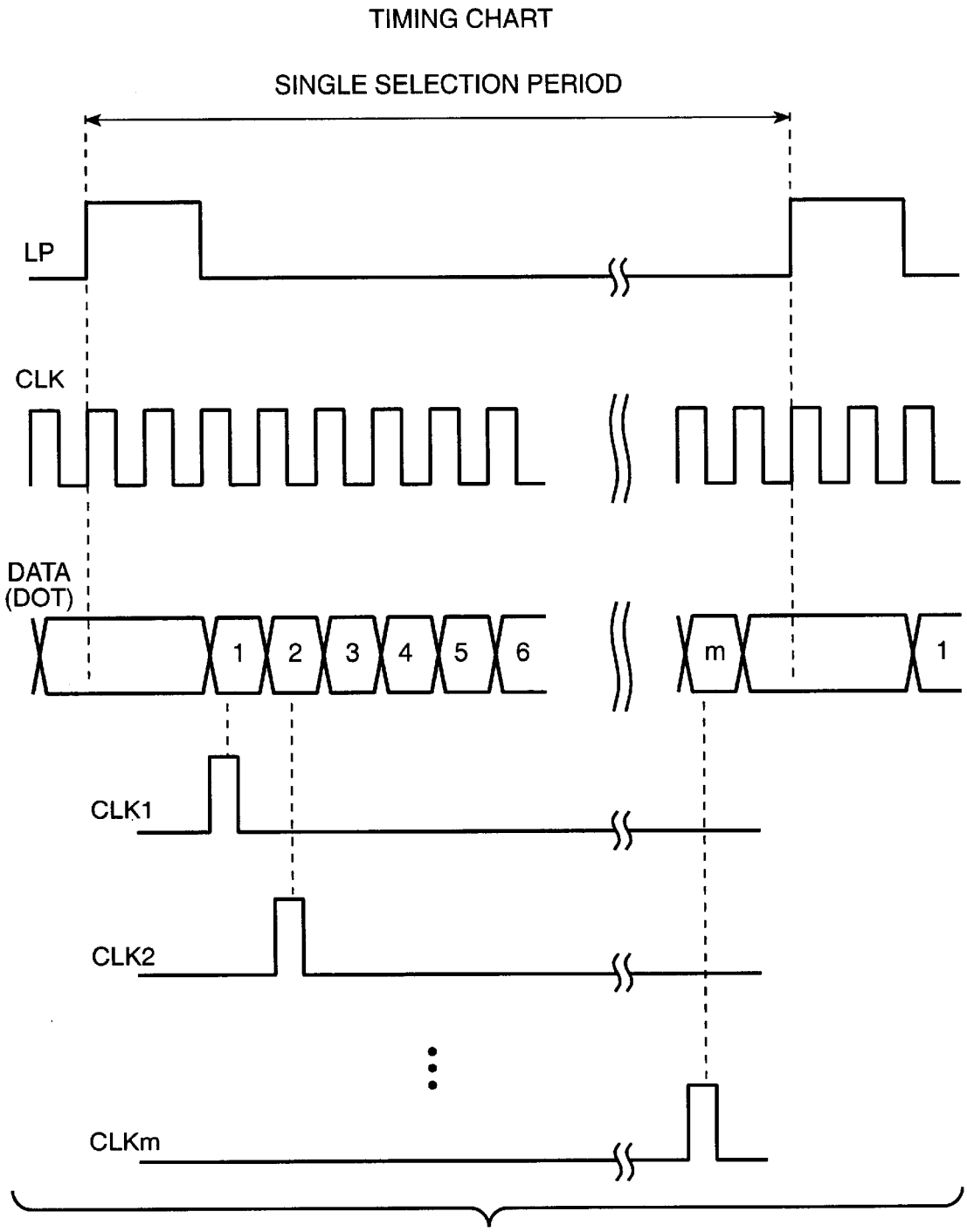
FIG. 15 is also a timing chart showing the operation of the circuit shown in FIG. 13.

FIGS. 14 and 15 are timing charts that explain the accumulation operation of the input buffer circuit in FIG. 13.

In FIG. 14, only the LP1G signal is High (active) in the first selection period ($H_{1st}$). Only CLK1 through CLKm that are input into the AND gates G!, G5 . . . G4*m*-3 connected to LP1G in FIG. 13 are input into latch B1, latch B5, . . . , latch B4*m*-3.

In other words, in the first selection period ($H_{1st}$), the data to be displayed at the pixels located at intersections of X1 and Y1–Ym (LINE1) is accumulated in latch B1, latch B5, . . . , latch B4*m*-3 according to CLK1 through CLKm.

In the next (second) selection period ($H_{2nd}$), only the LP2G signal is High (active). Only CLK1 through CLKm that are input into the AND gates G2, G6 . . . G4*m*-2 connected to LP2G are input into latch B2, latch B6, . . . , latch B4*m*-2. In other words, in 2H, the data to be displayed at the pixels located at intersections of X2 and Y1–Ym (LINE2) is accumulated in latch B2, latch B6, . . . , latch B4*m*-2 according to CLK1 through CLKm.

Likewise, in the third selection period ($H_{3rd}$), the data to be displayed at the pixels located at intersections of X3 and Y1–Ym (LINE3) is accumulated in latch B3, latch B7, . . . , latch B4*m*-1 according to CLK1 through CLKm.

Likewise, in the fourth selection period ($H_{4th}$), the data to be displayed at the pixels located at intersections of X4 and Y1–Ym (LINE4) is accumulated in latch B4, latch B8, . . . , latch B4*m* according to CLK1 through CLKm.

When the data for the four lines (X1 through X4) is accumulated, it is transferred to the data accumulation means in the same way as in the configuration in FIG. 11. Likewise, the buffer operation is repeated for four scanning electrodes over one frame period.

Next, the modified example shown in FIG. 16 will be explained.

Figure 16:
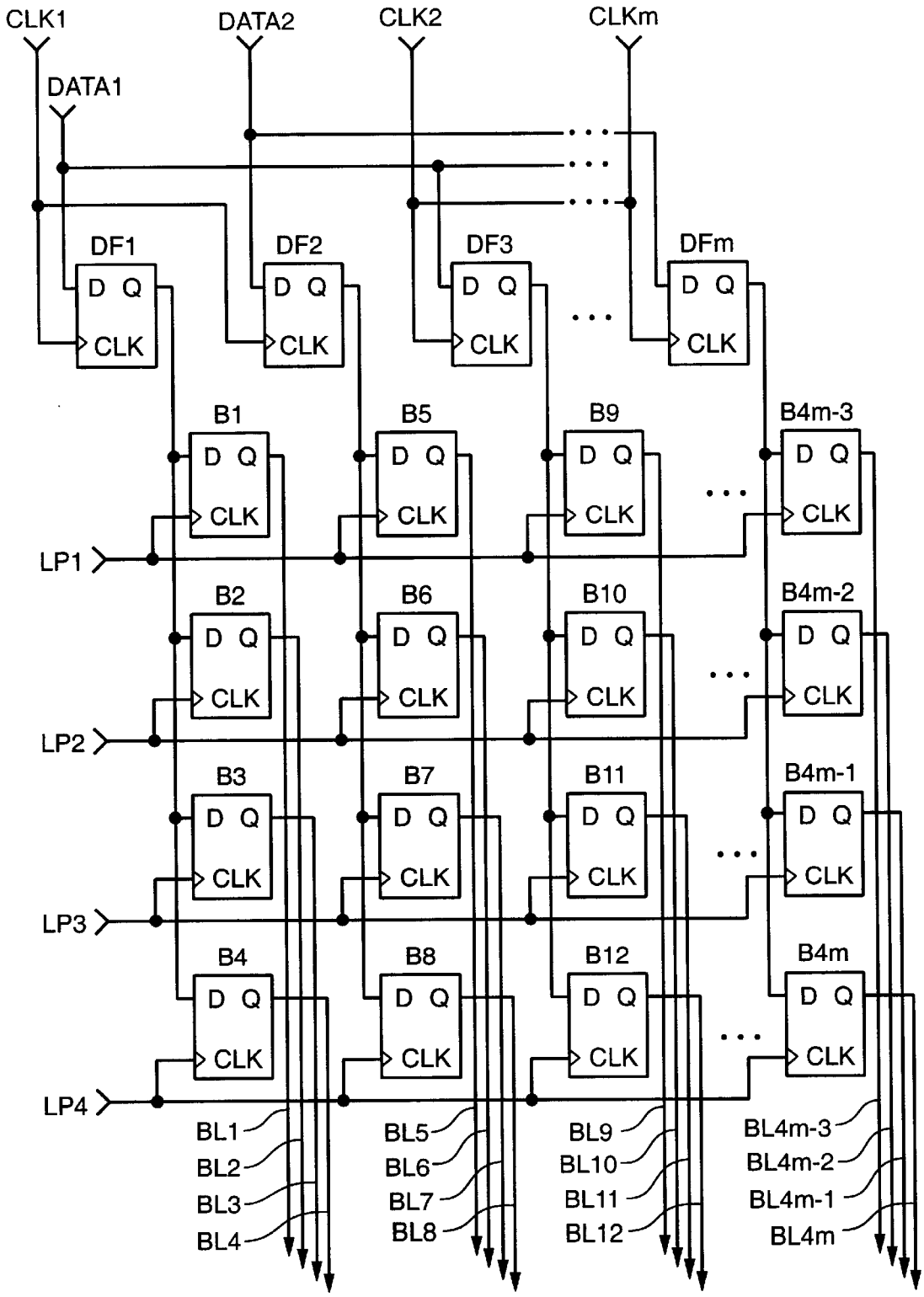
FIG. 16 shows yet another configuration example of part of input buffer circuit 2011 shown in FIG. 8.
Figure 17:
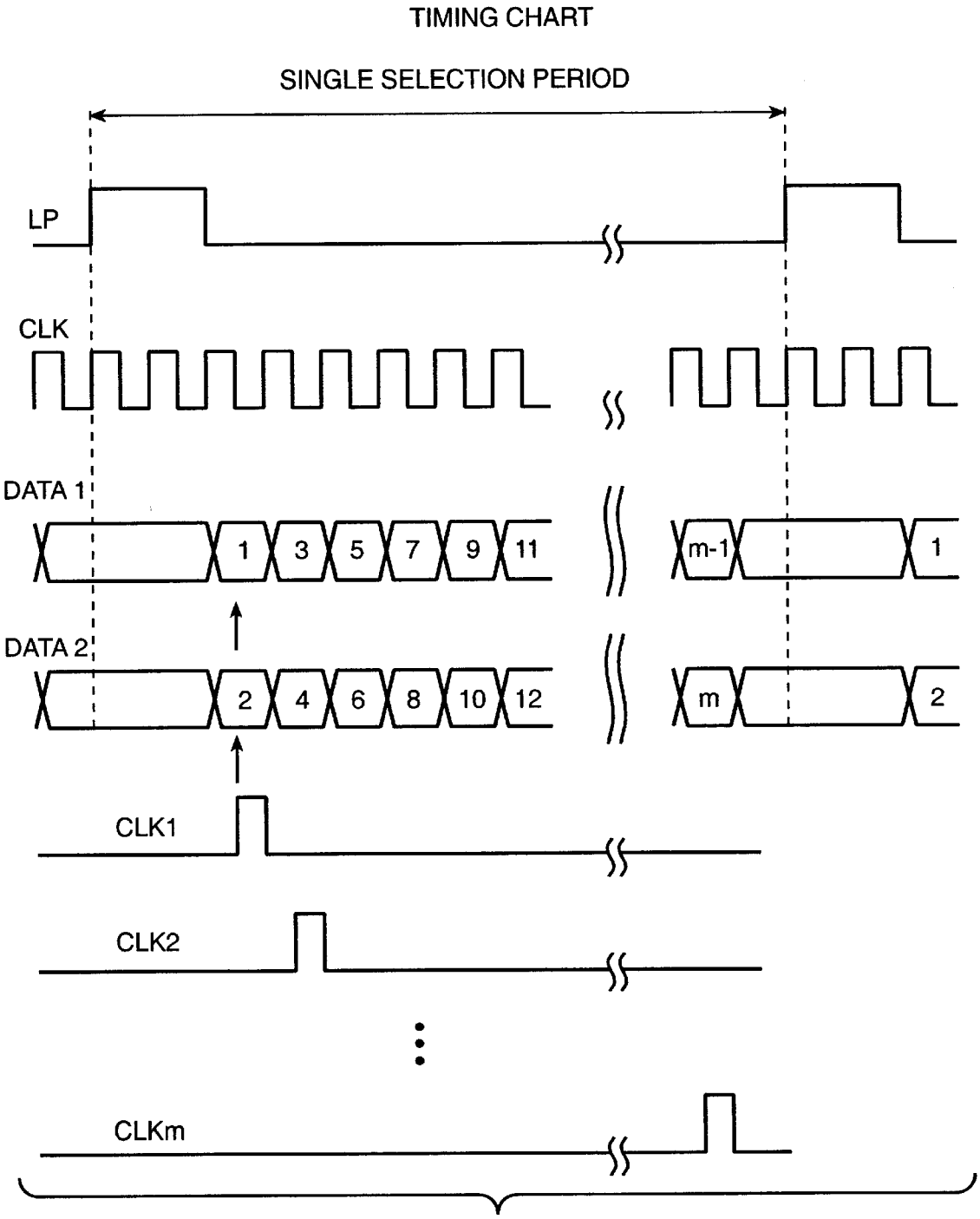
FIG. 17 is a timing chart showing the operation of the circuit shown in FIG. 16.

In the modified example in FIG. 16, data is input in parallel. FIG. 17 is a timing chart showing the data accumulation operation.

In FIG. 16, the clock input pins of flip-flops DF1 and DF2 are connected to the common clock CLK1. The data pin of DF1 is connected to DATA1, and the data pin of DF2 is connected to DATA2. For such two parallel input signals, a single clock is input into two DFFs, and DATA1 is connected to DF (odd numbered) of DFFs, and DATA2 is connected to DF (even numbered) of DFFs. When CLK1 is input as shown in FIG. 12, dot 1 and dot 2 of DATA, i.e., the data to be displayed in the pixel located at the intersection of X1 and Y1 and the data to be displayed in the pixel located at the intersection of X1 and Y2, are accumulated in DF1 and DF2. Likewise, one scanning line's worth of data is accumulated according to CLK1 through CLK(m/2).

When parallel input is used in this way, the number of clocks can be reduced by half (m/2) compared to the configuration in FIG. 11 involving serial input. Therefore, a buffering means with low power consumption can be designed.

Figure 18:
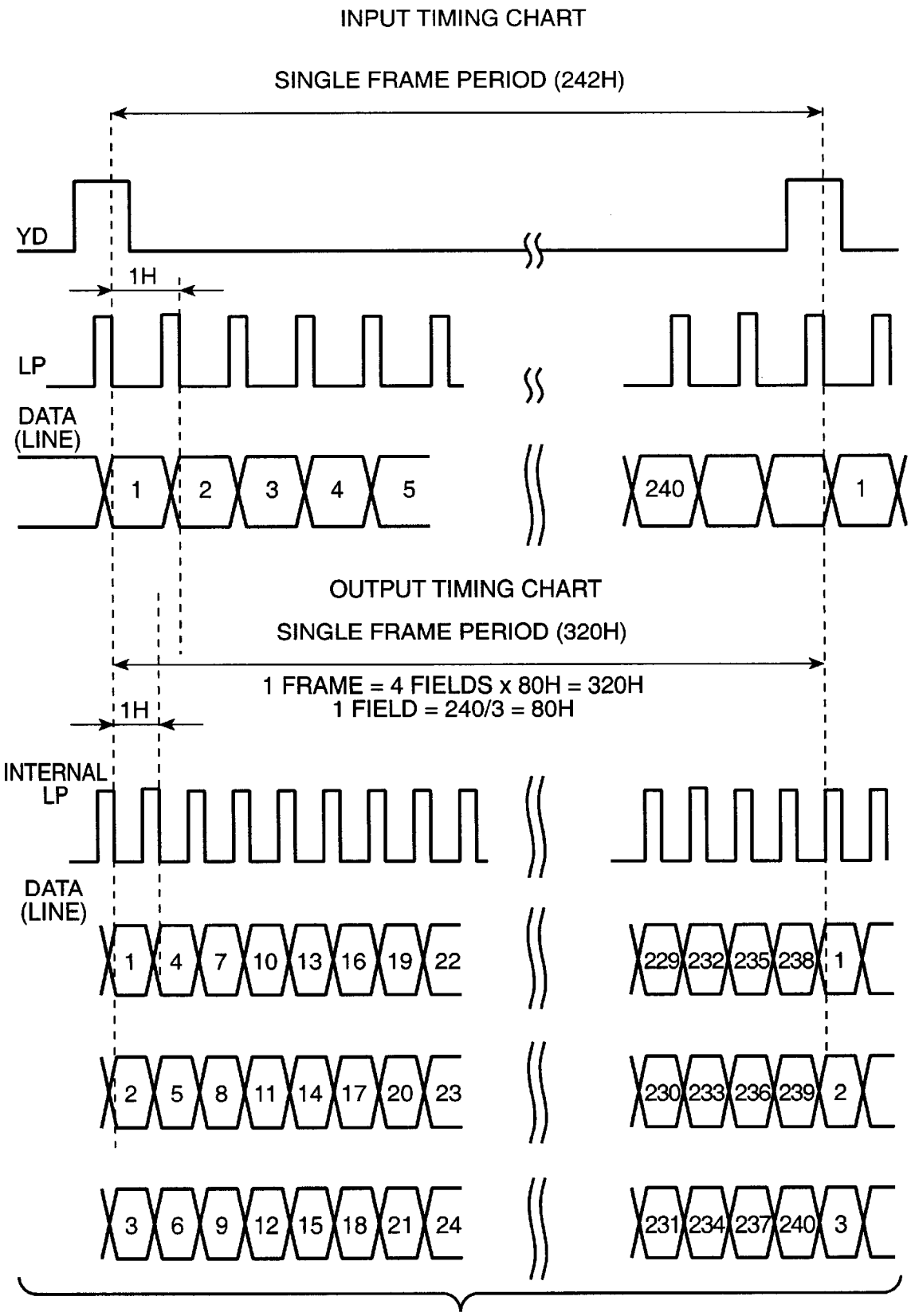
FIG. 18 is a timing chart showing a control example of the display device when three scanning lines are simultaneously selected.

The modified example shown in FIG. 18 is also possible. In the examples explained so far, there were no limitations in the number of lines that can be simultaneously selected. However, the inventors discovered that the ease of control differs significantly depending on the number of scanning lines to be simultaneously selected, when data is transferred between the input buffer circuit and the frame memory. It was determined that ease of control could be optimized by simultaneously selecting $2^k$ lines (where k is a natural number). FIG. 18 is a control timing example when $2^k$ lines are simultaneously selected.

For a specific example, the total scanning line count of n=240 for simultaneous selection of four lines is assumed. In this case, the field count required for maintaining the orthogonality of the scanning pattern is 4. Therefore, one field period becomes 60 (=240/4) selection periods, and one frame period becomes 240 (60×4) selection periods. This is the same as the total scanning line count of n=240, and means that input signals YD and LP from an MPU or an ordinary controller, and CLK of the input signal, shown in FIGS. 2, 3A, and 3B, can be used for controlling the output signals without any modifications.

Next, the total scanning line count of n=240 for simultaneous selection of three lines is assumed. In this case also, four fields are required for maintaining the orthogonality. Therefore, one field period becomes 80 (=240/3) selection periods, and one frame period becomes 320 (80×4) selection periods. Therefore, each frame period is longer than in the case of simultaneous selection of four lines. This is shown in FIG. 18.

Even when the input requires 240 selection periods, if the output requires 320 selection periods, it is necessary to match their frequencies by matching their frame periods in order to prevent frame response, flicker, etc. Consequently, the selection periods during output must be made shorter than the selection periods during input.

Therefore, it is necessary to provide a circuit, such as a VCO (voltage control oscillator) or a PLL (phase-locked loop), inside control circuit 20 to generate an internal clock that is higher than CLK of the input signal, thus eliminating the difference in selection periods.

Furthermore, because the write and read operation timings are not synchronized during data read from the memory, controlling the data input into the data accumulation means becomes complex. To achieve asynchronous write and read operations, simple single-port RAM cannot be used, and dual-port RAM for which writing and reading can be performed independently must be used. However, dual-port RAMs are more expensive and requires a larger area than single-port RAMs. Therefore, when a number of lines (e.g., 3, 5, . . . ) other than 4 must be simultaneously selected, the input signal cannot be used as is for controlling the output, making control circuit 2000 expensive.

However, when $2^k$ (e.g., 2, 8, 16, 32, 64 where k is a natural number) lines are to be simultaneously selected, the input selection period timing can be used as is for output selection period as in the case of simultaneous selection of four lines.

If the response speed of the liquid crystal is slow, intensity changes due to frame response are not severe. However, as the response speed becomes faster, intensity changes due to frame response become more pronounced. Therefore, when using liquid crystals with fast response speed, it is necessary to set the number of lines to be simultaneously selected somewhat large.

However, if 4 to 8 or a slightly larger number of lines are simultaneously selected, intensity changes can be suppressed for all practical purposes. On the other hand, if the number of lines to be simultaneously selected is too large, the amount of data that must be buffered increases, making it difficult to use input signals for controlling output signals.

Therefore, when the degree of intensity change due to frame response, amount of data to be buffered, controllability of output signals by input signals, etc. are considered as a whole, simultaneous selection of 4 or 8 lines results in the best cost-performance.

Next, Embodiment 3 will be explained.

EMBODIMENT 3

(A) Explanation of Mismatch Determination Circuit

As explained in FIG. 55, in a matrix-type display device using a drive method that simultaneously selects multiple scanning lines, the number of mismatches between image data and scanning pattern must be determined in order to determine the voltage to be supplied to the data lines.

Figure 19:
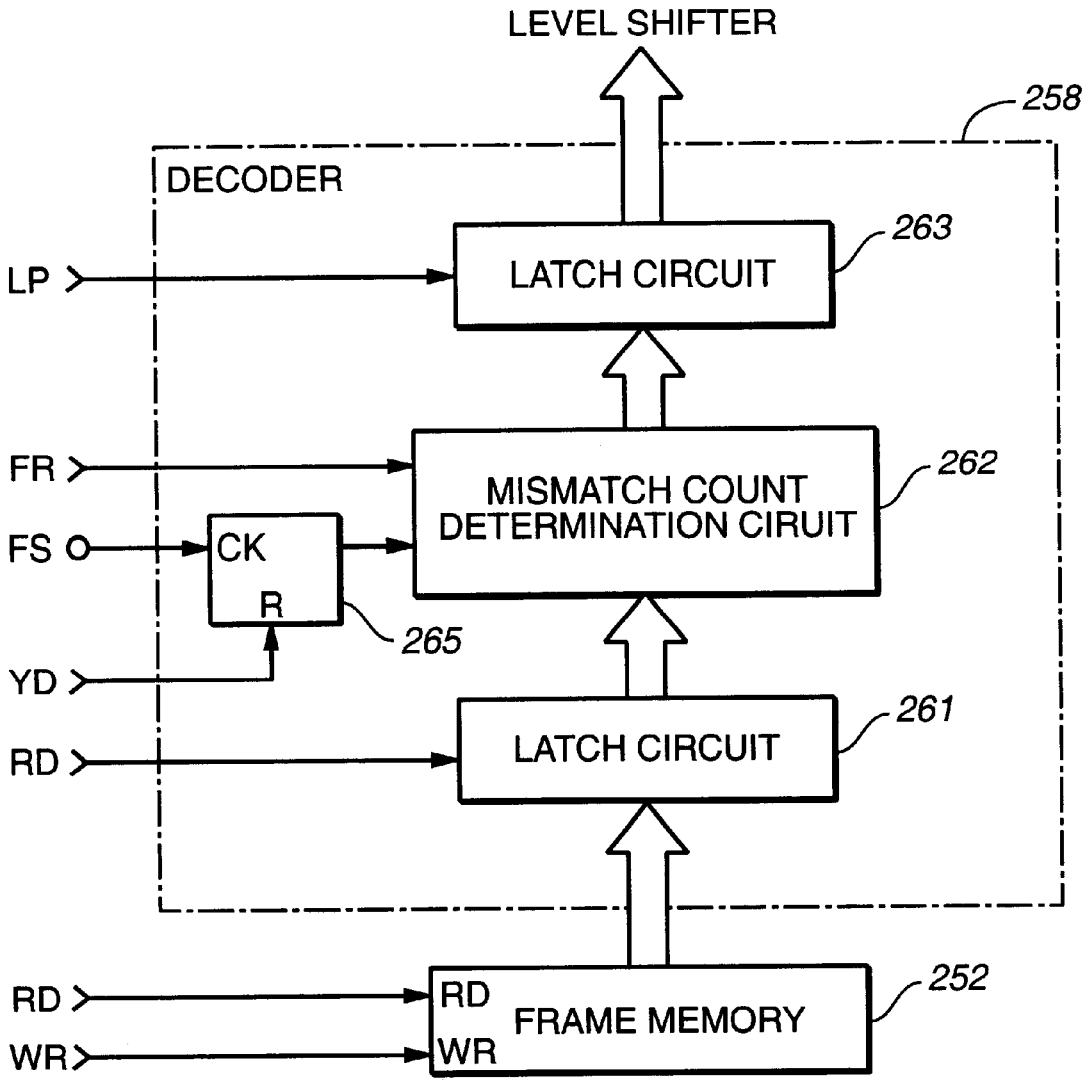
FIG. 19 shows the circuit related to Embodiment 3 of the invention.

The mismatch determination circuit is provided inside decoder 258 shown in FIGS. 1 and 2. FIG. 19 shows the internal configuration of decoder 258.

Decoder 258 possesses latch circuits 261 and 263, mismatch determination circuit 262, status counter 265 which determines the scanning pattern based on signals FS and YD.

Figure 26:
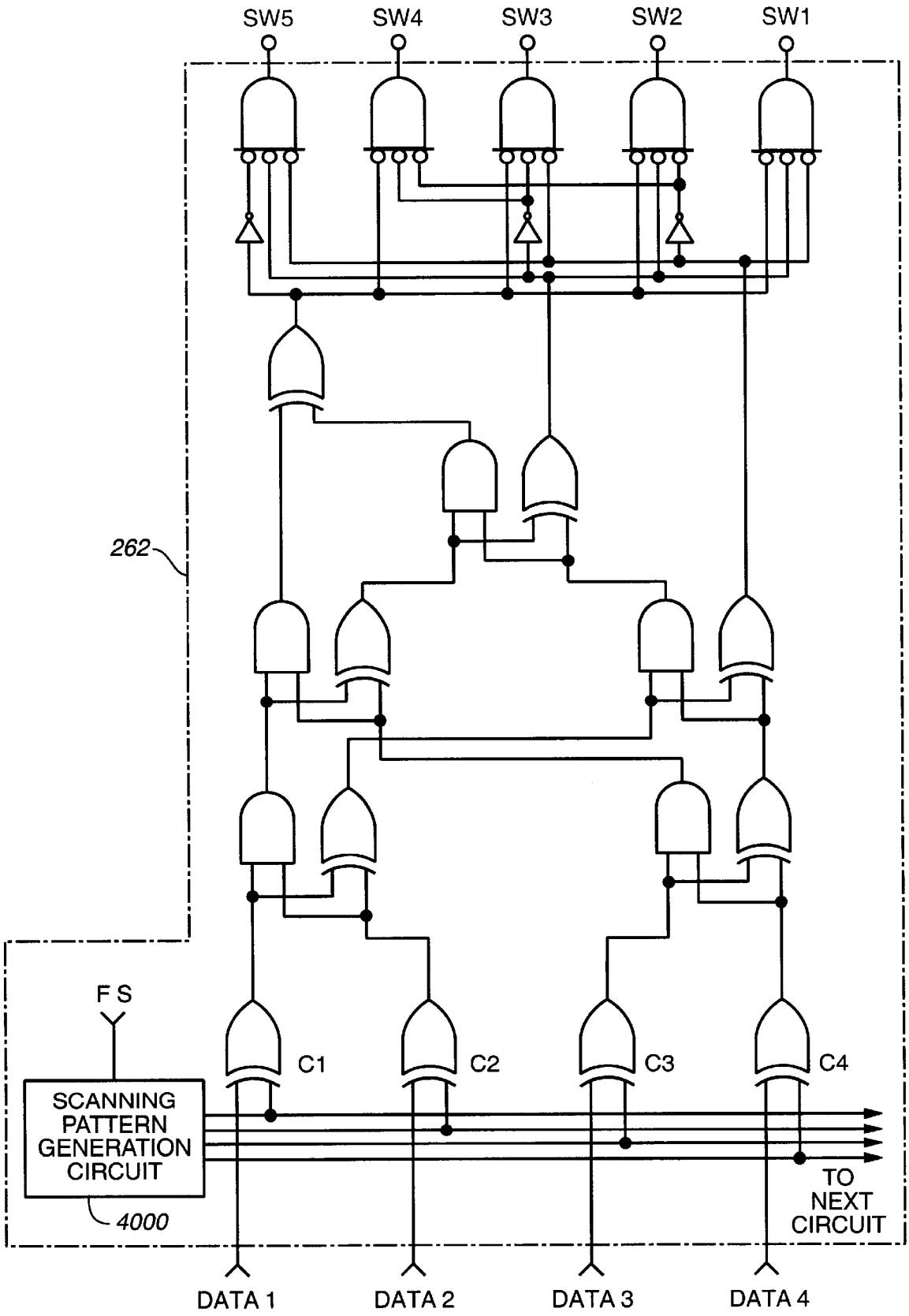
FIG. 26 (PRIOR ART)
FIG. 26 shows the configuration of a conventional decoder.

The evaluation performed by the inventors have made it clear that mismatch determination circuit 262 can be configured using the circuit shown in FIG. 26. The circuit in FIG. 26 is a circuit for performing the calculation for selecting an appropriate potential from among the five levels of data line drive voltage shown on the right side of FIG. 27 (VY1, VY2, VY3, VY4, and VY5). That is, the circuit determines the number of mismatches between the scanning pattern and display pattern, and generates a signal for selecting VY1, VY2, VY3, VY4, or VY5 if the mismatch count is 0, 1, 2, 3, 4, or 5, respectively.

Figures 27, 28A, 28B:
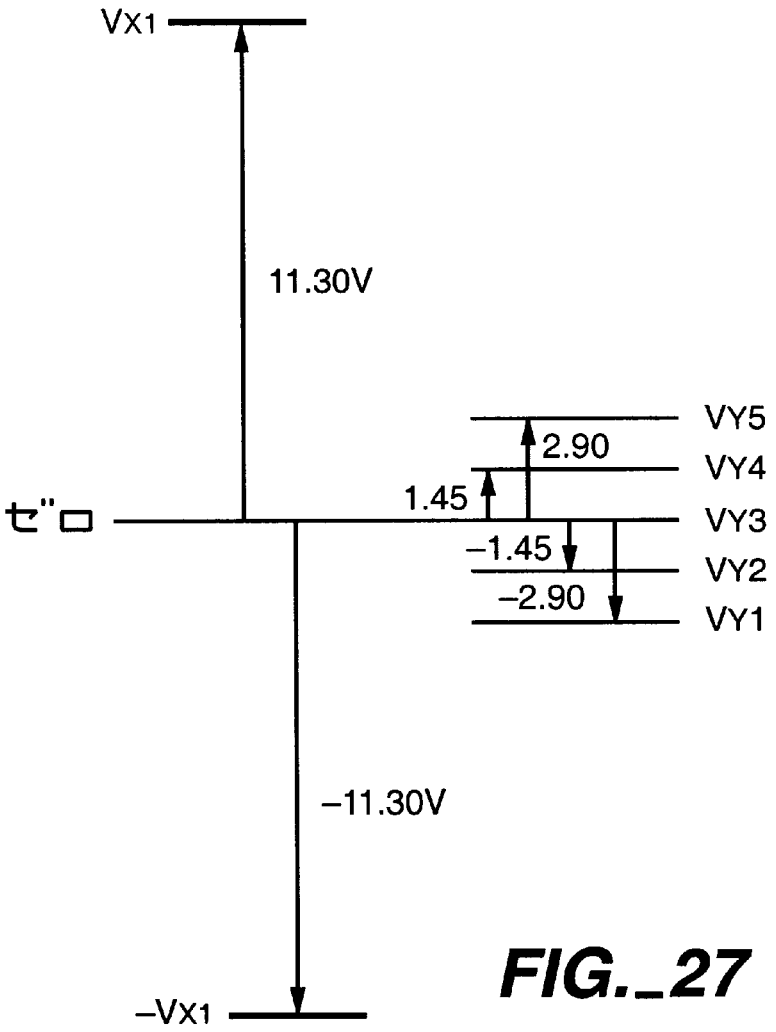
FIG. 27 shows the voltage values used for simultaneously selecting and driving four scanning lines.
FIGS. 28A and 28B show examples of scanning patterns.

There are three levels in the scanning line potential: VX1 (11.30 V), −VX1(−11.30 V), and 0 V. FIGS. 28A and 28B show scanning pattern examples for four lines. As shown in these FIGS., a scanning pattern consists of a 4 by 4 matrix, and a rows indicates the scanning line order and a column indicates the selection order. Mismatch determination circuit 262 selects four lines four times, determines the mismatch count between the display pattern and scanning pattern four times, and determines the data line voltage level.

(B) Problems Identified by the Inventor

The circuit in FIG. 26 determines the mismatch count using exclusive-OR (EX_OR) and adder (ADDER) circuits. That is, the circuit in FIG. 26 comprises four EX_OR gates for detecting the mismatch count, and six EX_OR gates, five AND gates, five tri-input NAND gates, and three inverters used for the ADDER circuit.

However, this configuration has a problem in that it increases the circuit size. For example, as evident from FIG. 26, the wires connecting individual gates are quite complex, and the required ADDER circuits increase the circuit size.

Moreover, as the number of lines to be simultaneously selected increases, the complexity increases. In particular, the size of the ADDER circuit increases roughly in proportion to the second power of the number of scanning lines to be simultaneously selected.

Such an increase in circuit size becomes a particularly serious problem when a configuration (such as that shown in FIG. 2) is used that includes the mismatch determination circuit inside the data line drive circuit.

(C) Characteristics of Embodiment 3

Therefore, in this embodiment, the mismatch determination circuit is configured using read-only memory (ROM).

(D) Specifics of Embodiment 3

The specifics of Embodiment 3 are explained below using a case involving simultaneous selection of four lines.

Figure 20:
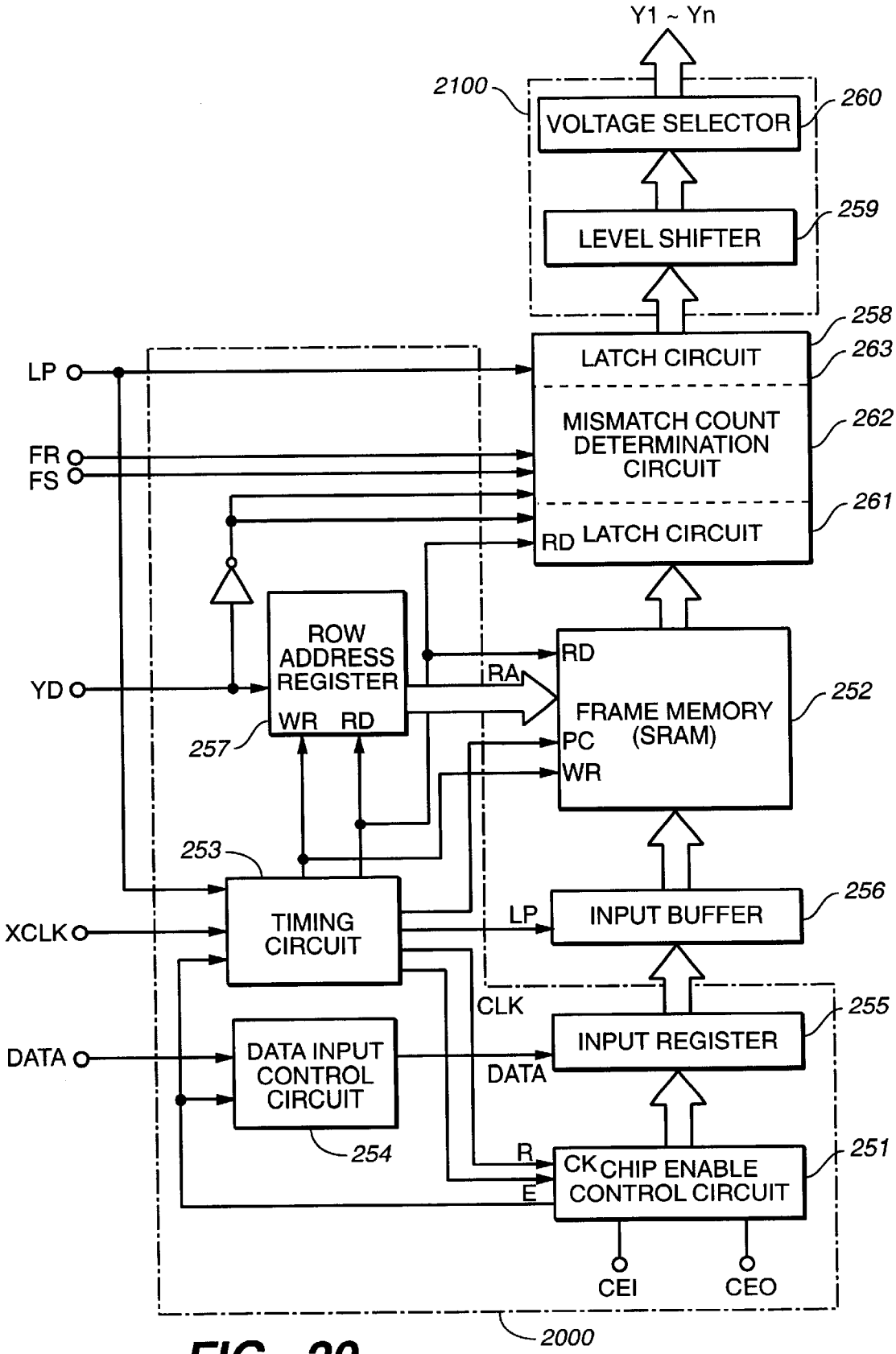
FIG. 20 shows a more specific configuration of the circuit shown in FIG. 19.
Figure 29:
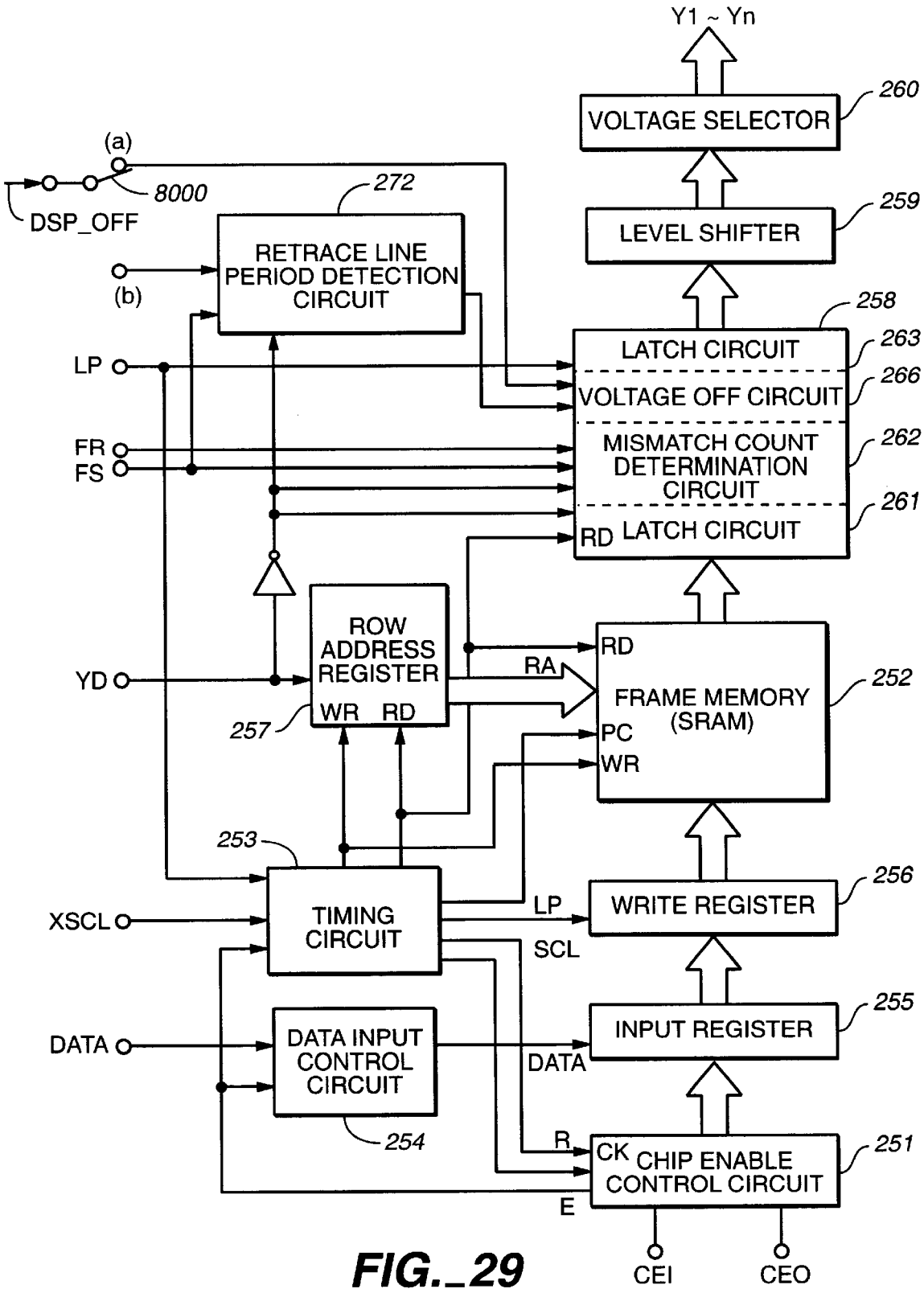
FIG. 29 is a block diagram showing the overall configuration of the data line drive circuit of Embodiment 4 of the invention.

FIG. 20 shows the system configuration. Decoder 258 which includes mismatch determination circuit 262 is positioned between frame memory 252 and level shifter 259, as shown in FIG. 29.

Figure 21:
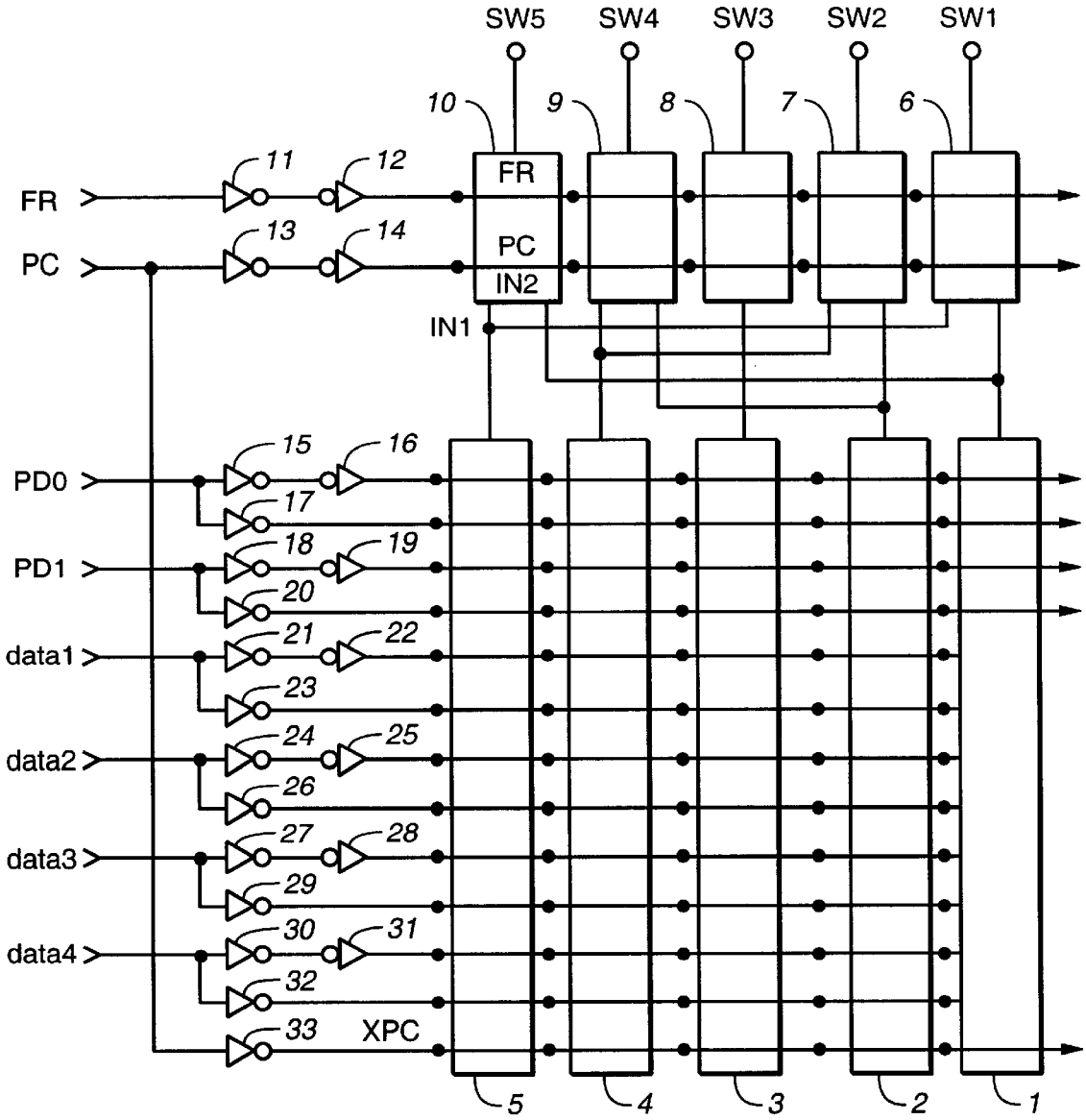
FIG. 21 is a circuit diagram explaining the characteristics (decoders comprising ROMs) of Embodiment 3.

FIG. 21 is a block diagram showing the circuit configuration of the mismatch determination circuit for each output, integrated inside the data line drive circuit. The mismatch determination circuit possesses first ROM circuit 1, second ROM circuit 2, third ROM circuit 3, fourth ROM circuit 4, fifth ROM circuit 5, and precharge (PC) circuits 6–10. PC circuits 6, 7, 9, and 10 have the same configuration, while PC circuit 8 has a slightly different configuration and has only one input/output pin.

The signals to be input into the mismatch determination circuit are pattern recognition signals F1 and F2 for differentiating among the four scanning patterns, data signals data 1 through data 4 read from the frame memory, precharge signal PC, and signal FR for inverting the display between ON and OFF.

Both the normal and inverted signals of these input signals are input into ROM circuits 1–5. However, only the normal signals are input into the FR pin.

Output signals sw1–sw5 of PC circuits 6–10 are connected to the control pins of voltage selector 260 via level shifter 259 of FIG. 20. When one of output signals sw1–sw5 is High, a corresponding voltage level is selected from among voltage levels YV1–VY5 and is applied to the data line.

FIG. 22A–C schematically show ROM circuit 5 of FIG. 21, and circles (+) indicate N-channel transistors (hereafter referred to as "Nch×Tr").

As the correspondence to normally used CMOS transistor symbols in FIGS. 22A and 22B show, the gates are noted as (a, c), the drain is noted as (b), the source is noted as (d), and the substrate is noted as (Vss=GND).

Note that the ROM circuit logic is configured using only Nch×Tr's. Although logic configuration using only P-channel transistors (hereafter referred to as "Pch×Tr") is possible, N-channel transistors are preferred for the following reason. When achieving the same transistor drive level, the mobility of an N-channel transistor is approximately three times that of a P-channel transistor. Consequently, when creating transistors of the same capacity, one using N-channel transistors can be made ⅓ the size of that using P-channel transistors.

In FIGS. 22A–22C, the Nch×Tr driven by the XPC signal (inverted signal of PC) prevents Vdd (5 V) and Vss (GND) potentials from shorting during precharge.

Next, a process is explained in which the output signal is generated through decode calculation based on the input signal.

The output lines (vertical lines) of the mismatch determination circuit are High because of the precharge (PC signal). When all Nch×Tr's serially connected to a single vertical line are turned on by the input signal entered from an input line (horizontal line), the potential of the vertical line becomes Vss and the output changes to Low.

Let's assume that the pattern shown in FIG. 28A is used as the scanning pattern, for example.

If XPC is High and data 1–data 4 are all High, all Nch×Tr's on the first column of ROM 5 circuit are turned ON, become connected to Vss, and output Low. Other columns contain some Nch×Tr's that are not turned on, do not become connected to Vss, and thus remain High.

In this way, output can be selected by the placement of Nch×Tr's. That is, by placing Nch×Tr's in the desired locations, it is possible to decode input signals and convert them into selection voltage data.

Note that ROM circuit 5 is used only when the mismatch count between the scanning pattern and the display data is 4, i.e., all different. Therefore, even when four different scanning patterns are to be applied, the total output count is only four. As such, a four-column configuration is sufficient for ROM circuit 5.

Likewise, the configuration of other ROM circuits are determined based on the number of outputs. For example, ROM circuit 1, ROM circuit 2, ROM circuit 3, and ROM circuit 4 need only 4, 9, 16, and 9 columns, respectively.

If the scanning voltage pattern is changed from the one in FIG. 28A to that in FIG. 28B, the placement of Nch×Tr's can be changed accordingly. Such a placement change can be easily accomplished by changing the masks for ROM manufacturing.

Figure 23:
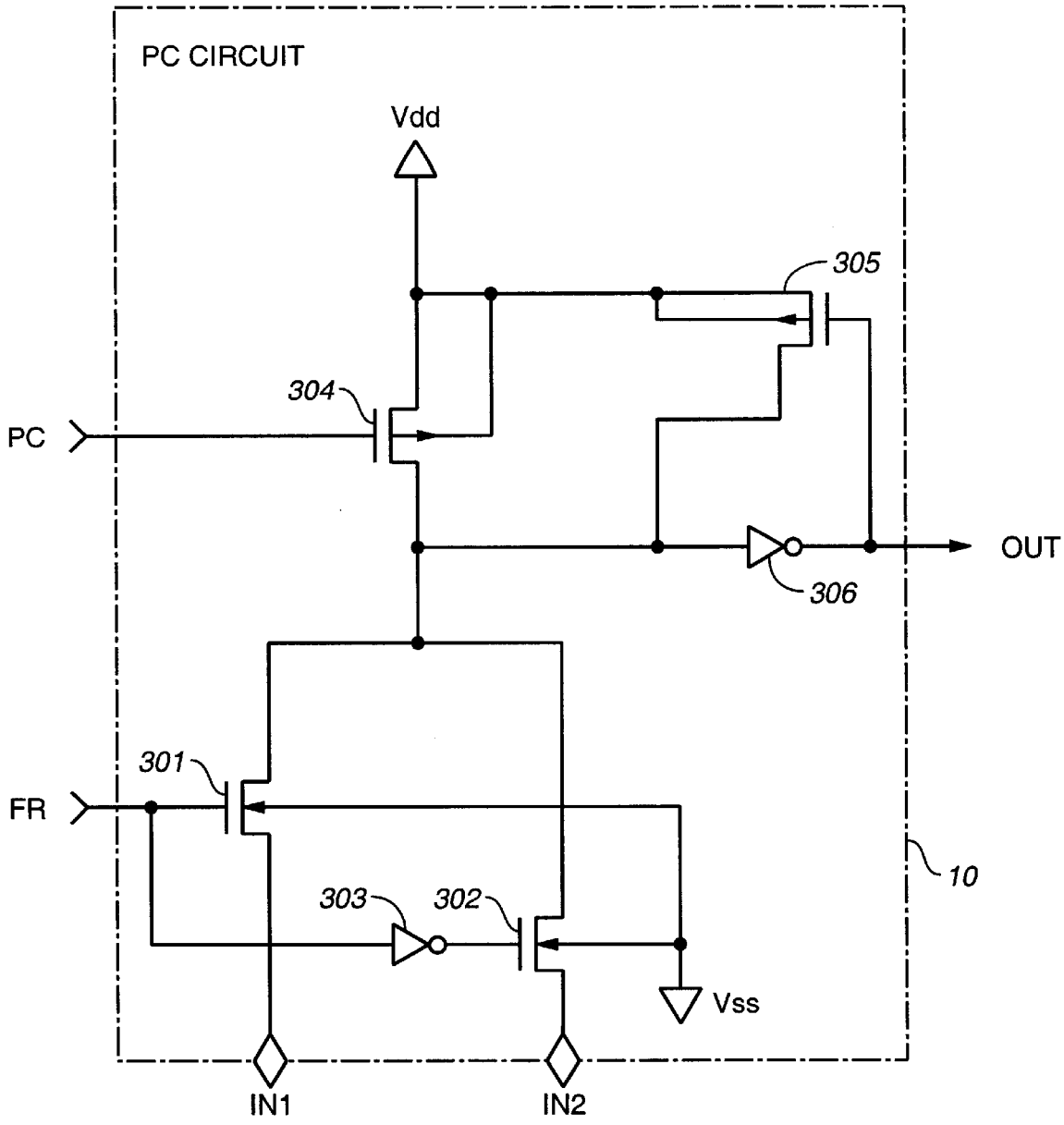
FIG. 23 is a circuit diagram showing a circuit configuration example of precharge circuit 10 shown in FIG. 21.

FIG. 23 is a diagram showing the internal circuit configuration of PC circuit 10 shown in FIG. 21. In this configuration, inverter 303 and two Nch×Tr's 301 and 302 connected to signal FR can be used for selecting input/output pins IN1 and IN2.

When signal FR is High, the signal being input into pin IN1 is selected, and when signal FR is Low, the signal being input into pin IN2 is selected.

Pch×Tr 304 receives signal PC and precharges the ROM circuit connected to either pin IN1 or IN2.

Pch×Tr 305 and inverter 306 are provided for output. Pch×Tr 305 is used for stabilizing the output.

Since PC circuit 8 in FIG. 21 need to select only voltage level VY3 (e.g., ground), it need not select an input signal based on signal FR. Consequently, PC circuit 8 does not have Nch×Tr's 301 and 302 for input selection, and is directly connected to the source of Pch×Tr 304 to be precharged.

Figure 24:
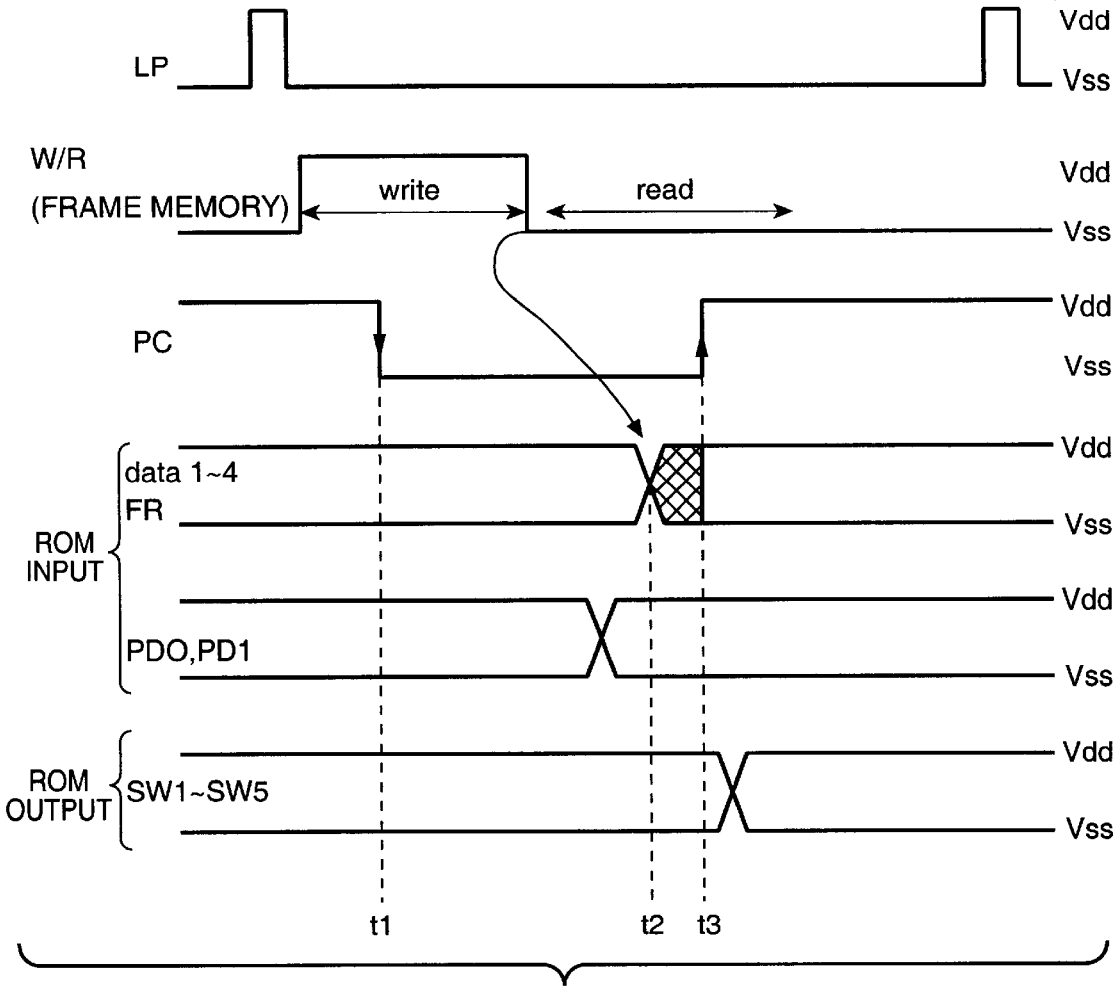
FIG. 24 is a timing chart showing the operation of the ROM shown in FIG. 21.

FIG. 24 is a timing chart for explaining the operation of the mismatch count determination circuit. This FIG. shows the relationship among input signals data 1–data 4, pattern recognition signals PD0 and PD1, single selection period signal LP, precharge signal PC, inverted FR signal, W/R (Write when FR is High, and Read when FR is Low) signals of frame memory.

The operation of the circuit will be explained with references to FIGS. 21–24.

In the explanation, the LP signal (single selection period) is used as the reference. After LP falls and following the write period in which data is written into the frame memory, there is a read period in which the data for the lines to be simultaneously selected is read from the frame memory. Output data 1–data 4, signal FR, PD0, and PD1 are confirmed during this read period. To delete and reset the data before the confirmation, PC (precharge) signal goes Low during the period between pre-confirmation and post-confirmation. Based on this PC signal, the Pch×Tr's inside PC circuits 6–10 go on, and Nch×Tr's inside ROM circuits 1–5 are precharged and pulled up to the high (Vdd) level. Afterwards, data 1–data 4, and pattern recognition signals PD0 and PD1 are decoded by ROM 1–5, and as a result, the signals (sw1–sw5) for selecting the voltage levels to be applied to the data lines are determined.

A conventional ROM requires a Pch×Tr for precharge for each Nch×Tr column. However, in the ROM circuit used in the mismatch count determination circuit, the outputs of all columns never change at the same time as explained in FIG. 22. Therefore, only one Pch×Tr for precharge is required for each ROM circuit. In other words, sufficient precharging can be achieved if one Pch×Tr is provided in the single PC circuit provided in each ROM circuit. Therefore, only Pch×Tr is provided inside the PC circuit in the present invention. The invention further reduces the number of Pch transistors which have larger areas than Nch transistors, achieving a smaller circuit size.

In this way, by configuring the ROM circuit using only Nch×Tr's and further reducing their number depending on the output count, and by using only one Pch×Tr for precharge in the PC circuit, it has been confirmed that the circuit area can be reduced to 40% of a circuit with conventional gate configuration.

Although the above explanation involved simultaneous selection of four lines, the number of rows and columns inside the ROM circuit can be increased or decreased accordingly if the number of lines to be simultaneously selected increases or decreases. If the number of lines to be simultaneously selected is four or more, the number of scanning pattern recognition signals (PD0, PD1) will be significantly smaller than the number of lines to be selected simultaneously. For example, if 32 lines are to be simultaneously selected, the number of required scanning pattern recognition signals is only five, whereas 32 lines would be required in a conventional case. This reduces the wiring requirement.

Next, a modified example of Embodiment 3 will be explained with reference to FIG. 25.

Figure 25:
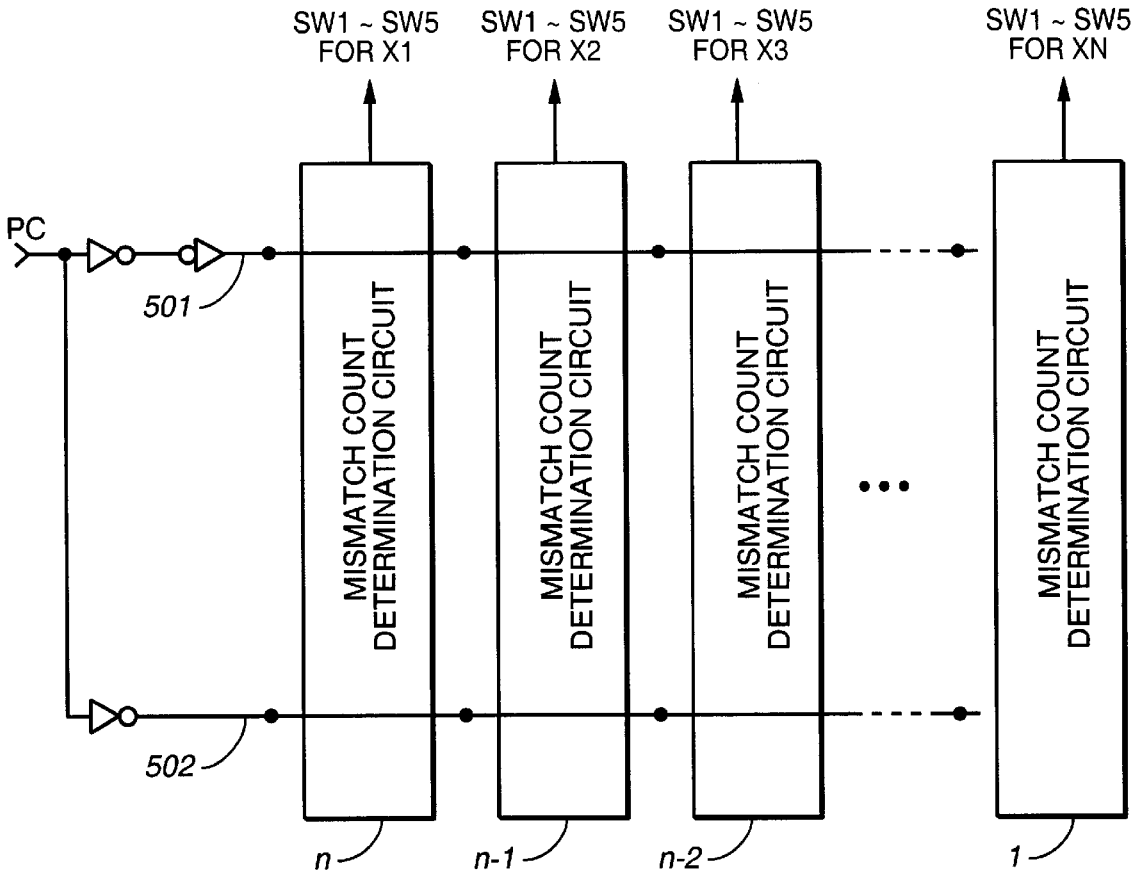
FIG. 25 shows the characteristics of the transmission line of the precharge (PC) signal of the ROM shown in FIG. 21.

The modified example in FIG. 25 reduces power consumption by using a delay line (polysilicon line) to transmit the precharge (PC) signal inside the mismatch count determination circuit shown in FIG. 21.

PC signal in FIG. 21 turns on the Pch×Tr and charges up the drains of the Nch×Tr's. The data line drive circuit with integrated RAM possesses a number of mismatch count determination circuits equaling the number of outputs for driving the data lines. Therefore, Nch×Tr's equaling the number of outputs are precharged all at once, allowing a high level of current to flow. However, by using delay lines for the data lines which transmit this precharge signal to all mismatch count determination circuits, it is possible to prevent simultaneous charge-up and to average out the current flow over the delay time, thus preventing a rush current and realizing a data line drive circuit with smaller power consumption.

In other words, as shown in FIG. 25, low power consumption can be achieved by using polysilicon to form signal lines 501 and 502 for the precharge signals. Furthermore, the rush current can be averaged out by using delay lines for the precharge wiring, achieving mismatch count determination circuits with low power consumption.

Next, Embodiment 4 will be explained.

EMBODIMENT 4

(A) Characteristics of Embodiment 4

This embodiment is characterized in that the data line drive circuit is internally provided with a voltage OFF circuit that uses an external input to make all voltage levels to be output to the data lines identical.

This embodiment is further characterized in that the data line drive circuit is internally provided with a retrace line period detection circuit, and the retrace line period signal from the retrace line period detection circuit or an external input is used to make all voltage levels to be output to the data lines identical.

(B) Problems Identified by the Inventors

Even when the liquid crystal display device is in the active state, some of the periods are not required for display in some cases.

Examples include the period that corresponds to the retrace line period of a CRT, the period between one frame period and the next, the period between one field period and the next, and the period for interfacing with a touch sensor. These periods will be referred to as "blank periods." They may also be summarily referred to as "retrace line periods" if appropriate.

If the above-mentioned decoder 258 is left to run normally during this retrace line period (blank period), various kinds of voltage will be applied to the liquid crystals of the display panel, causing crosstalk, etc., which adversely affect the display.

Specific explanations are provided below.

Normally, the number of liquid crystal drive signals sent from a controller, etc. during one frame of selection period signal LP is larger than the number of selection periods in which actual display is performed, as shown in FIG. 40. The figure shows the multi-line drive in which four lines are simultaneously selected in a display panel possessing 240 scanning lines, as an example. To run a display device possessing 240 scanning lines with simultaneous selection of four lines, a single full-screen scan is completed in 240/4=60 selection periods. This is treated as a single field. To display the pixels of all four lines independently, at least four fields are required. Therefore, display will require 60×4 fields=240 selection periods.

However, as shown in FIG. 40, the number of selection periods per frame period is 245, which is more than the 240 selection periods required for display.

The reason for this difference is as follows. In order to maintain compatibility in display control with other types of display devices, such as CRTs, extra selection periods are added that correspond to the period (retrace line period) required for CRT scanning to return to the initial scan line after completing a scan.

Furthermore, during display control, the need for adjusting the input/output of display data with the CPU which generates the display data sometimes increases the number of selection periods. The above-mentioned retrace line period is not necessary for display, and the voltage applied to the liquid crystals of the display panel during this period adversely affects the display.

In conventional MPX drive, if the potential of the scanning line during the retrace line period is in the non-selection state, i.e., zero potential, the effective voltage applied to the liquid crystal is the same, regardless of whether the data line is at VMY1 or VMY2 potential, resulting in lower contrast (ON/OFF voltage ratio). However, the display is not greatly affected by the selection potential.

On the other hand, in multi-line drive, both the selection potential of the data line and the number of potentials to be selected are larger than those in MPX drive. That is, if the number of scanning lines to be simultaneously selected is h (an integer), h+1 voltage levels are required for the data line side. Consequently, display differs greatly depending on the potential selected by the data line during the retrace line period.

For example, if a selection potential different from that being applied to the adjacent data line is applied to a data line, there appears to be crosstalk. The inventors have discovered that, unlike in conventional MPX drive, if the above condition occurs in even a small number of periods (5H) out of all periods (245H), clearly adverse effects are observed in the display and appear as crosstalk.

In other words, in conventional MPX drive, if the potential of the scanning line during the retrace line period is in the non-selection state, i.e., zero potential, the effective voltage applied to the liquid crystal is the same, regardless of whether the data line is at VMY1 or VMY2 potential, as shown in FIG. 39A. Consequently, although the resulting contrast is low, the display is not greatly affected by the selection potential.

On the other hand, in multi-line drive, both the absolute value of the selection potential of the data line and the number of potentials to be selected are large, as shown in FIG. 39B. Consequently, the display differs greatly depending on the potential selected by the data line during the retrace line period.

For example, if a selection potential different from that being applied to the adjacent data line is applied to a data line, there appears to be crosstalk. It has become clear that, unlike in conventional MPX drive, if the above condition occurs in even a small number of periods (5H) out of all periods (245H), clearly adverse effects are observed in the display and appear as crosstalk.

(C) Characteristics of Embodiment 4

FIG. 29 shows the overall configuration of the data line drive circuit of this embodiment.

The main characteristic of the configuration in FIG. 29 is that the display OFF (DSP_OFF) signal is input into decoder 258 to stabilize the voltage to be applied to the data line during the retrace line period. In order to stabilize the voltage to be applied to the data line, voltage OFF circuit 266 is provided inside decoder 258.

First, a case will be explained in which the display OFF (DSP_OFF) signal is directly input into voltage OFF circuit 266 without going through the retrace line period detection circuit. In this case, switch 8000 in FIG. 29 is switched to side (a). Module controller 2340 shown in FIG. 2 generates the display OFF (DSP_OFF) signal, which is then directly input into voltage OFF circuit 266.

The configuration of the voltage OFF circuit is explained below.

Figure 30A:
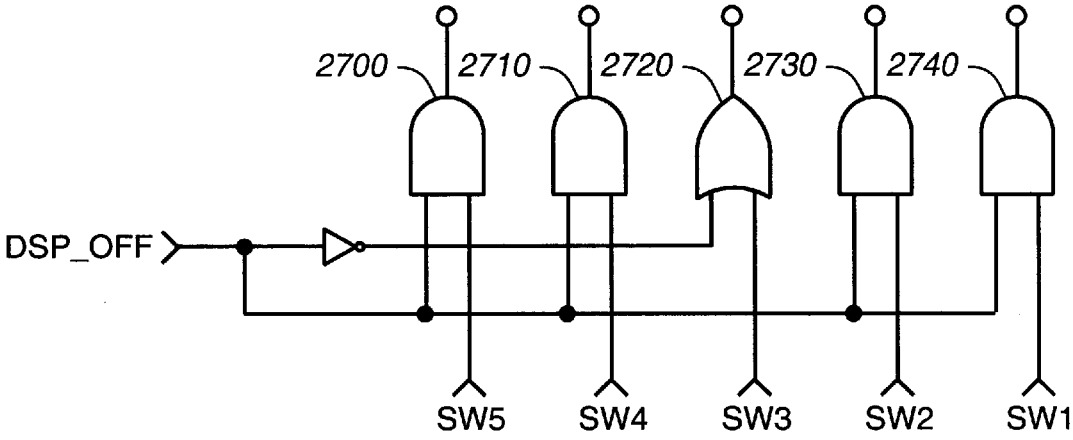
FIG. 30A shows a configuration example of a voltage OFF circuit.
Figure 30B:
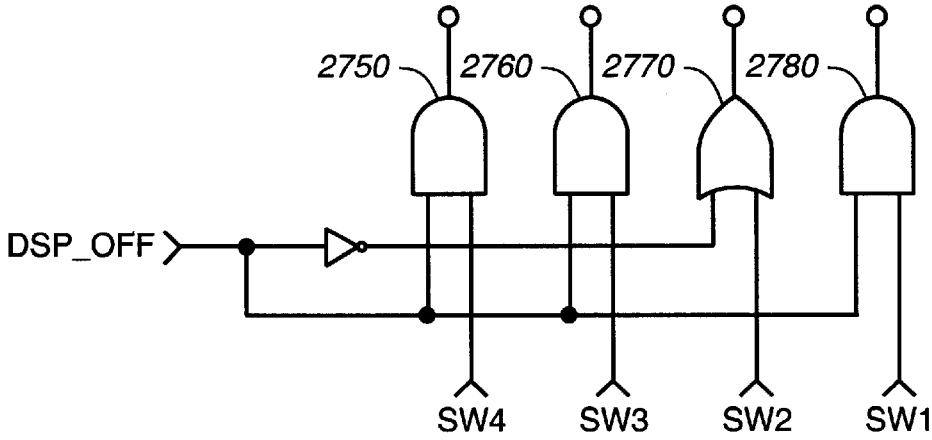
FIG. 30B shows another configuration example of a voltage OFF circuit.

FIGS. 30A and 30B show examples of the voltage OFF circuit configuration for a single output. In other words, if 160 outputs are required, 160 circuits will be arranged in parallel in FIGS. 30A and 30B.

FIGS. 30A and 30B show voltage OFF circuits when four or three lines, respectively, are simultaneously selected.

As shown in FIG. 30A, when four lines are to be simultaneously selected, signals sw1–sw5 for selecting five levels of potentials (VY1–VY5) are output by the mismatch count determination circuit and are input into the voltage OFF circuit. That is, sw1, sw2, sw4, and sw5 are input into AND gates 2700, 2710, 2730, and 2740, respectively, sw3 is input into OR gate 2720.

Meanwhile, external signal DSP_OFF is commonly input into AND gates 2700, 2710, 2730, and 2740. The inverted DSP_OFF signal is input into OR gate 2720.

In other words, if the DSP_OFF signal is High, signals sw1–sw5 are output as High. However, if the DSP_OFF signal is Low, only signal sw3 goes High. Therefore, when the DSP_OFF signal is set Low, the voltage selector connected to sw3 which goes High applies VY3 (see FIG. 39B) to the data line.

In the case of simultaneous selection of four lines, V×3 which is the same as the zero potential in the non-selection level in the scanning line, is applied to the data line during the retrace line period, and thus no voltage is applied to the liquid crystals, preventing crosstalk.

In the case of simultaneous selection of an even number of lines, such as four lines, the potential of the non-selection level on the scanning line side can also be selected on the data line side, and it is desirable that the data line select this potential during the retrace line period. However, in the case of simultaneous selection of an odd number of lines, such as three, five, or seven, the potential of the non-selection level on the scanning line side is not available as a voltage level for a normal data line. In such a case, the following two methods are available:

1) The non-selection level on the scanning side is input into the data line drive circuit, and the data line selects the non-selection level during the retrace line period.

2) The data line selects a potential level that is closest to the non-selection level on the scanning side during the retrace line period.

To implement method 1) for simultaneous selection of three lines, set signal sw3 (selection signal that corresponds to VY3) of the four line selection circuit shown in FIG. 30A to High, change the data line drive potentials VY1 and VY2 to the voltage used for three lines, and change VY4 and VY5 to the VY3 and VY4 for three lines.

On the other hand, to implement method 2), the circuit diagram in FIG. 30B is used. This circuit selects VY2 from the four voltage levels (VY1, VY2, VY3, and VY4) during the retrace line period.

As demonstrated above, it is possible to eliminate crosstalk even when simultaneously selecting an odd number of lines.

Next, a case will be explained in which the display OFF (DSP_OFF) signal is input into voltage OFF circuit 266 via retrace line period detection circuit 272 in FIG. 29.

In this case, switch 8000 in FIG. 29 is switched to side (b), and the display OFF (DSP_OFF) signal is input into retrace line period detection circuit 272.

Figure 31:
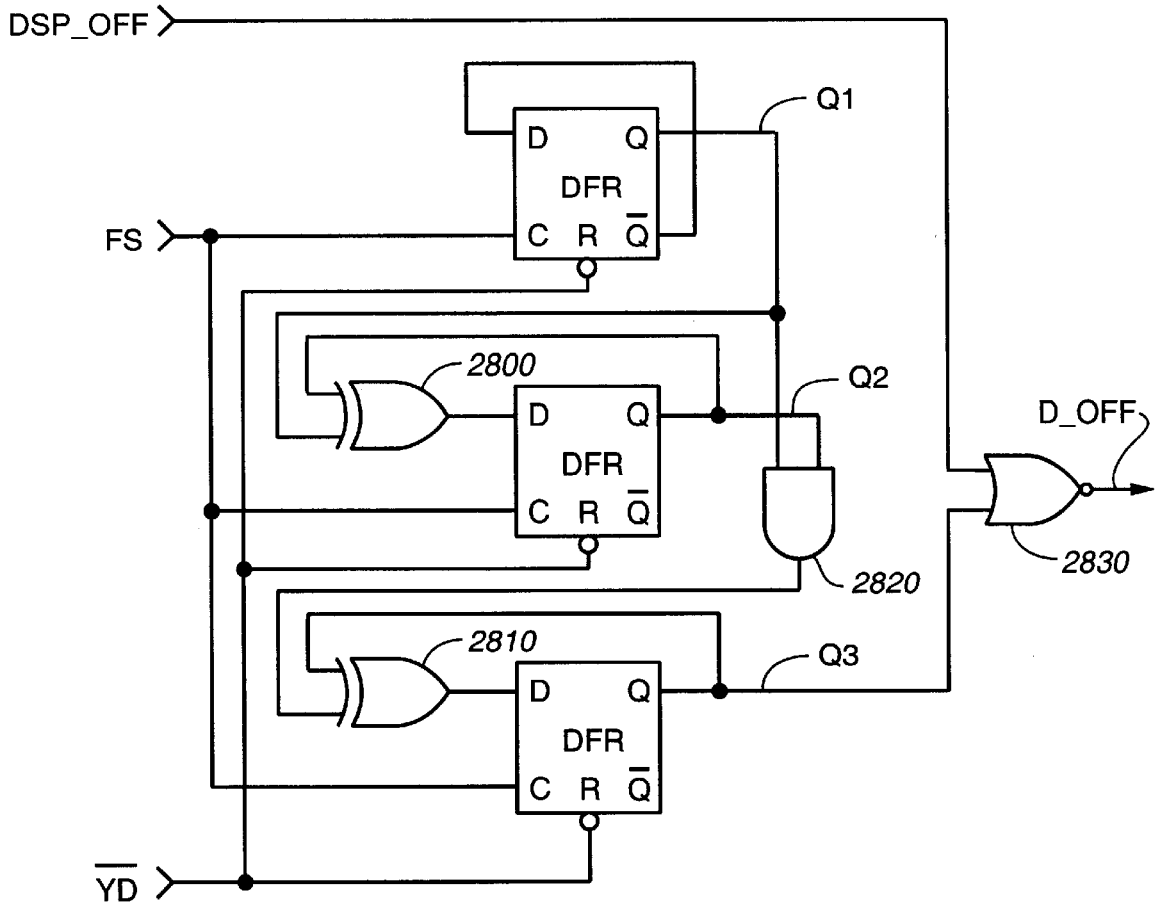
FIG. 31 shows a configuration example of a retrace line period detection circuit.

As shown in FIG. 31, frame signal YD, field signal FS, and the external input DSP_OFF signal are input into retrace line period detection circuit 272. Retrace line period detection circuit 272 possesses a function to generate a signal that is equivalent to the DSP_OFF signal on its own, even when the external input DSP_OFF signal is not present.

Figure 32:
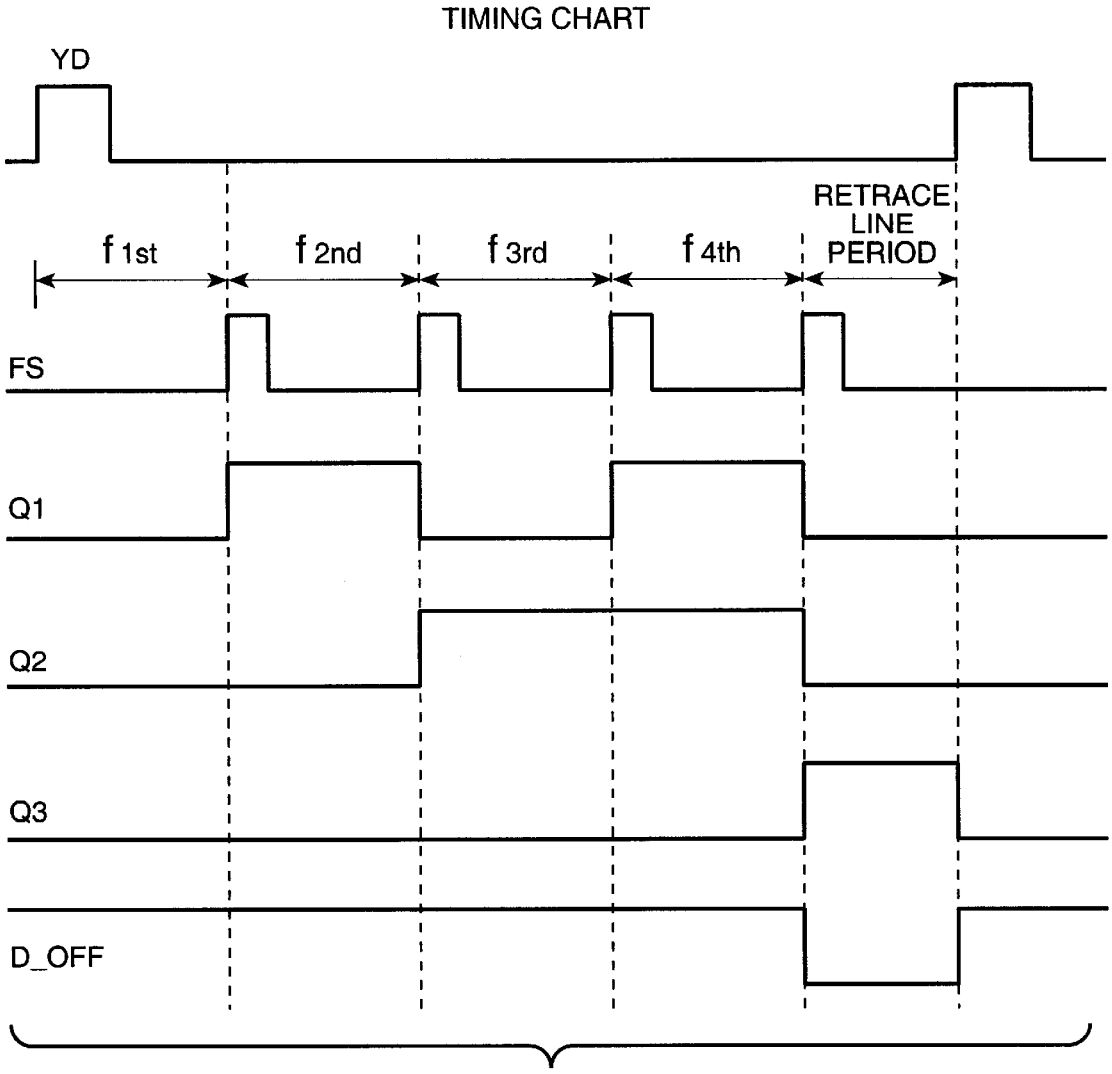
FIG. 32 is a timing chart showing the operation of the circuit shown in FIG. 31.

FIG. 31 shows a circuit configuration example of retrace line period detection circuit 272, and FIG. 32 is a timing chart showing its operation.

Retrace line period detection circuit 272 is a 3-bit counter that counts FS signals and is reset by YD. In simultaneous selection of four lines, four fields are required for display.

Since individual fields are separated by FS signals, the period in which output Q3 of the last three bits of the counter goes High becomes the retrace line period. By obtaining the NOR result of counter output Q3 and external input DSP_OFF, a data line drive circuit can be provided that can accept external input and for which the retrace line period need not be generated using an external device such as a controller.

When using retrace line period detection circuit 272 of FIG. 31, select VY3 as the data line drive voltage when NOR gate 2830 is High.

Since retrace line period detection circuit 272 is active if YD, FS, and DSP_OFF signals are input, it can be applied to the type of data line drive circuits into which data is serially input from outside, as well as to data line drive circuits that contain RAM.

Next, a modified example of Embodiment 4 will be explained.

Figure 33:
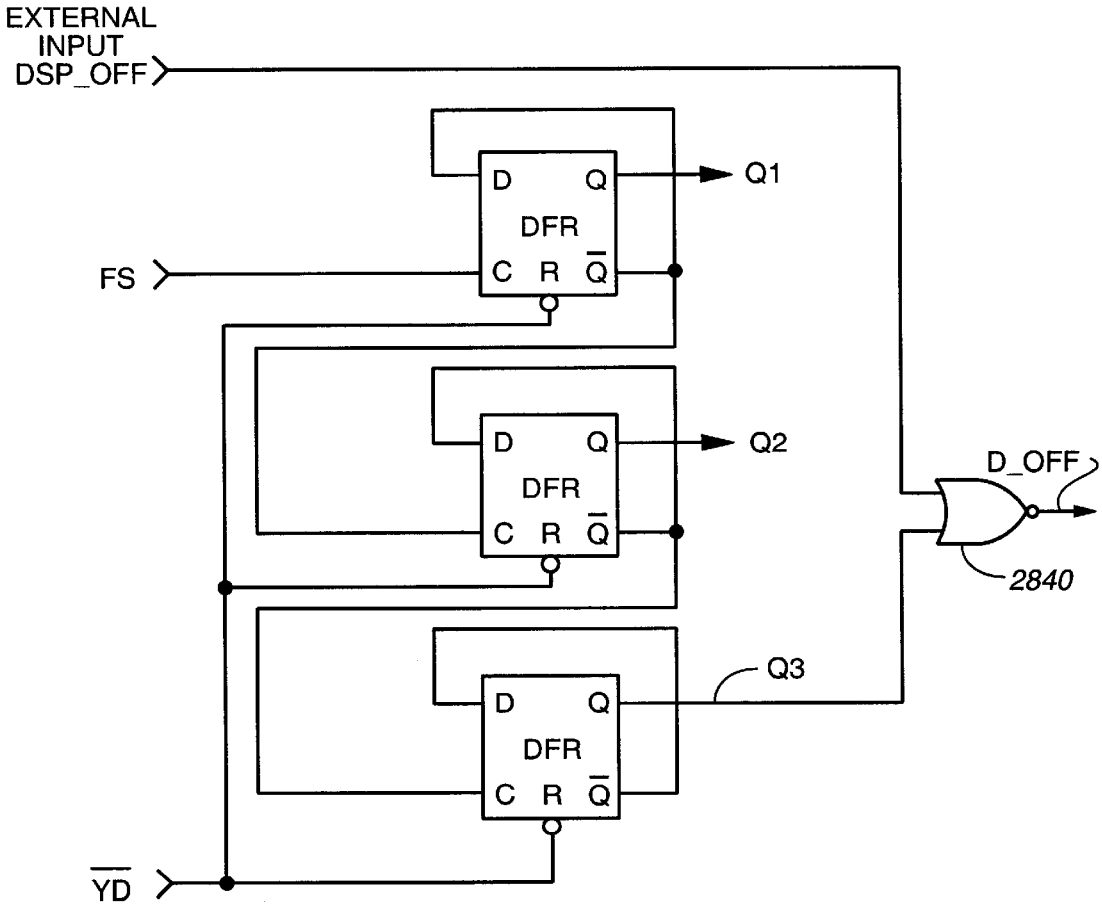
FIG. 33 is a block diagram showing another configuration example of a retrace line period detection circuit.

FIG. 33 is a diagram showing another configuration example of retrace line period detection circuit 272, which is smaller in this case.

In the configuration in FIG. 33, retrace line period detection circuit 272 consists of three D-type flip-flops with reset (DFR).

Figure 35:
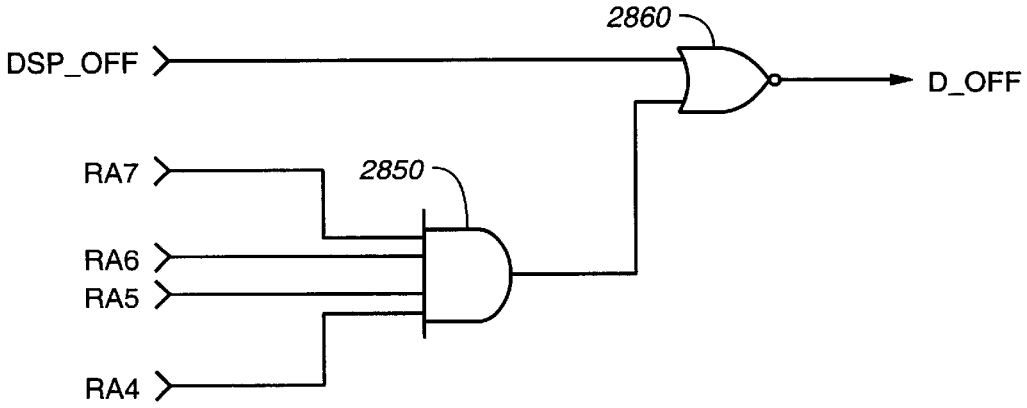
Figure 34:
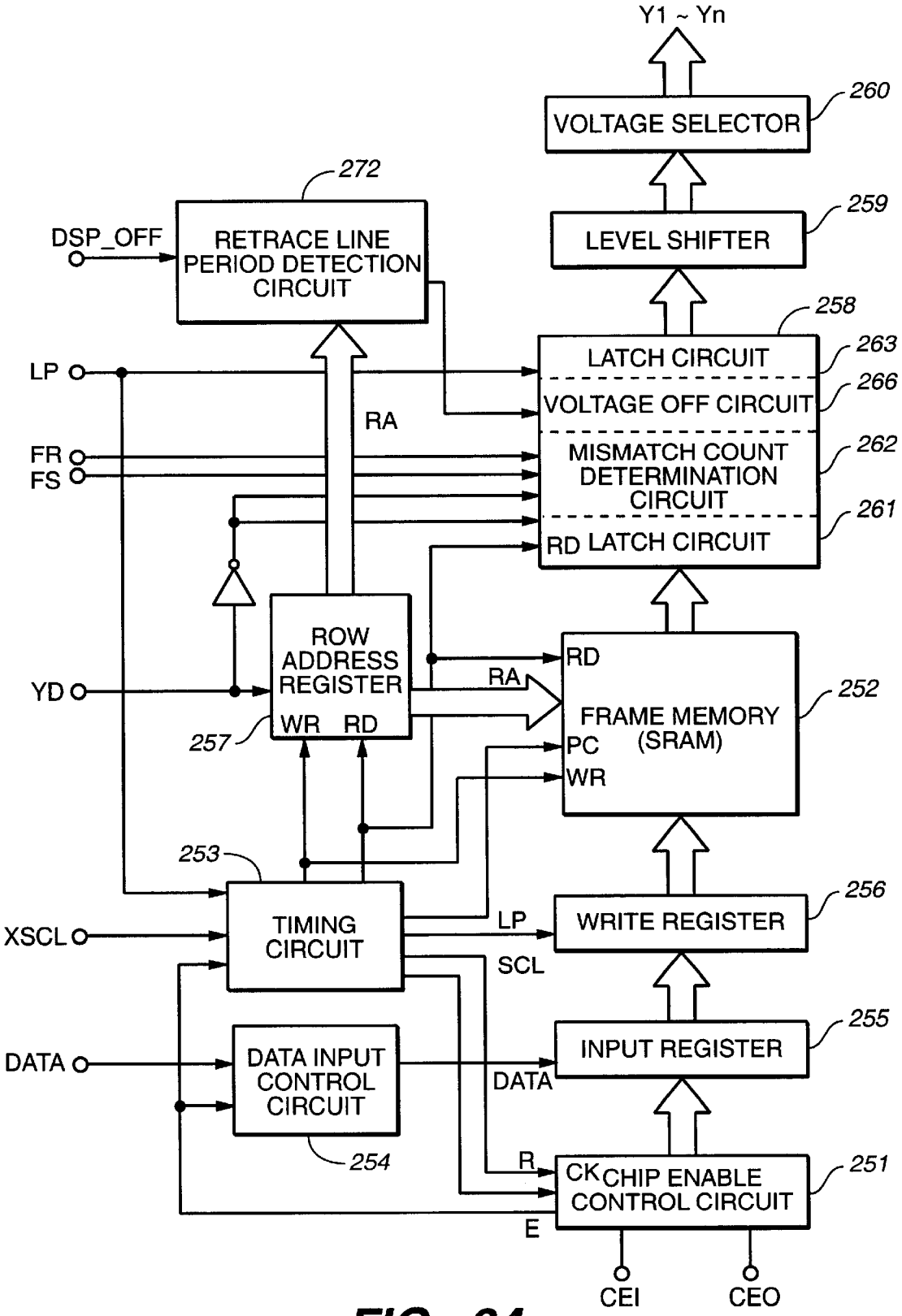
FIG. 34 shows a modified configuration example (overall configuration of the data line drive circuit) related to Embodiment 4.

As shown in FIG. 34, retrace line period detection circuit 272 can be configured to detect the retrace line period by decoding the address value of row address register 257. In this case, as shown in FIG. 35, retrace line period detection circuit 272 receives the address signal (RA signal) from row address register 257, and detects 241H through 245H of the retrace line period with decoder 2850. Address signal (RA signal) consists of 8 bits (RA1–RA7). By obtaining the AND result of the upper four bits of these 8 bits, it is possible to detect address values 240 (241H period) and higher among the address values that begin at 0. Furthermore, since only a single 4-input AND gate is required, a compact circuit size can be achieved.

Additionally, as shown in FIG. 36, voltage determination circuit 267, which integrates a mismatch count detection circuit and a voltage OFF circuit, can be configured to maintain a constant voltage during the retrace line period.

FIG. 37 is a circuit diagram of voltage determination circuit 267 when the gate is configured for simultaneous selection of four lines.

Scanning pattern generation circuit 91 determines the levels of scanning pattern signals C1–C4. The number of mismatches between the scanning pattern and the image data for four lines output from the frame memory is detected by four EX_OR gates 92–95, and is then converted into a 3-bit (D2, D1, and D0) mismatch count by adder circuit 96. This 3-bit mismatch count is decoded by decode circuit 97 into signals sw1–sw5 which select five levels of potentials (VY1–VY5). The D_OFF signal is input into this decode circuit 97, and when this signal is Low, only sw3 goes High and VY3 is selected. If the D_OFF signal is High, the voltage level that corresponds to the detected mismatch count is selected.

As explained in Embodiment 3, it is also possible to use ROMs to configure voltage determination circuit 267.

FIG. 38 shows the configuration of voltage determination circuit 267.

Voltage determination circuit 267 consists of ROMs 601–605 and PC circuits 606–610. The details of this configuration will be omitted here since they were already explained using FIGS. 21 and 22.

The display OFF signal (D_OFF signal) is input into these ROM circuits 601–605, and VY3 is selected if the D_OFF signal is Low, and the voltage is determined based on the mismatch count if the D_OFF signal is High.

When the D_OFF signal is Low, the N-channel transistors connected to the D_OFF signal all go off, the ROM circuit output goes High, and V×5 is not selected.

Note that only ROM 603 can output a low-level signal by shutting off the normal output and creating a route leading to Vss (Low) when the D_OFF signal level is Low.

As explained above, according to this embodiment, crosstalk can be eliminated by making all the data line drive voltage levels identical, even when the multi-line drive method is used.

Next, Embodiment 5 will be explained.

EMBODIMENT 5

(A) Characteristics of Embodiment 5

This embodiment relates to a scanning line drive circuit (X driver). This embodiment can provide a scanning line drive circuit (X driver) that works with low power consumption without requiring a high-frequency clock, and that achieves further reduction in power consumption and smaller size by setting the shift register step count to m/h (where m is a scanning output count, and h is the number of scanning lines to be simultaneously selected).

(B) Problems Identified by the Inventors

FIG. 59 is a diagram showing the configuration of the scanning line drive circuit (X driver) evaluated by the inventors before the present invention.

As shown in FIG. 59, the scanning line drive circuit (X driver) is configured by cascading three integrated circuit (IC) chips 9000, 9010, and 9020, for example. integrated circuit (IC) chip 9000 is the leading chip, and integrated circuit (IC) chips 9010 and 9020 are subordinate chips. In the figure, FS is the pin that outputs carry signals, and FSI is the pin for receiving the carry signals. Carry signals output from integrated circuit (IC) chip 9020 are returned to the leading chip IC chip 9000.

FIG. 51 shows an internal configuration example of integrated circuit (IC) chip 9000 when two scanning lines are simultaneously driven. As shown in FIG. 51, each of the integrated circuit (IC) chips constituting the scanning line drive circuit possesses code generation area 1201, first shift register 1202, second shift register 1203, level shifter 1204, decoder 1205, and voltage selector 1206.

The scanning line drive voltage is, for example, "+V1" or "−V1" during selection and "0" during non-selection, and thus there are a total of three levels. Note that "V1" and "−V1" are equivalent to "V×1" and "−V×1" in FIG. 39B. To select one of these three levels, 2-bit control information is required, and thus 2-step shift registers 1202 and 1203 are provided in FIG. 51.

Since there are n scanning lines (X1–Xn), the bit counts of shift registers 1202 and 1203 are both n. For example, if one integrated circuit (IC) chip is used for driving a total of 120 scanning lines, the bit counts of shift registers 1202 and 1203 are both 120.

The integrated circuit (IC) chip configuration in a case involving simultaneous drive of four lines could be that shown in FIG. 52, for example. As the number of scanning lines to be simultaneously driven increases, so does the shift register capacity.

(C) Contents of Embodiment 5

FIG. 41 shows the overall configuration of a liquid crystal display device. Unlike in conventional cases, scanning line drive circuit 2200 in this embodiment requires only one shift register 102. Furthermore, the bit count of shift register 102 need only be n/h (where n is the total number of scanning lines, and h is the number of scanning lines to be simultaneously driven), resulting in a significantly simpler circuit configuration than before.

This simplification is achieved by separately processing the data required for selecting scanning lines and the data required for determining the voltage to be supplied to the scanning lines.

In other words, in a conventional method, the information concerning the scanning line to be driven and the drive voltage to be used is grouped together and stored in the shift register.

By contrast, in this embodiment, a group of h scanning lines is treated as a single scanning line by focusing on the fact that the MLS drive method sequentially drives a group of h adjacent scanning lines. This approach reduces the bit count of the shift register, that stores the information for specifying the scanning line to be driven, down to n/h (where n is the total number of scanning lines, and h is the number of scanning lines to be simultaneously driven).

Meanwhile, the data for specifying a drive voltage can be easily generated by the code generation area. Furthermore, by entering the data for specifying a drive voltage and the data for specifying a scanning line into a decoder for decoding, a scanning line control signal can be generated that is the same as before. As shown in FIG. 51, the new decoder can be obtained by making only small improvements to a conventional decoder, and thus the circuit can be simplified by simply reducing the bit count of the shift registers.

In other words, as shown in FIG. 41, the data that is output from shift register 102 is the selection data for sequentially selecting groups of four scanning lines. Data D0–D3 for selecting voltage output V1 or −V1 for the group of four scanning lines selected is input into decoder 103 in parallel. This configuration uses a bit count of 30 for the shift registers, resulting in lower power consumption and smaller circuit size.

(D) Specific Circuit Configuration of Embodiment 5

The specifics of a case in which four scanning lines are simultaneously selected and one integrated circuit (IC) chip is used for driving a total of 120 scanning lines are explained below.

FIG. 42 is a specific circuit diagram of scanning line drive circuit 2200. Code generation area 101 comprises counter 201 which is reset by signal YD and which counts selection pulse LP; pattern decoder 202 which comprises ROM that outputs data D0, D1, D2, and D3 based on the address in counter 201 and signal FR; latch 203 which latches this data; buffer inverters 204 and 205 which run using signal LP as their clock; circuit 206 for generating leading chip identification signals MS, signal YD, and data SD which is to be entered from signal FSI to the shift register; and delay line 207.

Next, decoder 103, level shifter 104, and voltage selector 105 will be explained. The circuit shown in FIG. 42 outputs voltage to four scanning lines (X1, X2, X3, and X4).

The leading output of the shift register is labeled SH1. This SH1 is commonly input into all decoders. Data D1, D2, D3, and D4 are input into decoder 103. Signal DOFF which forces the voltage to 0 potential is also input into decoder 103.

After data (D0, D1, D2, and D3) is decoded by decoder 103 into switching signals for individual voltages, +V×1, 0, or −V×1 is selected by level shifter 104 and voltage selector 105, and is output to X1, X2, X3, and X4.

To summarize the logic operation, SH1 is a signal that indicates whether Y1 through Y4 are selected (High) or not selected (Low). If SH1 is Low, output potentials Y1 through Y4 are determined regardless of whether the signals for D0 through D3 are High or Low. For example, if D0 is High, Y1 outputs V1; if D0 is Low, Y1 outputs −V1. Likewise, voltages Y2 through Y4 are determined according to D1 through D3.

FIG. 43 is a timing chart for a case in which four scanning lines are simultaneously selected.

One frame period is defined to consist of 240 scanning periods (LPs). In this case, the two integrated circuit (IC) chips shown in FIG. 59 are cascaded. When signal YD is input into the leading chip, signal SH1 first goes High for only a single LP period.

Shift register 102 shifts data for each LP. To finish scanning all 240 scanning lines once requires 60 selection pulse LPs, and these constitute a single field.

When the scanning of a single field is finished, signal FS of the cascaded subordinate chip is input as signal FSI for the leading chip, as shown in FIG. 43. Then, signal SH1 goes High again, and the operation for sequentially selecting four scanning lines begins again.

In this way, field 2, field 3, field 4, etc. are selected, and the operation for a single frame is completed. The operation explained above is repeated for subsequent frames.

Although the above explanation involves simultaneous selection of four scanning lines, the present invention is not limited to such a case, and the shift register can be configured to have 60 steps if two scanning lines are to be selected simultaneously, and 15 steps if eight scanning lines are to be simultaneously selected. It is obvious that the present invention can be applied to cases in which the number of scanning lines to be simultaneously selected is two or greater.

Next, a modified example of Embodiment 5 will be explained.

FIG. 44 shows the configuration of the modified example. In FIG. 41, level shifter 104 is located behind decoder 103. In FIG. 44, decoder 504 is located behind level shifter 503.

The input of level shifter 503 consists of 30 signals, i.e., the output of shift register 502 (SH1–SH30), and four signals, i.e., data D0–D3 from code generation area 501. Therefore, the total bit count of the level shifter need be only 34. This further simplifies the circuit compared to that in FIG. 41 in which a level shifter with 360 (=120×3) bits is required.

FIG. 45 shows the configuration of another modified example.

In FIG. 45, code generation area 601 is internally divided into register controller 601 and pattern decoder 602. Pattern decoder 602 possesses input pins for accepting scanning voltage pattern data PD1 and PD0. Scanning pattern data PD1 and PD0 is sent from data line drive circuit (Y driver) 2100.

Even when the pattern to be used is changed in the mismatch detection circuit of data line drive circuit (Y driver) 2100, the scanning voltage pattern change is sent to scanning line drive circuit (X driver) as pattern data PD1 and PD0. Therefore, it is possible to change the column pattern output sequence according to the scanning pattern used by data line drive circuit (Y driver) 2100, without having to change the circuit configuration of scanning line drive circuit (X driver). This will be explained in more detail in Embodiment 6 below.

Additionally, counter 201 which was required before pattern decoder 202 is no longer required, and the pattern decoder itself need not count 240 selection pulse LPs for example, and need differentiate among only four patterns, resulting in a smaller size. As a result, further size reduction can be achieved for the liquid crystal display device.

FIGS. 46 and 47 show circuit examples of pattern decoder 602. FIGS. 48A and 48B schematically show scanning patterns.

Pattern decoder 602 in FIG. 46 decodes the scanning voltage pattern shown in FIG. 48A, and pattern decoder 602 in FIG. 47 decodes the scanning voltage pattern shown in FIG. 48B.

The explanation below uses the scanning voltage pattern in FIG. 48A for display. The scanning voltage pattern in FIG. 48A schematically shows the selection voltages of the four scanning lines to be selected, and "+" and "−" indicate "V1" and "−V1," respectively.

For example, V1 is selected for all of the scanning lines selected in the first field. V1 is selected for the first and second lines selected in the second field, and V1 is selected for the third and fourth lines.

However, it is known that selecting the same pattern for an entire field causes crosstalk and flickering in the display. Therefore, an output voltage pattern is sometimes used for applying to lines 1 through 16, a display pattern that starts with the first field and then sequentially changes to the fourth field, and for applying to lines 17 through 32, a display pattern that starts with the second field and then sequentially changes to the third, fourth, and first fields.

In this case, because lines 1 through 16 are selected based on the first four selection pulse LPs and lines 17 through 32 are selected based on the next four selection pulse LPs, the display explained above can be achieved by simply entering the signal for differentiating patterns for every 4 LPs into input pins PD1 and PD0 of the pattern decoder.

The scanning voltage pattern can be easily changed to that shown in FIG. 48B by changing the input of the AND gate of the pattern decoder. Alternating drive is also possible in which signal FR is used to alternately select "V1" and "−V1."

Although a pattern decoder circuit using gate circuits was used in the explanation above, the same effects can be obtained using a ROM-based configuration.

FIG. 49 shows another modified example.

The modified example in FIG. 49 is a circuit diagram showing the internal configuration of register controller 601 shown in FIG. 45. FIG. 50 is a timing chart showing the operation of the circuit in FIG. 45.

If one frame period is equivalent to 240 selection pulses (LPs), each scanning line is normally selected four times during a single frame period as shown in FIG. 43, and voltage V1, 0, or −V1 is applied. However, the display will be disturbed if the retrace line period is included (single frame in FIG. 50 corresponds to 245 LPs).

This is because the counter continues to count and the operation for selecting scanning lines is resumed even during the retrace line period, and as a result unnecessary voltage is applied to the liquid crystal display panel. To correct this display problem, it is necessary to force the input of a DOFF signal from outside during the retrace line period, and to set the potential of signal SD to 0 V.

In FIG. 49, retrace line period processing circuit 1001 is added in order to eliminate the need for forcing the input of a DOFF signal from outside.

The operation of retrace line period processing circuit 1001 in FIG. 49 is explained using the timing chart in FIG. 50. In FIG. 50, the number of scanning lines to be driven is 240, one frame period is equivalent to 245 selection pulses (LPs), and the retrace line period is equivalent to five selection pulses (LPs).

Since the total number of scanning lines is 240, two integrated circuit (IC) chips each possessing 120 outputs are cascaded. The timing of changes of FSI and FS, etc. for the leading chip is shown in FIG. 50.

First, when signal YD is input, scanning begins according to signal LP not shown in the figure. The scanning for 120 outputs of the leading chip is finished by the 30th LP, and a high-level signal FS is input into the cascaded subordinate chip. When the scanning for the subordinate chip is finished, a high-level signal FS from the cascaded subordinate chip is input into the leading chip as signal FSI, and the scanning shifts from field 1 to field 2. The above operation is repeated until field 4 is scanned.

During this operation, signals Q10, Q20, and Q30 inside retrace line period processing circuit 1001 are first reset by signal YD to Low, and then go High at the rising edge of signal FSI in the first, second, and third fields, respectively. Signal G10 is a signal for latching signal Q30. This signal G10 prevents signal FSI from passing through AND gate 1002 at time t4 during the retrace line period, thus preventing unnecessary display during the retrace line period.

Next, Embodiment 6 of the invention will be explained.

EMBODIMENT 6

When implementing the MLS drive method, determining the number of scanning lines to be simultaneously driven (h) and selecting the scanning voltage pattern are the most basic and important items. This embodiment explains the number of scanning lines to be simultaneously driven and the scanning voltage pattern that should preferably be used when configuring a liquid crystal display device using the circuit configurations in Embodiments 1 through 5 described above.

(A) According to the evaluation by the inventor, the number of scanning lines to be simultaneously driven should preferably be four (h=4) from the viewpoint of keeping the circuit simple, reducing power consumption, and preventing crosstalk, etc. Furthermore, as the scanning voltage pattern for simultaneously driving four lines, it is preferable to adopt a pattern in which the polarity of one of the four selection pulses used for selecting four lines is opposite the polarity of the other three selection pulses as shown in FIG. 60A (FIG. 28B, FIG. 48B). For example, in FIG. 60A, the pattern in the first column (vertical pattern) is (+, +, −, +).

For example, when such a pattern is used, display that turns on all of the pixels located on a single data line, in effect, applies a uniform selection voltage to all of the pixels during a single frame period. Changes in intensity within a single frame period are also suppressed. Consequently, when displaying black characters on a white screen, flickering can be reduced, contrast can be enhanced, and image quality can be improved. Furthermore, such a pattern is advantageous for grey scale display using the frame gradation method.

To implement MLS drive using the above-mentioned scanning voltage pattern, ROM (decoder) 5 inside the data line drive circuit (Y driver) shown in FIG. 21 can be configured as shown in FIG. 61, for example. Accordingly, pattern decoder (ROM) 202 inside the scanning line drive circuit (X driver) shown in FIG. 42 can be configured as shown in FIG. 61. Viewed in terms of the pattern (horizontal pattern) for each row, as shown in FIG. 60C, the same effects can be obtained by making the polarity of one of the selection pulses different from that of ther selection pulses.

(B) Cyclically changing the scanning voltage pattern reduces the occurrence of both high- and low-frequency components accompanying MLS drive, further reducing crosstalk and flickering. These effects were explained in Embodiment 5 using FIG. 45.

The technique for cyclically changing the scanning voltage pattern is specifically explained below. As shown in FIG. 60B, the patterns for the individual columns will be denoted a, b, c, and d.

As shown in FIG. 62B, if a drive method is used in which one frame period consists of four field periods and all scanning lines are selected once during a single field period, it is better to drive the scanning lines using different multiple scanning voltage patterns during a single field period. In other words, the pattern that cyclically changes as aabbc, bbcd, ccdda, ddaab, or the pattern that cyclically changes as abcda, bcdab, cdabc, dabcd as shown in FIG. 62B can be used. Use of such patterns suppresses changes in intensity of the liquid crystal panel during a single frame period, prevents image flickering, and also reduces the occurrence of crosstalk.

If a single pattern is used within a single field period as shown in FIG. 62A, high- and low-frequency components tend to occur more easily than in the case in FIG. 62B.

FIG. 63 shows a system configuration for implementing the method of changing the scanning voltage pattern cyclically as described above.

One of the characteristics of FIG. 63 is that the scanning voltage pattern can be changed by merely entering a control signal into data line drive circuit (Y driver) 9300 by sending pattern data signals (pattern recognition signals) PD0 and PD1 from data line drive circuit (Y driver) 9300 to scanning line drive circuit (X driver) 2200. The operation of scanning line drive circuit (X driver) 2200 using pattern data signals PD0 and PD1 was explained in detail in Embodiment 5 using FIGS. 45 through 47.

Another characteristic of the system in FIG. 63 is that information can be easily exchanged between scanning line drive circuit (X driver) 2200 and data line drive circuit (X driver) 9300 by sending a carrier signal (signal FS) as a field recognition signal (signal CA) from scanning line drive circuit (Y driver) 2200 to data line drive circuit (Y driver) 9300. In other words, a new special control signal need not be added.

FIG. 65 shows a configuration example of the circuit that generates pattern data PD0 and PD1 for cyclically changing the scanning voltage pattern.

This circuit possesses address counter 9500, selector 9510, two D-type flip-flops 9520 and 9530 which function as a dividing circuit, logic circuits 9540 and 9550, two D-type flip-flops 9560 and 9570, and exclusive-OR circuit 9580.

The circuit in FIG. 65 works according to the timing shown in FIG. 64.

Selector 9510 selects and outputs one of the multiple kinds of clocks sent from address counter 9500 based on an external control signal, for example. The clock output from this selector 9510 functions as the operating clock for the two D-type flip-flops 9560 and 9570.

Field recognition signal CA sent from the scanning line drive circuit and signal YD which indicates the start of a frame period are divided by two D-type flip-flops 9520 and 9530, and as a result, two clock signals CC1 and CC2 with differing periods are formed. Pattern data PD0 and PD1 are generated based on these clock signals CC1 and CC2.

As shown on the bottom side of FIG. 64, one of patterns a through d shown in FIG. 62B is selected according to the voltage level combination of pattern data PD0 and PD1. That is, if both PD0 and PD1 are at the low level, pattern "a" is selected; if PD0 is High and PD1 is Low, pattern "b" is selected; if PD0 is Low and PD1 is High, pattern "c" is selected, and if both PD0 and PD1 are High, pattern "d" is selected.

As explained above, by adopting the configuration in FIG. 63 or 65, MLS drive can be performed while cyclically changing the scanning voltage pattern. When a liquid crystal is driven by the liquid crystal drive method in this embodiment, high-quality, high-gradation display with little crosstalk or flickering can be achieved even when using a liquid crystal display with fast response.

Therefore, using the liquid crystal display device in this embodiment as the display device of an instrument such as a personal computer, increases the product value.

Note that the present invention is not limited to the above-mentioned embodiments, and can be modified in many ways. For example, various voltage levels can be used as the selection voltage or non-selection voltage for the scanning lines.

What is claimed is:

1. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a buffer memory for accumulating display data representing the image to be displayed, said buffer memory comprising (n×M) buffer elements for accumulating at least (n×M) display data representing the image to be displayed;

a frame memory for accumulating the display data from said buffer memory, wherein the (n×M) display data is written simultaneously in parallel into said frame memory, and a data line drive circuit for determining a data voltage signal to be applied to the M data lines in accordance with a comparison between the selection voltage pattern applied by said scanning line drive circuit and the (n×M) display data accumulated in said frame memory, and for applying the determined data voltage signal to the M data lines.

2. A display device according to claim 1, wherein said buffer memory comprises:

a shift register for temporarily storing the (M) display data, and a latch for accumulating (n×M) display data.

3. A display device according to claim 1, wherein said buffer memory comprises a shift register for temporarily storing (n×M) display data.

4. A display device according to claim 1, wherein said buffer memory comprises (n×M) transparent latches.

5. A display device according to claim 1, wherein multiple pieces of data can be simultaneously written into said buffer memory.

6. A display device according to claim 1, wherein said frame memory and said buffer memory are integrally formed into said data line drive circuit.

7. A display device according to claim 1, wherein said frame memory and said buffer memory are integrally formed in a controller that controls operations of said scanning line drive circuit and said data line drive circuit.

8. A display device according to claim 1, wherein said frame memory and said buffer memory are integrally formed into an independent memory unit.

9. A display device according to claim 1, wherein the number of scanning lines n to be simultaneously selected is expressed as $n=2^k$ (where k is a natural number).

10. A display device according to claim 9 wherein k=2 and n=4.

11. A display device having a M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N; and a data line drive circuit comprising a mismatch determination circuit for determining a data voltage signal to be applied to the M data lines in accordance with a number of mismatches between the selection voltage pattern applied by said scanning line drive circuit and the display data accumulated in said frame, and for applying the determined data voltage signal to the M data lines, wherein said mismatch determination circuit comprises a read only memory (ROM), wherein said ROM comprises of a set of ROM circuits where the display data and a data representing the selection voltage pattern are provided, and the set of ROM circuits detecting certain mismatch counts.

12. A display device according to claim 11, wherein said ROM comprises:

a plurality of insulative gate-type transistors each comprising a source, a drain and a gate; and input lines for inputting the display data and the selection voltage pattern; and output lines formed by connecting in series in a predetermined arrangement said source and said drain of corresponding ones of said plurality insulative gate-type transistors; and wherein said ROM can be programmed through connection/disconnection among said input lines and said gate of corresponding ones of said plurality insulative gate-type transistors.

13. A display device according to claim 12, wherein said insulating gate-type transistors comprise n-channel MOSFETs.

14. A display device according to claim 11, wherein the n scanning lines simultaneously selected is $2^k$, wherein k=2 and n=4, and wherein said ROM circuits consists of 42 (=4+9+16+9+4) columns.

15. A display device according to claim 11, further comprising a plurality of precharge circuits for precharging said ROM circuits and a number of said precharge circuits is smaller than the number of columns in said ROM circuits.

16. A display device according to claim 11, further comprising precharge circuits for precharging the output lines of said ROM circuits.

17. A display device according to claim 11, further comprising signal lines for relaying precharge signals for controlling start/finish of precharge operations of said precharge circuits, said signal lines comprising delay lines.

18. A display device according to claim 17, wherein said the delay lines comprise polysilicon.

19. A display device according to claim 11, wherein the number of scanning lines n to be simultaneously selected is expressed as $n=2^k$ (where k is a natural number).

20. A display device according to claim 19, wherein k=2 and n=4.

21. A display device according to claim 20, wherein the selection voltage pattern to be input into said ROM is such that a polarity of a voltage to be applied to one of the four scanning lines to be simultaneously selected is opposite a polarity of a voltage to be applied to the other three of the four scanning lines.

22. A display device according to claim 20, wherein a number of selection pulses to be supplied to each scanning line during a single frame period is w, wherein w=4k, and wherein said selection voltage pattern to be input into said ROM is such that a polarity of k pulses out of the w selection pulses is different from the polarity of the other w-k selection pulses.

23. A display device according to claim 11, wherein the selection voltage pattern to be input into ROM changes cyclically during a single frame period.

24. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N; and a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said data line drive circuit comprising a data line OFF circuit for applying a common voltage to all of the M data lines during periods of non-contribution for displaying the image.

25. A display device according to claim 24, wherein the number of scanning lines n to be simultaneously selected is expressed as $n=2^k$ (where k is a natural number).

26. A display device according to claim 25, wherein k=2 and n=4.

27. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N; and a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said data line drive circuit comprising a data line OFF circuit for applying a common voltage to all of the M data lines during periods of non-contribution for displaying the image, wherein said OFF circuit is externally controlled.

28. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N; and a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said data line drive circuit comprising a data line OFF circuit for applying a common voltage to all of the M data lines during periods of non-contribution for displaying the image, wherein said OFF circuit comprises a blank period detection circuit for detecting a blank period, and wherein said OFF circuit applies the common voltage to the M data lines during the blank period detected by said blank period detection circuit.

29. A display device according to claim 28, wherein said blank period detection circuit comprises a counter for counting a number of filed status signals (FS), each of which indicates the start of a field period.

30. A display device according to claim 28, wherein said blank period detection circuit comprises a decoder for decoding frame memory addresses.

31. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N; and a data line drive circuit comprising a voltage determination circuit for determining a data voltage signal to be applied to the M data lines according to the number of mismatches between the selection voltage pattern and display data representing the image and for applying the determined data voltage signal to the M data lines, and for applying a common voltage to all of the M data lines during the periods of non-contribution to displaying the image.

32. A display device according to claim 31, wherein the number of scanning lines n to be simultaneously selected is expressed as $n=2^k$ (where k is a natural number).

33. A display device according to claim 32, wherein k=2 and n=4.

34. A display device according to claim 31, wherein said voltage determination circuit comprises a read-only memory (ROM), wherein said ROM comprises:

a plurality of insulative gate-type transistors each comprising a source, a drain and a gate; and a first input line into for receiving a control signal for applying common voltage to all M data lines, and a second input lines for inputting the display data and the selection voltage pattern; and a plurality of output lines formed by connecting in series in a predetermined arrangement said source and said drain of corresponding ones of said plurality insulative gate-type transistors; and wherein said ROM can be programmed through connection/disconnection among said input lines and said gate of corresponding ones of said plurality insulative gate-type transistors, wherein said first input line is commonly connected to said plurality of output lines, and wherein output levels of all said multiple output lines can be fixed at a common potential by setting a voltage level of the control signal that is input via said first input line at a predetermined level.

35. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said scanning line drive circuit comprising (N/n) stage shift for storing the data that specifies the group of the n scanning lines to be selected;

a decoder for generating a signal that indicates the scanning line to be driven by said scanning line drive circuit and a drive voltage level by decoding both the data that specifies the voltage level to be applied to the scanning line and an output from said (N/n) stage shift register; and a code generation circuit for generating the data that specifies the voltage level to be applied to the scanning line.

36. A display device according to claim 35, wherein the number of scanning lines n to be simultaneously selected is expressed as $n=2^k$ (where k is a natural number).

37. A display device according to claim 36, wherein k=2 and n=4.

38. A display device according to claim 35, wherein the selection voltage pattern changes cyclically during a single frame period.

39. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said scanning line drive circuit comprising a (N/n) stage shift register for storing the data that specifies the n scanning lines to be selected;

a decoder for generating a signal that indicates the scanning line to be driven by said scanning line drive circuit and a drive voltage level by decoding both the data that specifies the voltage level to be applied to the scanning line and an output from said (N/n) stage shift register; and a code generation circuit for generating the data that specifies the voltage level to be applied to the scanning line;

wherein said code generation circuit comprises an input circuit to input control signals that control the voltage level to be applied to the scanning lines.

40. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said scanning line drive circuit comprising a (N/n) stage shift register for storing the data that specifies the n scanning lines to be selected;

a decoder for generating a signal that indicates the scanning line to be driven by said scanning line drive circuit and a drive voltage level by decoding both the data that specifies the voltage level to be applied to the scanning line and an output from said (N/n) stage shift register; and a code generation circuit for generating the data that specifies the voltage level to be applied to the scanning line;

wherein the data that specifies the voltage level to be applied to the scanning line contains information of a polarity of the voltage to be applied to one of the n scanning lines to be simultaneously selected and is different from the polarity of the voltage to be applied to the other n-1 scanning lines.

41. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said scanning line drive circuit comprising a (N/n) stage shift register for storing the data that specifies the n scanning lines to be selected, a decoder for generating a signal that indicates the scanning line to be driven by said scanning line drive circuit and a drive voltage level by decoding both the data that specifies the voltage level to be applied to the scanning line and an output from said (N/n) stage shift register; and a code generation circuit for generating the data that specifies the voltage level to be applied to the scanning line;

wherein when a number of scanning lines to be simultaneously selected is n and the number of selection pulses to be supplied to each scanning line during a single frame period is w, wherein w is a natural number of at least 2, the data that specifies the voltage level to be applied to the scanning line contains the information for achieving drive such that a relationship, in which the polarity of one of said w selection pulses is different from the polarity of the other (w−1) selection pulses.

42. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said scanning line drive circuit comprising a (N/n) stage shift register for storing the data that specifies the n scanning lines to be selected;

a decoder for generating a signal that indicates the scanning line to be driven by said scanning line drive circuit and a drive voltage level by decoding both the data that specifies the voltage level to be applied to the scanning line and an output from said (N/n) stage shift register; and a code generation circuit for generating the data that specifies the voltage level to be applied to the scanning line;

wherein said code generation circuit comprises a retrace line processing circuit for inhibiting the data that specifies the scanning line to be driven to said shift registers during a retrace line period.

43. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines; and wherein, when a single frame consists of a plurality of fields, said scanning line drive circuit drives each group of n scanning lines by using multiple different selection voltage patterns during single ones of the field periods and selects all of the N scanning lines once during the single field period, and wherein said scanning line drive circuit and said data line drive circuit drive the scanning lines and data lines, respectively, based on the same selection voltage pattern by exchanging with each other information on the applied selection voltage pattern.

44. A display device according to claim 43, wherein the information for specifying a selection voltage pattern is input into one of said scanning line drive circuit and said data line drive circuit, and relays the information to the other one of said scanning line drive circuit and said data line drive circuit.

45. A display device having M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit comprising a mismatch determination circuit for determining the number of mismatches between said selection voltage pattern and said display data, wherein said mismatch determination circuit comprises a read-only memory (ROM), wherein said ROM comprises:

a plurality of insulative gate-type transistors each comprising a source, a drain and a gate; and a first input line for inputting the display data and the selection voltage pattern; and output lines formed by connecting in series in a predetermined arrangement said source and said drain of corresponding ones of said plurality insulative gate-type transistors; and wherein said ROM can be programmed through connection/disconnection among said input lines and said gate of corresponding ones of said plurality insulative gate-type transistors, and for applying the determined data voltage signal to the M data lines; and;

a code generation circuit for generating both the data that specifies the n scanning lines to be driven and the data that specifies the voltage level to be applied to the n scanning lines, and said code generation circuit comprising an input circuit to control signals that control the voltage level to be applied to the scanning lines, and wherein the selection voltage pattern information to be input into said ROM is also input to said code generation circuit via the input circuit for said control signal.

46. An electronic instrument comprising a display device comprising:

M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a buffer memory for accumulating display data representing the image to be displayed, said buffer memory comprising (n×M) buffer elements for accumulating at least (n×M) display data representing the image to be displayed;

a frame memory for accumulating the display data from said buffer memory, wherein the (n×M) display data is written into said frame memory with the same timing, and a data line drive circuit for determining a data voltage signal to be applied to the M data lines in accordance with a comparison between the selection voltage pattern applied by said scanning line drive circuit and the (n×M) display data accumulated in said frame memory, and for applying the determined data voltage signal to the M data lines.

47. An electronic instrument comprising a display device comprising:

M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N;

a data line drive circuit comprising a mismatch determination circuit for determining a data voltage signal to be applied to the M data lines in accordance with a number of mismatches between the selection voltage pattern applied by said scanning line drive circuit and the display data accumulated in said frame, and for applying the determined data voltage signal to the M data lines, wherein said mismatch determination circuit comprises a read only memory (ROM).

48. An electronic instrument comprising a display device comprising:

M data lines and N scanning lines arranged in a matrix and forming a plurality of display elements disposed at intersections of the M data and N scanning lines, wherein N and M are each integers greater than 1, for displaying an image, said display device comprising:

a scanning line drive circuit for applying a scanning voltage signal possessing a specified selection voltage pattern simultaneously to n scanning lines from among the N scanning lines, wherein n is an integer greater than 1 and less than N; and a data line drive circuit for determining a data voltage signal to be applied to the M data lines in accordance with a comparison between the selection voltage pattern applied by said scanning line drive circuit and the displayed image represented by display data, and for applying the determined data voltage signal to the M data lines, said data line drive circuit comprising a data line OFF circuit for applying a common voltage to all of the M data lines during periods of non-contribution for displaying the image.

49. A method of driving a display device provided with a matrix panel comprising M data lines and N scanning lines arranged in a matrix and forming a plurality of display elements disposed at intersections of the M data and N scanning lines, wherein N and M are each integers greater than 1, for displaying an image, the method comprises the steps of:

providing scanning signals from a scanning line drive circuit and data signals from a data line drive circuit for driving the display elements by simultaneously selecting multiple scanning lines from among the scanning lines and applying a scanning voltage signal possessing a specified selection voltage pattern, and by determining the voltage to be applied to said data lines based on the comparison between said selection voltage pattern and the display data representing the image; and driving each group of multiple scanning lines by using multiple different selection voltage patterns during a single field period, wherein the single frame consists of multiple fields, selecting all scanning lines once during the single field period, exchanging the information on the selection voltage between the scanning line drive circuit and the data line drive circuit for driving the scanning lines and data lines, respectively, based on the same selection voltage pattern.

50. A method of claim 49, wherein, when the information for specifying a selection voltage pattern is input into a first one of the scanning line drive circuit and the data line drive circuit, the first one that has received the information relays the information to the other one for driving of scanning lines and data lines based on the same selection voltage pattern.

* * * * *

UNITED STATES PATENT AND TRADEMARK OFFICE

CERTIFICATE OF CORRECTION

PATENT NO. : 6,252,572 B1
DATED : June 26, 2001
INVENTOR(S) : Takashi Kurumisawa et al.

It is certified that error appears in the above-identified patent and that said Letters Patent is hereby corrected as shown below:

Title page,
Item [56], References Cited, U.S. PATENT DOCUMENTS, correct "4,693,569" to -- 4,693,563 --.

Signed and Sealed this

Nineteenth Day of March, 2002

*Attest:*

*Attesting Officer*

JAMES E. ROGAN
*Director of the United States Patent and Trademark Office*